US007068955B2

(12) United States Patent
Yamamoto et al.

(10) Patent No.: US 7,068,955 B2
(45) Date of Patent: Jun. 27, 2006

(54) IMAGE FORMING APPARATUS HAVING DEVELOPER AMOUNT DETECTOR

(75) Inventors: Shinya Yamamoto, Shizuoka-Ken (JP); Hiroshi Sasame, Shizuoka-Ken (JP); Kazushige Sakurai, Shizuoka-Ken (JP); Takashi Hibi, Shizuoka-Ken (JP); Hiroaki Ogata, Shizuoka-Ken (JP); Tomomi Kakeshita, Shizuoka-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 10/386,687

(22) Filed: Mar. 13, 2003

(65) Prior Publication Data

US 2003/0175039 A1 Sep. 18, 2003

Related U.S. Application Data

(62) Division of application No. 09/650,752, filed on Aug. 29, 2000, now Pat. No. 6,912,366.

(30) Foreign Application Priority Data

| | | |
|---|---|---|
| Aug. 31, 1999 | (JP) | 11-246611 |
| Oct. 15, 1999 | (JP) | 11-294576 |
| Nov. 15, 1999 | (JP) | 11-324684 |
| Dec. 15, 1999 | (JP) | 11-356728 |
| Dec. 15, 1999 | (JP) | 11-356729 |
| Jan. 14, 2000 | (JP) | 2000-007218 |

(51) Int. Cl.
*G03G 15/08* (2006.01)

(52) U.S. Cl. ..... 399/27

(58) Field of Classification Search ..... 399/27, 399/24, 25

See application file for complete search history.

(56) References Cited

U.S. PATENT DOCUMENTS

| | | | | |
|---|---|---|---|---|
| 4,647,185 | A * | 3/1987 | Takeda et al. | 399/27 |
| 5,095,335 | A | 3/1992 | Watanabe et al. | 355/210 |
| 5,126,800 | A | 6/1992 | Shishido et al. | 355/211 |
| 5,270,783 | A | 12/1993 | Bisaiji et al. | 399/62 |
| 5,283,613 | A | 2/1994 | Midgley, Sr. | 355/203 |
| 5,298,951 | A * | 3/1994 | Kai | 399/27 |
| 5,475,471 | A | 12/1995 | Kisu et al. | 355/219 |
| 5,534,344 | A | 7/1996 | Kisu et al. | 428/323 |
| 5,541,711 | A | 7/1996 | Kisu et al. | 355/219 |

(Continued)

FOREIGN PATENT DOCUMENTS

JP 06186855 A * 7/1994

(Continued)

OTHER PUBLICATIONS partial translation of cited reference JP10-133528a.*

(Continued)

*Primary Examiner*—Quana M. Grainger
(74) *Attorney, Agent, or Firm*—Fitzpatrick, Cella, Harper & Scinto

(57) ABSTRACT

An image forming apparatus or a cartridge detachably attachable to the image forming apparatus is provided, wherein the apparatus comprises developer container for containing developer, developer amount detecting means for detecting an amount of the developer contained in the developer container, a memory for memorizing information concerning the amount of the developer detected by the detecting means and output means for outputting the information concerning the amount of the developer, and the output means outputs the information concerning the developer memorized in the memory until the detection result of the detecting means is confirmed.

6 Claims, 25 Drawing Sheets

U.S. PATENT DOCUMENTS

| | | | | |
|---|---|---|---|---|
| 5,546,167 | A | | 8/1996 | Ogata et al. ..... 355/219 |
| 5,678,141 | A | | 10/1997 | Asano et al. ..... 399/115 |
| 5,708,912 | A | | 1/1998 | Lee ..... 399/24 |
| 5,765,077 | A | | 6/1998 | Sakurai et al. ..... 399/176 |
| 5,835,817 | A | | 11/1998 | Bullock et al. ..... 399/25 |
| 5,835,818 | A | | 11/1998 | Hoshika et al. ..... 399/26 |
| 5,864,731 | A | | 1/1999 | Ikemoto et al. ..... 399/27 |
| 5,923,917 | A | | 7/1999 | Sakurai et al. ..... 399/27 |
| 5,946,522 | A | * | 8/1999 | Inami ..... 399/27 |
| 5,995,774 | A | | 11/1999 | Applegate et al. ..... 399/27 |
| 6,264,301 | B1 | | 7/2001 | Helterline et al. ..... 347/19 |
| 6,330,402 | B1 | | 12/2001 | Sakurai et al. ..... 399/27 |
| 6,347,198 | B1 | | 2/2002 | Yamamoto et al. ..... 399/12 |
| 6,397,018 | B1 | | 5/2002 | Matsumoto et al. ..... 399/27 |
| 6,496,664 | B1 | | 12/2002 | Ogata et al. ..... 399/62 |

FOREIGN PATENT DOCUMENTS

| | | | | |
|---|---|---|---|---|
| JP | 10-133528 | A | | 5/1998 |
| JP | 10-133543 | | | 5/1998 |
| JP | 11052687 | A | * | 2/1999 |
| JP | 11272064 | A | * | 10/1999 |

OTHER PUBLICATIONS

Patent Abstracts of Japan, vol. 1999, No. 04, Apr. 30, 1999 (JP 11-015252)—Jan. 22, 1999.

* cited by examiner

©

IMAGE FORMING APPARATUS HAVING DEVELOPER AMOUNT DETECTOR

CROSS REFERENCE TO RELATED APPLICATION

This Application is a divisional of U.S. patent application Ser. No. 09/650,752, filed Aug. 29, 2000 now U.S. Pat. No. 6,912,366.

BACKGROUND OF THE INVENTION

1. Field of the Invention

This invention relates to an image forming apparatus for forming an electrostatic latent image in an image bearing body and developing the electrostatic latent image with developer stored in a developing apparatus, and more particularly to an image forming apparatus having a remaining developer amount detecting device provided with remaining developer amount detecting means capable of serially detecting the remaining amount of developer stored in a developer container as well as a cartridge that can be inserted in the image forming apparatus main body, that is, a process cartridge, a developing apparatus constituted as a cartridge.

Here, for example, an image forming apparatus using electrophotography technology includes an electrophotographic copying machine, an electrophotographic printer, such as an LED printer, a laser beam printer and the like, an electrophotographic facsimile apparatus and so on.

In addition, a process cartridge refers to a cartridge integrally constituted by at least one of charging means, developing means and cleaning means, and an electrophotosensitive body, which is made detachably attachable to an electrophotographic image forming apparatus main body, or a cartridge integrally constituted by at least developing means and an electrophotosensitive body, which is made detachably attachable to an electrophotographic image forming apparatus main body.

2. Related Background Art

In a conventional image forming apparatus using, for example, an electrophotographic image forming process, a process-cartridge method is adopted in which the cartridge is integrally constituted by an electrophotographic sensitive body and process means affecting the electronic electrophotosensitive body and is made to be detachably attachable to an electrophotographic image forming apparatus main body. In accordance with the process-cartridge method, since the maintenance of the apparatus can be conducted by a user in person and not by a serviceman, the operability is considerably improved. Hence, the process-cartridge method is widely used in electrophotographic image forming apparatuses.

In an electrophotographic image forming apparatus using a process-cartridge method, although an image can be formed again by replacing a cartridge when developer is exhausted, the replacement of a cartridge should be performed by a user in person and, therefore, means for warning a user when developer is exhausted, i.e., a remaining developer amount detecting device, is required.

A remaining developer amount detecting device has remaining developer amount detecting means that can detect a remaining-developer-amount level in a cartridge or an image forming apparatus main body in order to make it possible to find at any time how much developer is left to serve to form images in the cartridge.

There is the flat antenna method as one method of this remaining developer amount detecting means. A flat antenna, as shown in FIG. 3, has a pair of conductor patterns 22, 23 having a predetermined interval therebetween and formed on a substrate 21, which are disposed in a position contacting developer on an inner side of a developer container and, as the amount of developer in the developer container decreases, the contacting area of the developer and the flat antenna 20 also decreases.

The electrostatic capacity varies as the contacting area of the conductor pattern surface and the developer changes due to the consumption of the developer, and this makes it possible to represent the relationship between the remaining developer amount in the container and the electrostatic capacity of the flat antenna, and the remaining developer amount in the container can be found at any time by measuring the electrostatic capacity of the flat antenna.

The electrostatic capacity of the flat antenna 20 is obtained by applying a constant alternate current bias on one of the pair of conductor portions 22, 23 and detecting the current flowing to the other conductor part at that time.

In fact, since there is a slight remaining developer sticking to the surface of the flat antenna 20 even if the developer in the developer container decreases little by little, the surface of the flat antenna is cleaned as an agitating member rotates with an antenna cleaning member attached to the agitating member provided in the developer container.

However, the output of the flat antenna 20 changes in a cycle in accordance with the timing at which the cleaning member cleans the antenna surface, by cleaning the antenna surface in this way. Thus, the remaining developer amount level is confirmed by statistical processing, such as finding the average value or choosing the minimum value depending on the cycle.

However, even if the remaining developer amount detecting means such as the flat antenna 20 capable of detecting the remaining developer level is provided as described above, the remaining developer amount level cannot always be found. For example, immediately after the power from a power source of the image forming apparatus main body is inputted, the remaining developer amount in the cartridge is unknown. A certain length of time is required until a measurement result is obtained because it is not until the apparatus is made to operate such as to form a certain number of images that the remaining developer amount level is confirmed.

Therefore, immediately after power from the power source of the image forming apparatus main body is inputted, immediately after a cartridge is once taken out and inserted again for jam processing or in other similar cases, there is a problem that the user cannot immediately find if there is a developer amount sufficient for a number of pieces of papers to be printed in the cartridge.

In addition, there is a possibility that the remaining developer amount detecting means such as the flat antenna 20 capable of detecting the remaining developer amount level breaks down. Causes of failures might be electronic failures, such as a defective contact and a defective application bias or mechanical failures, such as damage to the flat antenna 20. In any case, the possibility that both the image forming apparatus and the cartridge are critically affected is high.

Therefore, it is desired that whether the remaining developer amount detecting means breaks down or not is made to be detectable immediately after inserting a process cartridge in the image forming apparatus, and at least before the image forming apparatus forms an image and that both the image forming apparatus and the cartridge are prevented from being affected critically.

A similar problem occurs when the remaining developer amount in a developer container provided in the image forming apparatus main body or in developer container and the like of the developing apparatus constituted as a cartridge is detected by the remaining developer amount detecting means.

SUMMARY OF THE INVENTION

The present invention has been devised in view of the above problems and it is an object of the present invention to provide an image forming apparatus capable of always indicating the remaining developer amount.

It is another object of the present invention to provide an image forming apparatus capable of indicating the remaining developer amount even during the measurement of the remaining amount.

It is another object of the present invention to provide an image forming apparatus capable of detecting precisely an abnormality of an apparatus.

It is another object of the present invention to provide an image forming apparatus capable of promptly detecting an abnormality of an apparatus.

It is another object of the present invention to provide an image forming apparatus comprising:

a developer container for containing developer;

developer amount detecting means for detecting the amount of the developer contained in the developer container;

a memory for memorizing information concerning the developer amount detected by the detecting means; and output means for outputting the information concerning the amount of the developer, wherein the output means outputs the information concerning the developer memorized in the memory until the detection results of the detecting means is confirmed.

It is another object of the present invention to provide an image forming apparatus comprising:

a developer container for containing developer;

developer amount detecting means for detecting the amount of the developer contained in the developer container;

a memory for memorizing the remaining developer amount detected by the detecting means, the remaining amount information memorized in the memory being serially updated; and output means for outputting the remaining developer amount information, the output means outputting any one of the remaining developer amount information memorized in the memory or the remaining developer amount information to be detected by the detecting means.

It is another object of the present invention to provide a cartridge comprising:

a developer container; and a memory for memorizing the remaining developer amount in the developer container, wherein the remaining amount information memorized in the memory is serially updated.

It is another object of the present invention to provide an image forming apparatus comprising:

a developer container for containing developer;

developer amount detecting means for detecting the amount of the developer contained in the developer container;

a memory for memorizing the remaining developer amount detected by the detecting means, remaining amount information memorized in the memory being serially updated; and comparing means for comparing the remaining developer amount information memorized in the memory and the remaining developer amount information to be detected by the detecting means.

It is another object of the present invention to provide an image forming apparatus comprising:

a developer container for containing developer;

developer amount detecting means for detecting an amount of the developer contained in the developer container;

a memory for memorizing information concerning the developer amount detected by the detecting means, the memory memorizing first information indicating that a remaining developer amount is less than a predetermined amount and second information indicating that no developer remains; and output means for outputting information indicating an abnormality of the apparatus when the detecting means detects the second information when the first information is not memorized in the memory.

It is another object of the present invention to provide a cartridge comprising:

a developer container; and a memory for memorizing first information indicating that the remaining developer amount in the developer container is less than a predetermined amount and second information indicating that no developer remains.

It is another object of the present invention to provide an image forming apparatus comprising:

a developer container for containing developer; and developer amount detecting means for detecting the amount of the developer contained in the developer container, wherein the detecting means can detect the amount of the developer by a first detecting method and a second detecting method having a detection time shorter than that of the first detecting method.

Further objects of the present invention will be apparent by reading the following detailed description with reference to the attached drawings.

DESCRIPTION OF THE PREFERRED EMBODIMENTS

Figure 1:
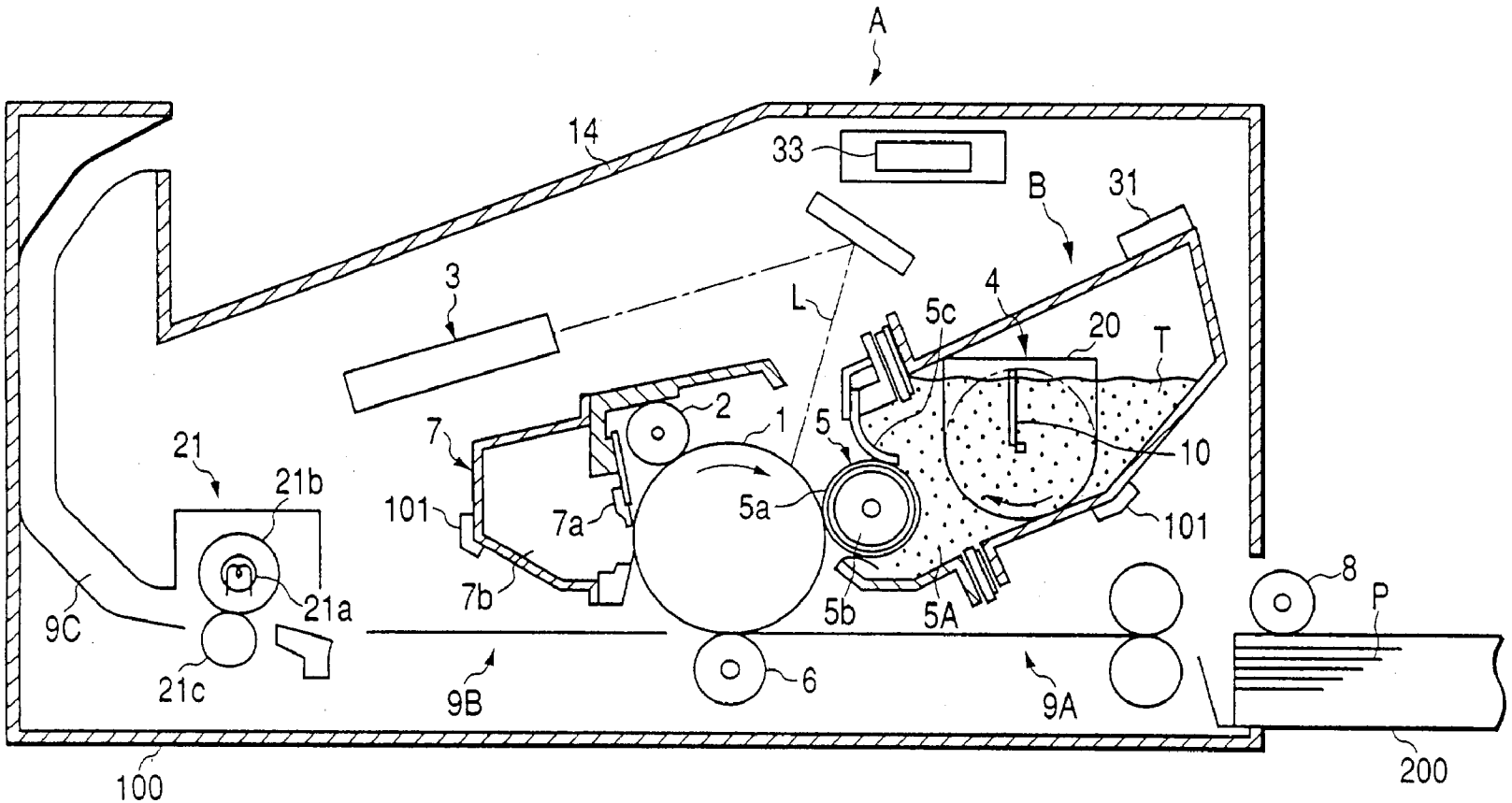
FIG. 1 is a cross sectional view of an image forming apparatus relating to all the embodiments of the present invention.

An image forming apparatus and a cartridge detachably attachable to the image forming apparatus in accordance with the present invention will now be described more in detail with reference to the attached drawings.

First Embodiment

An embodiment of an electrophotographic image forming apparatus configured in accordance with the present invention to which a process cartridge is detachably attachable will first be described with reference to FIG. 1 through FIG. 3. In this embodiment, an electrophotographic image forming apparatus is a laser beam printer A of the electrophotographic type and forms an image on a recording material, for example, recording paper, an OHP sheet and cloth by an electrophotographic image forming process.

The laser beam printer A has a drum-shaped electrophotosensitive body, i.e., a photosensitive drum 1. The photosensitive drum 1 is charged by a charging roller 2 as charging means and then a latent image corresponding to image information is formed on the photosensitive drum 1 by irradiating the drum 1 with a laser beam L corresponding to image information from a laser scanner 3. The latent image is developed by developing means 5 and is made a visible image, i.e., a toner image.

That is, the developing means 5 has a developing chamber 5A provided with a developing roller 5*a* as developer bearing body and forwards developer T in the developer container 4 being a developer containing portion formed adjacent to the developing chamber 5A to the developing roller 5*a* of the developing chamber 5A by the rotation of a developer forwarding member 21. In this embodiment, an insulative one component toner is used as the developer T. In addition, the developing roller 5*a* incorporates a fixed magnet 5*b*, and the developer is conveyed by rotating the developing roller 5*a*, applying a friction electrifying charge by a developing blade 5*c*, making developer layer with a predetermined thickness, and supplying the developer to a developing region of the photosensitive drum 1. The developer supplied to the developing region is transferred to the latent image on the photosensitive drum 1 and forms a toner image. The developing roller 5*a* is connected to a developing bias circuit and is usually impressed with developing bias voltage, which is alternating current superimposed on direct current.

On the other hand, a recording material P set in a sheet feeding cassette 200 synchronously with the formation of a toner image is conveyed to a transferring position via pick-up roller 8 and conveying means 9A. A transferring roller 6 is disposed as transferring means in the transferring position and transfers the toner image on the photosensitive drum 1 to the recording material P by impressing voltage.

The recording material P having received the transfer of the toner image is conveyed to fixing means 21 by conveying means 9B. The fixing means 21 is provided with a fixing roller 21*b* incorporating a heater 21*a* and a driving roller 21*c*, and applies heat and voltage on the recording material P passing through the fixing means to fix the transferred toner image on the recording material P.

The recording material P is discharged to a discharging tray 14 by conveying means 9C. The discharging tray 14 is provided on the upper surface of an apparatus body 100 of the laser beam printer A.

The photosensitive drum 1 after transferring the toner image to the recording material P by the transferring roller 6 is applied to the next image-forming process after removing the developer remaining on the photosensitive drum 1 by cleaning means 7. The cleaning means 7 scratches off the remained developer on the photosensitive drum 1 by an elastic cleaning blade 7*a* provided so as to contact the photosensitive drum 1 and collects the remained developer in a waste developer keeping tank 7*b*.

Figure 2:
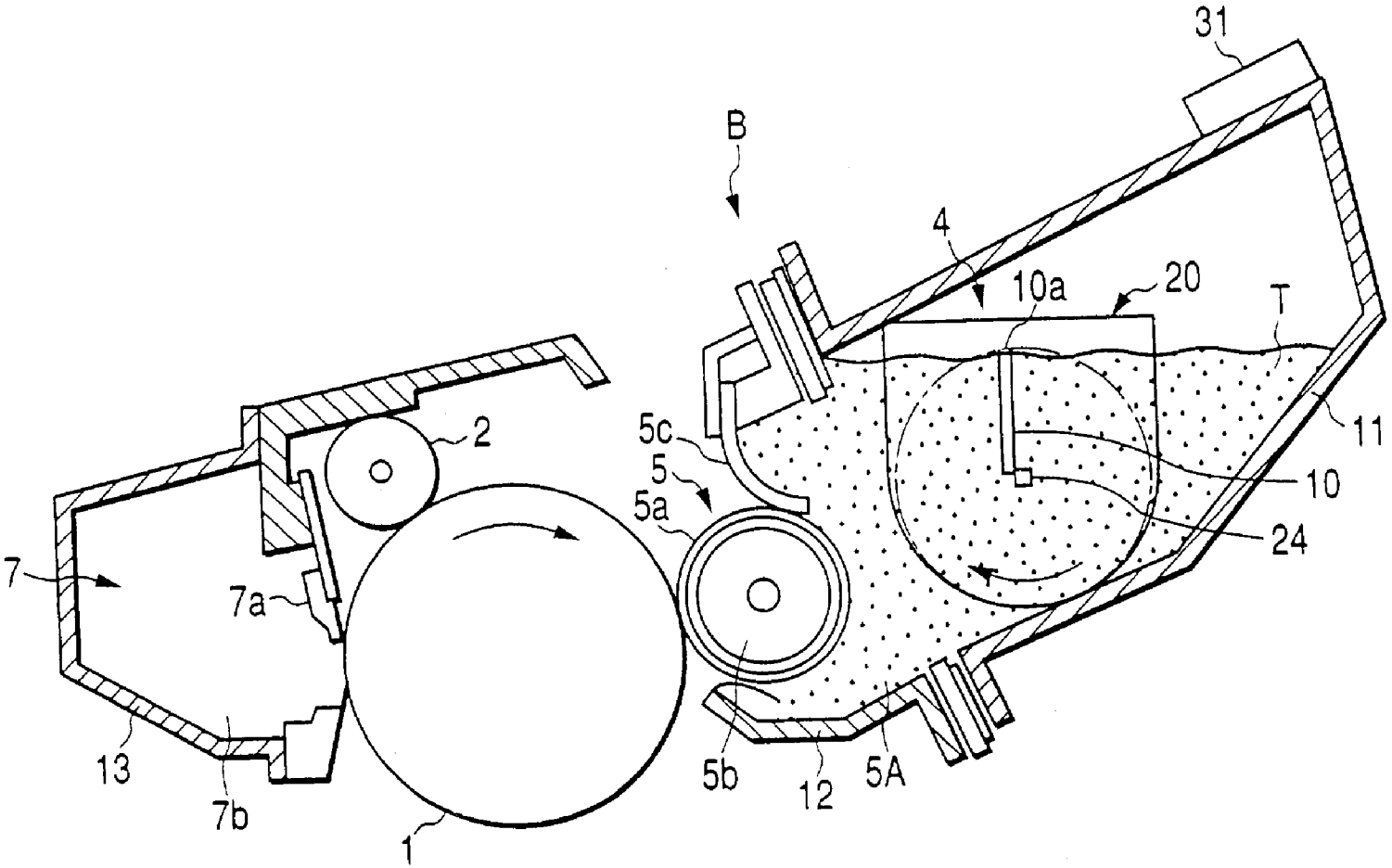
FIG. 2 is a cross sectional view of a process cartridge of the present invention.

On the other hand, in a process cartridge B of the embodiment, as shown FIG. 2, a developing unit is formed by integrally welding a developer frame body 11 having a developer container (a developer containing portion) 4 containing a developer and a developer forwarding member 21 and a developing frame 12 holding a developing means 5 such as a developing roller 5*a* and a developing blade 5*c*, and the cartridge B is formed as a cartridge by further integrally coupling a cleaning frame body 13 to which a photosensitive drum 1, cleaning means 7 such as a cleaning blade 7*a* and a charging roller 2 are attached, to the developing unit.

The process cartridge B is equipped with detachably attachable cartridge inserting means 101 (FIG. 1) provided in the image forming apparatus main body 100 by a user.

Figure 4:
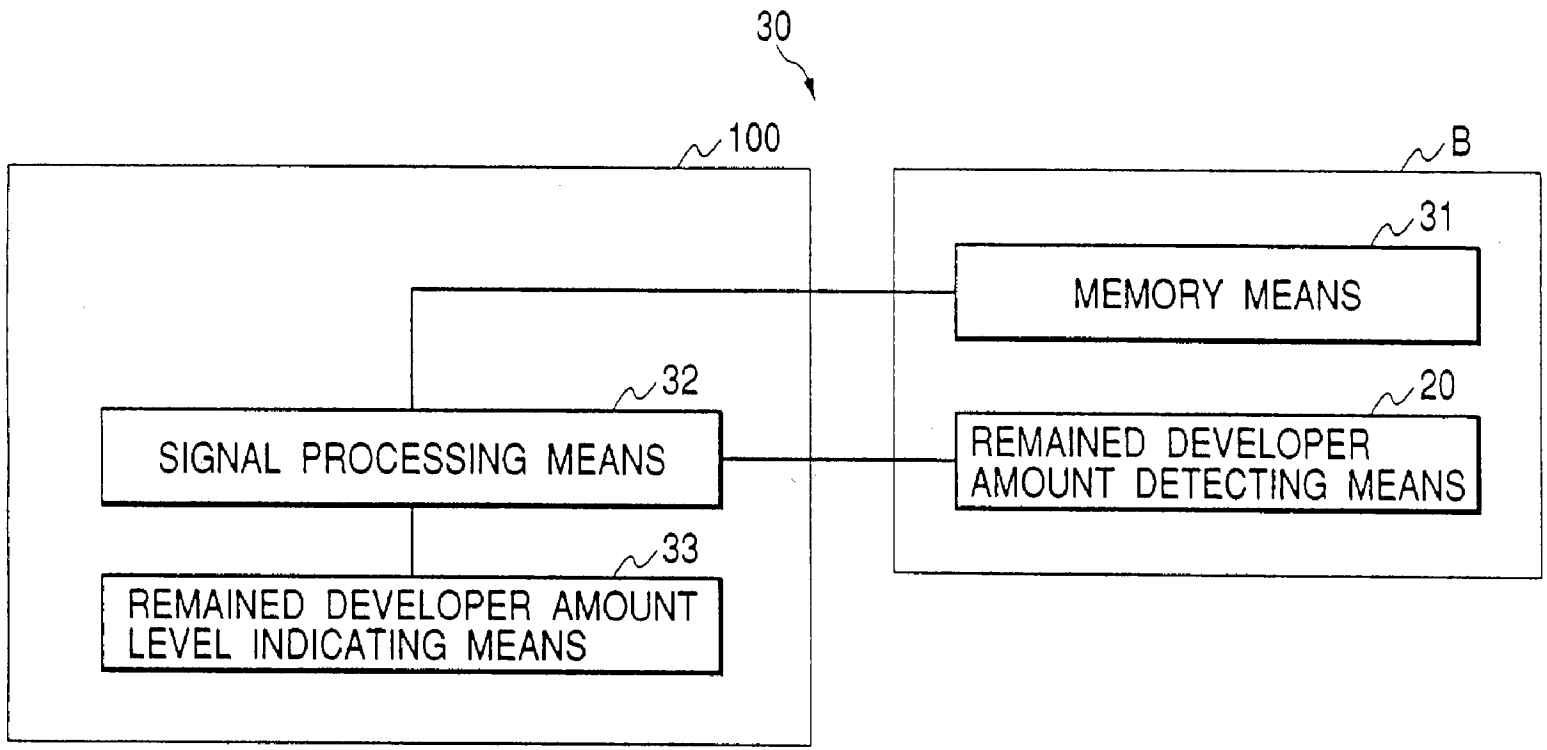
FIG. 4 is a block diagram showing the relationship between an image forming apparatus and a cartridge relating to the first embodiment of the present invention.

In accordance with the present invention, as shown in FIG. 4, the process cartridge B has a developer amount detecting device 30 provided with the remaining developer amount detecting means 20 capable of serially detecting a remaining developer amount in accordance with the consumption of the developer T in the developer container 4.

In accordance with this embodiment, as described above, agitating means 10 rotating in the direction represented by an arrow of FIG. 1 is provided in the developer container 4, and the developer T is supplied to the developing roller 5*a* while softening the developer by rotating the agitating means 10. In addition, a flat antenna 20 is mounted as remaining developer amount detecting means on the internal wall of the developer container 4 as shown in FIG. 3.

The flat antenna 20 is provided by forming two electrodes, i.e., conductor patterns 22, 23 on a generally used printed substrate 21 by etching or printing. In addition, in order to protect this circuit graphics, a protective film (not shown) is formed on the conductor patterns 22, 23. The conductor pattern may be set appropriately, and in this embodiment, the width (W) of two conductor patterns 22, 23 of the flat antenna 20 is set at 300 μm and the interval (G) between both the conductor patterns 22, 23 is as small as approximately 300 μm.

In the flat antenna 20 of this embodiment, when 200 Vpp, 2000 Hz were impressed as an alternating bias between the electrodes 22, 23 of each conductor pattern, different electrostatic values of 20 pF at the time when the developer did not touch the flat antenna 20 and 60 pF at the time when the developer touched the entire surface of the flat antenna 20 were observed.

In accordance with the developer T in the developer container 4 decreasing by repeating an image-forming process, the contacting area of the developer T and the flat antenna 20 decreases and the electrostatic capacity between the electrodes 22, 23 on the flat antenna also decreases accordingly. Therefore, by observing the electrostatic capacity, the amount of the developer T in the container 4 can be found at any time.

However, in fact, even if the developer T in the container 4 deceases gradually, dispersion arises in the measurement results due to the small amount of remaining developer sticking on the flat antenna 20.

Therefore, in order to remove the developer sticking on the surface, an antenna cleaning member 10*a* (FIG. 2) is provided on the end portion of the agitating means 10 to clean the surface of the flat antenna 20 with the agitating means 10 rotating. The antenna cleaning member 10*a* is a sheet made of, for example, PET (polyethylene terephthalate) and cleans the surface of the flat antenna 20 in a stroking manner.

Figure 3:
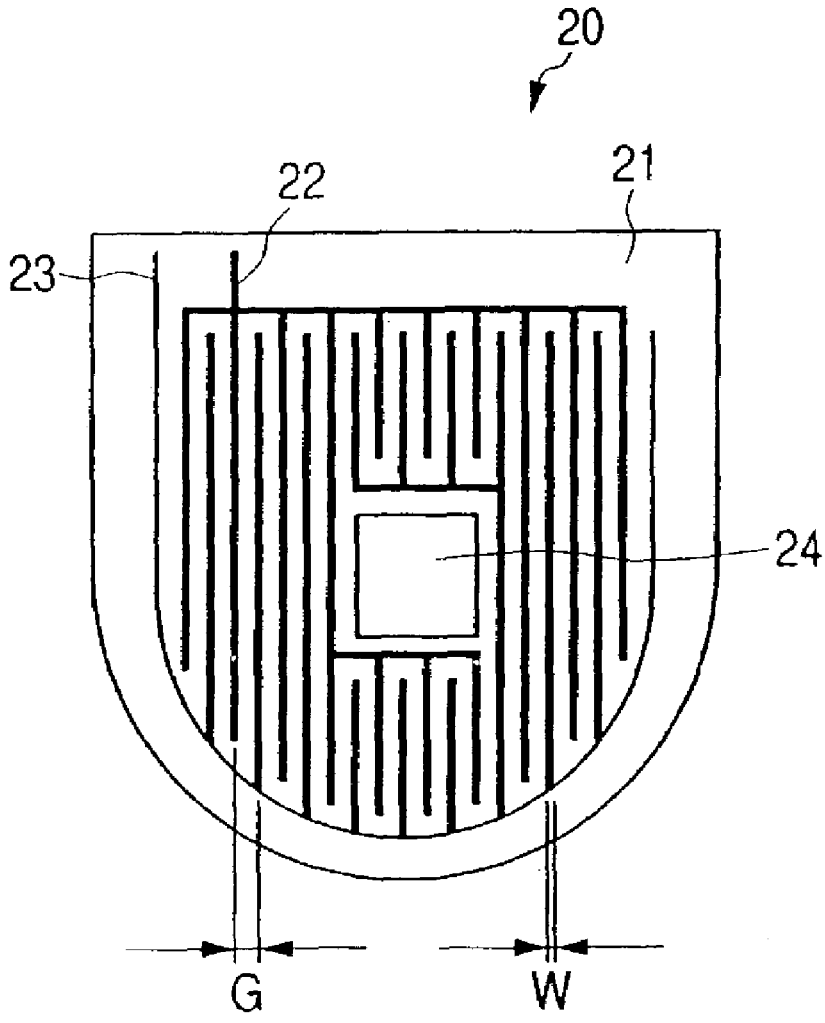
FIG. 3 illustrates an antenna part of the remaining developer amount detecting means relating to all the embodiments of the present invention.

As shown in FIG. 3, by providing a hole 24 in substantially the center portion of the flat antenna 20 and rotatably supporting the shaft of the agitating means 10 against the developer container 4 and the like through the hole 24, substantially the entire region of the flat antenna 20 can be cleaned by a surface cleaning means 10*a*.

Although the dispersion of the measurement results due to the small amount of remaining developer sticking on the flat antenna 20 can be dissolved with the above-mentioned configuration, the output of the flat antenna 20 fluctuates by the rotation cycle of the surface cleaning means 10*a*.

Thus, in this embodiment, the remaining developer amount level is confirmed by statistical processing, such as finding an average of antenna outputs or selecting a minimum value in accordance with the rotation cycle of the surface cleaning means 10*a*.

However, in order to confirm the remaining developer amount level, it is necessary to execute statistical processing of an antenna output in accordance with the rotation cycle of the surface cleaning means 10*a* by impressing bias to the flat antenna 20 as well as by rotating the agitating means 10 and the flat antenna surface cleaning means 10*a*, and hence time is required for such processing.

That is, after the power-source switch of the image forming apparatus main body 100 is turned on to agitate the developer and after a sufficient time elapses, an alarm concerning the developer amount can be indicated on the display of the apparatus main body 100 or the display of a personal computer when a first statistical processing operation is finished, but the remaining developer amount level cannot be indicated immediately after the power-source switch of the image forming apparatus body 100 is turned on, a cartridge is replaced, or jam processing is conducted and so on because there is not enough time to confirm the remaining amount. Therefore, during such period of time, a user cannot find the remaining developer amount level.

In this embodiment, therefore, memory means 31 is disposed in the process cartridge B, in which the confirmed remaining developer amount level is written and memorized at any time, and the remaining amount is indicated on the display of the apparatus main body 100 or the display of a personal computer using this data.

In this way, during the period when sufficient time has not elapsed until the remaining developer amount level is confirmed, such as immediately after the power source switch of the image forming apparatus main body 100 is turned on, a cartridge is replaced, or jam processing is conducted and so on, since the developer amount detecting device 30 can read out the remaining developer amount confirmed and memorized by the previous remaining amount detection and display it, a user can be notified of the remaining amount immediately, even during the period when the remaining developer amount level is not confirmed.

In addition, by mounting the memory means 31 on the process cartridge B, even if the cartridge B is replaced, a user can call the remaining developer amount level information out of the memory means 31 and find the current remaining developer amount level of the cartridge.

Moreover, in order to display a more accurate remaining developer amount level, the developer amount detecting device 30 has signal processing means 32 for comparing the remaining developer amount level value confirmed by processing an output signal of the remaining developer amount detecting means 20 with the remaining developer amount level value memorized in the memory means 31 of the process cartridge B as shown in FIG. 4.

The confirmed remaining developer amount level value and the remaining developer amount level value memorized in the memory means 31 of the process cartridge B are compared in two steps as described below. In the first step, the magnitude of the absolute value of the difference between the two values is checked.

In an apparatus for serially detecting the remaining amount such as the developer amount detecting device 30 of this embodiment, there should not be too large a difference between the remaining developer amount level confirmed by the nth detection and the remaining developer amount level confirmed by the n+1th detection. Thus, if a large difference exceeding the predetermined threshold value X is recognized, it is possible that this is caused by a breakage of the remaining developer amount detecting means 20, a breakage of the surface cleaning means 10*a*, an electric short-circuit, a failure of the image forming apparatus main body and so on.

In the second step, the confirmed remaining developer amount level value and the remaining developer amount level value memorized in the memory means 31 of the process cartridge B are compared.

Theoretically, the currently confirmed remaining developer amount level value is not possibly larger than the remaining developer amount level values confirmed such as at the time of the previous image formation and memorized in the process cartridge. Thus, if the confirmed remaining developer amount level value is larger than the remaining developer amount level value memorized in the memory means 31 of the process cartridge B, this can be regarded as a measurement error.

Further, in this embodiment, a read-writable NVRAM is adopted as the memory means 31 mounted on the process cartridge B. As shown in FIG. 4, means for writing and reading data with respect to the memory means 31 of the developer amount detecting device 30 is provided in the image forming apparatus main body 100 side. In addition, the confirmation of the remaining developer amount level by processing an output signal of the remaining developer amount detecting means 20 and the comparison of the confirmed value and a value in the memory means 31 are conducted by the signal processing means 32 disposed in the image forming apparatus main body 100 side.

Moreover, if the difference between a value memorized in the memory means 31 and a value obtained by the remaining developer amount detecting means 20 is equal to or larger than a predetermined value, it is determined that there is an abnormality or a failure of the process cartridge B or the image forming apparatus main body 100 and a user is informed accordingly.

Figure 5:
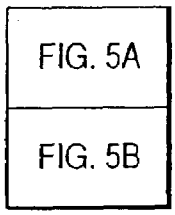
FIG. 5, composed of FIGS. 5A and 5B, is a flow chart of a remaining developer amount indicating system and an abnormality detecting system of the first embodiment of the present invention.
Figure 5A:
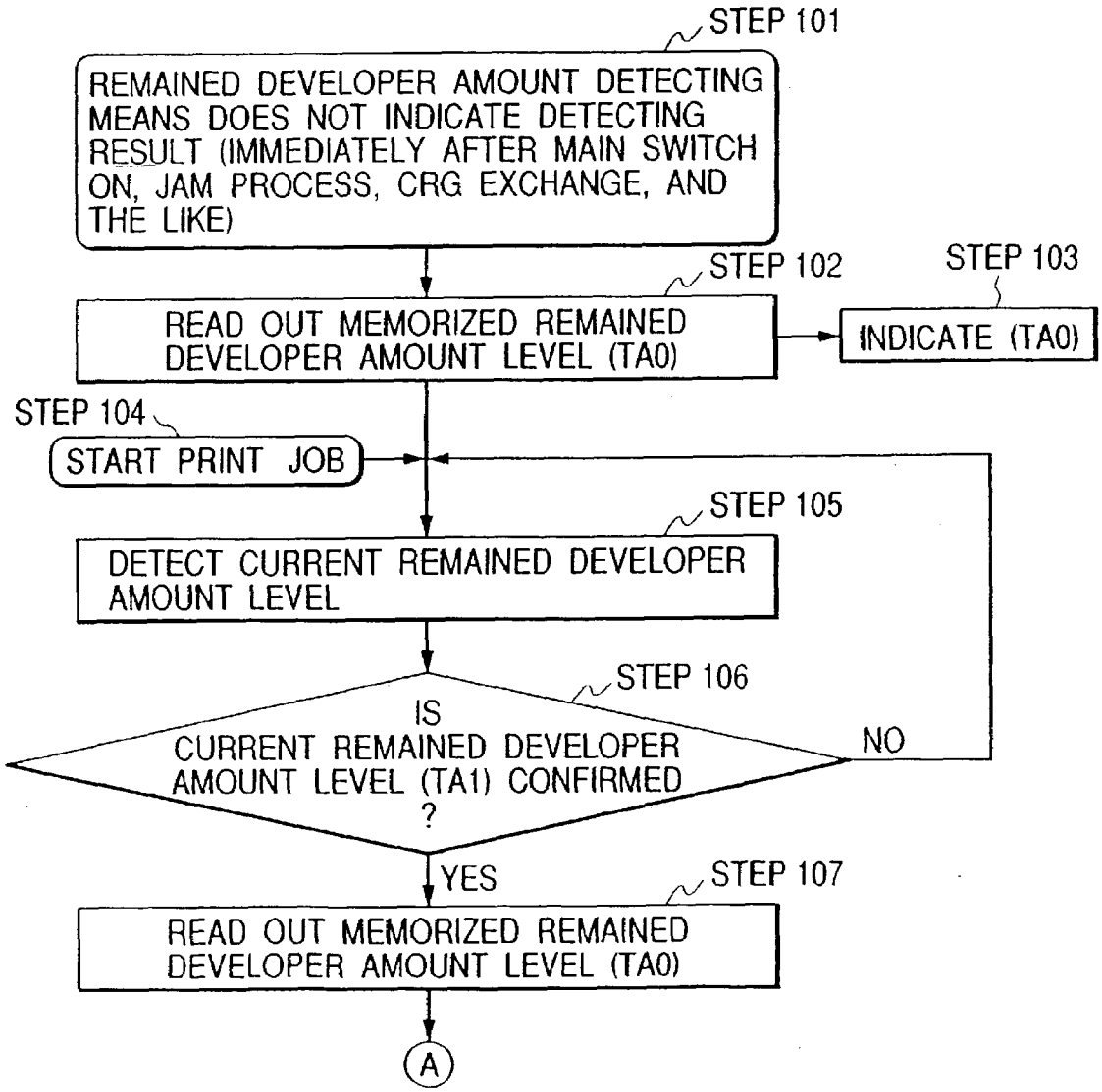
Figure 5B:
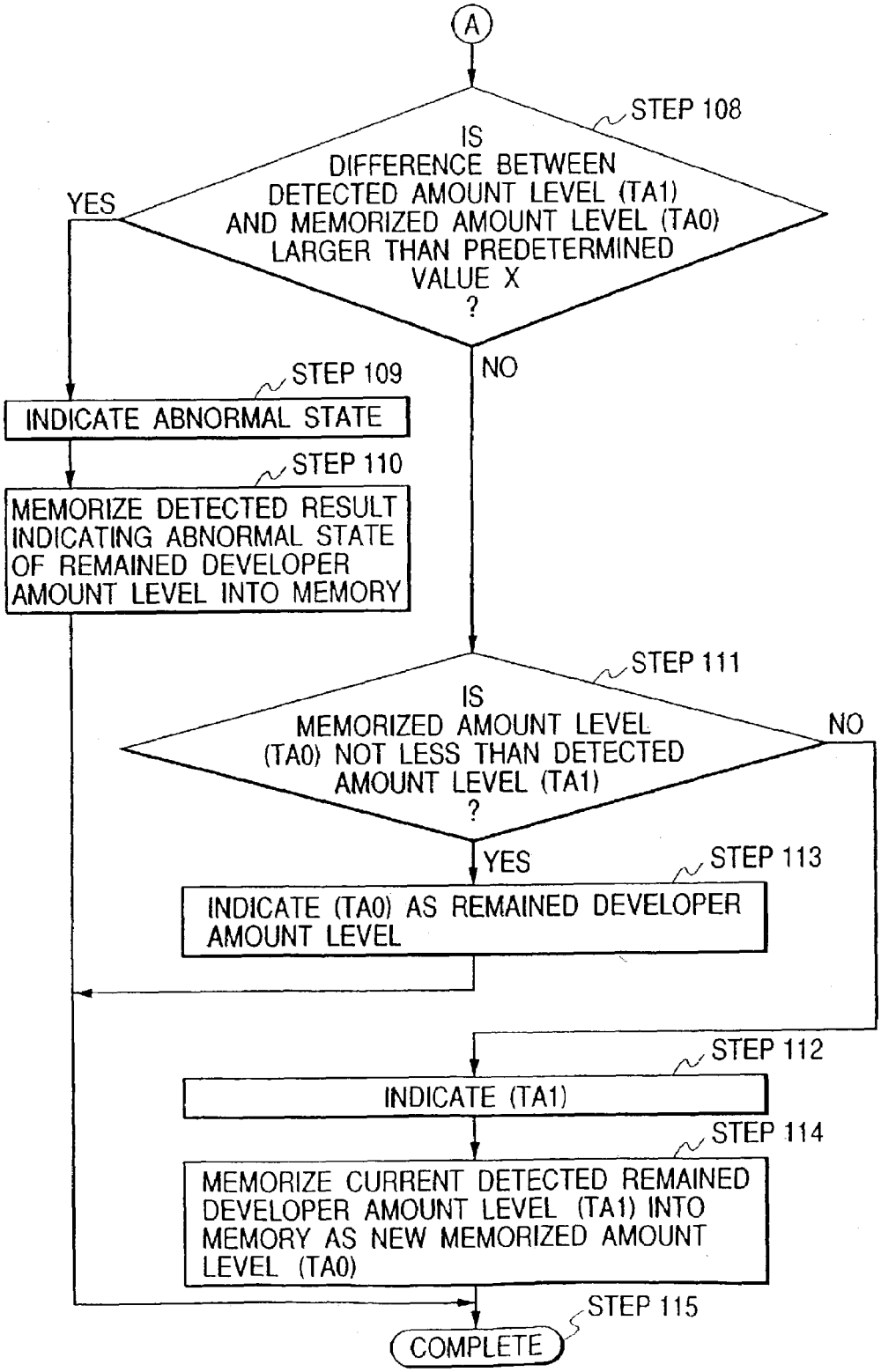

The above-mentioned processing is shown in FIGS. 5A and 5B as a flow chart. A developer amount detecting method in accordance with this embodiment will now be described with reference to FIGS. 5A and 5B.

In this embodiment, it is assumed that the remaining developer amount level is always indicated on the display of the image forming apparatus main body 100 or the display of a personal computer while the apparatus main body 100 is operating.

As described above, if the remaining developer amount level is not confirmed by the remaining developer amount detecting means 20 immediately after the power source of the main body is inputted, a cartridge is replaced or jam processing is conducted and so on (step 101), the image forming apparatus main body 100 reads out a remaining developer amount level TA0 confirmed by the previous remaining amount detection from the memory means 31 mounted on the process cartridge B; (step 102) and indicates TA0 as the remaining developer amount level at that time (step 103). Further, since the amount of a developer which is contained at the factory shipment stage is memorized in the memory means 31 in advance even if the cartridge B is brand-new, this level is read out and indicated until the remaining developer amount level is confirmed.

In addition, if printing is commenced from the status in which a cartridge is inserted and printing has not been performed for a while with the power-source switch of the apparatus main body being kept turned on (step 104), time is also required until the remaining developer amount level is confirmed after the agitation of the developer (cleaning of the antenna) is started, but since the previous remaining developer amount level is already indicated on the display, the processes of step 101 through 103 are not conducted.

A detection by the remaining developer amount detecting means 20 is thereafter executed (step 105) and the remaining developer amount level is confirmed as TA1 by the remaining developer amount detecting means 20 (step 106).

The image forming apparatus main body 100 reads the remaining developer amount level TA0 memorized in the memory means 31 mounted on the process cartridge B (step 107). TA1 and TA0 are compared in the signal processing means 32 (step 108).

As described above, the remaining developer amount level detected and confirmed by the remaining developer amount detecting means 20 is memorized in the memory means 31 mounted on the process cartridge B at any time. Thus, TA1 and TA0 are very close values unless there is any abnormality. Thus, if the difference between these two values is larger than the predetermined value X, it is determined that some abnormality has occurred, and a signal indicating the occurrence is sent (step 109). Indicated contents of the display portion receiving the signal may be the those indicating the occurrence of a failure in the remaining developer amount detecting means 20, the possibility of occurrence of a failure, such as the occurrence of a failure in the main body or the cause of a failure, or may be those indicating the necessity of maintenance, such as indicating that the process cartridge or the main body needs inspection.

In this instance, the remaining developer amount level TA1 is not overwritten in place of the level TA0 in the memory means 31 mounted on the process cartridge B. Thus, the remaining-developer-amount level before the occurrence of the abnormality is stored.

In addition, information of the occurrence of the abnormality is memorized in the memory means 31 (step 110). This makes it possible to display that it is a process cartridge that is likely to have failed in place of the remaining-developer-amount level, even in a case of replacing and inserting, and prevents the use of the cartridge in which the abnormality has occurred.

Moreover, TA1 and TA0 are compared to find which is larger (step 111). If the newly confirmed remaining-developer-amount level TA1 is larger, it is regarded that there is a detection error, and in order to not give a user erroneous information that a remaining-developer-amount level has increased, the remaining-developer-amount level TA0 memorized in the memory means 31 continues to be indicated (step 113).

Thus, the remaining developer amount level TA0 memorized in the memory means 31 is not replaced by TA1. This is important for performing the above-mentioned abnormality detection.

If the remaining-developer-amount level TA1 detected by the remaining developer amount detecting means 20 is smaller than TA0, the former is indicated (step 112), and TA0 in the memory means 31 is thereafter replaced by the value of TA1, which is memorized as new TA0 (step 114).

Although the flat antenna method is used as the remaining developer amount detecting means 20 in this embodiment, the present invention is not limited to the remaining developer amount detecting means of this method. If the remaining developer amount level can be serially detected, other methods such as the agitating torque detecting method in the developer container 4 may be used.

In addition, the signal processing means 32 disposed in the image forming apparatus main body 100 may be mounted on the process cartridge B together with the memory means 31.

By mounting a calculation processing apparatus relating to both the signal processing means 32 and the memory means 31 on the process cartridge B, communications such as writing and reading of data performed between the image forming apparatus main body 100 and the process cartridge B can be simplified. As a result, the possibility of the occurrence of communication errors by a defective contact, a noise and the like is decreased, and a stable detection of the remaining-developer-amount level can be conducted.

Second Embodiment

In the second embodiment, input and output of a data signal in the electrophotographic image forming apparatus described in the first embodiment will be described. In this embodiment, as in the first embodiment, an electrophotographic image forming apparatus is a laser printer A of the electrophotographic method. In addition, a process cartridge B is removably loaded in an image forming apparatus main body 100 by a user.

Figure 6:
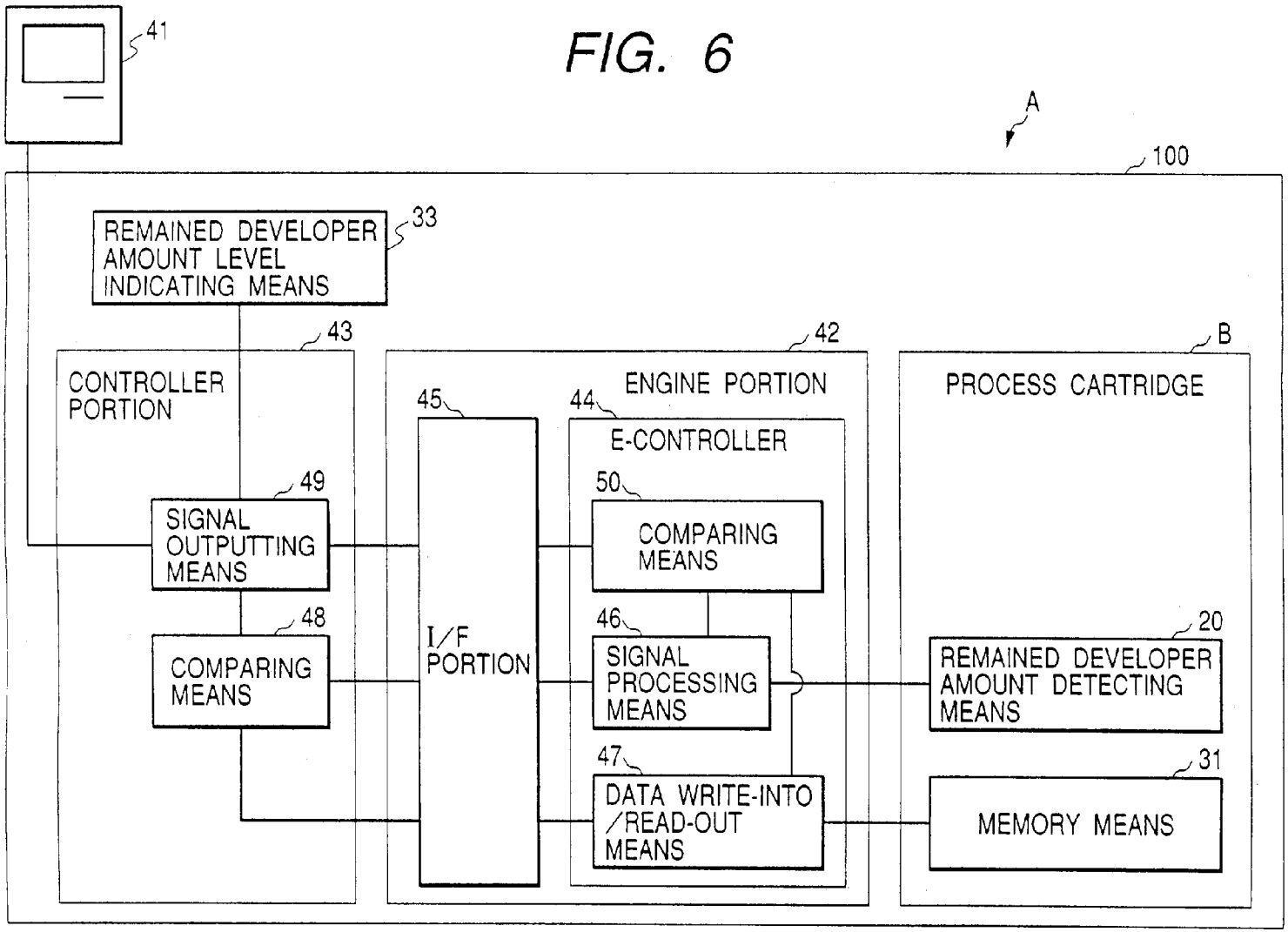
FIG. 6 is a block diagram of an image forming apparatus of the second embodiment of the present invention.

As shown in FIG. 6, the laser printer A is connected to a host 41 such as a personal computer or a workstation and used, and its configuration is roughly divided into an engine portion 42 as image forming means for forming an image on a recording material by an electrophotographic process based on image information, and a controller portion 43 as developing means that is connected to the host 41, and develops a page descriptive language received together with a print requiring signal from the host 41 to image information data.

The overall operations of the engine portion 42 is controlled by an E-controller 44. The controller portion 43 and the engine portion 42 can mutually communicate via a video interface (I/F) 45 forming a part of the E-controller.

This embodiment is characterized in that comparing means 48 having the function of partially executing the comparison of the remaining-developer-amount level value that is an output signal of the remaining-developer-amount detecting means 20 statistically processed and confirmed and the remaining-developer-amount level value memorized in the memory means 31, both described in the first embodiment, and a signal output means 49 for outputting a signal indicating the remaining-developer-amount level and the occurrence of an abnormality to indicating means 33 of the image forming apparatus main body or an apparatus having a display that can communicate with the image forming apparatus are disposed in the controller portion 43.

As described above, by disposing the comparing means 48 and the signal output means 49 in the controller portion 43, it becomes easy to display the remaining-developer-amount level and the occurrence of an abnormality on the host 41 such as a personal computer or a workstation that are an apparatus having a display that can communicate with the image forming apparatus.

As described in the first embodiment, the remaining developer amount in the developer container is confirmed by statistically processing an output from the flat antenna.

The processing is executed in signal processing means 46 disposed in the E-controller 44 of the engine portion 42. The confirmed current remaining-developer-amount-level value is transmitted to the comparing means 48 disposed in the controller portion 43 via the video interface (I/F) 45 from the signal processing means 46.

The remaining-developer-amount level value confirmed in the previous remaining amount detection and memorized in the memory means 31 is simultaneously read out by data writing and reading means 47 disposed in the E-controller 44 of the engine portion 42, and is transmitted to the comparing means 48 disposed in the controller 43 via the video interface (I/F) 45.

That is, there are two lines of outputs relating to the remaining-developer-amount-level value on the video interface (I/F) 45 being communicating means between the controller portion 43 and the engine portion 42.

Absolute values of the difference between both outputs relating to the remaining-developer-amount-level value is compared in the comparing means 48 and disposed in the controller portion 43. If the difference is determined to be equal to or larger than a predetermined value, the signal output means 49 disposed in the controller portion 43, upon receiving the output from the comparing means 48, outputs a signal indicating that an abnormality has occurred to the indicating means 33 provided in the image forming apparatus main body or an apparatus having a display that can communicate with the image forming apparatus.

Operations of the image forming apparatus of this embodiment conform to a flow chart shown in FIGS. 5A and 5B of the first embodiment, and input and output of a data signal of the image forming apparatus in this embodiment will now be described more in detail using the flow chart.

In this embodiment as well, it is assumed that a remaining-developer-amount level is always indicated on the display of the image forming apparatus main body 100 or the display of the host 41 such as a personal computer or a workstation while the apparatus body 100 is operating.

If the remaining-developer-amount level is not confirmed by the remaining developer amount detecting means 20 immediately after the power source switch of the main body is turned on, a cartridge is replaced or jam processing is conducted and so on (step 101), data writing and reading means 47 disposed in the E-controller 44 of the engine portion 42 reads out the remaining-developer-amount level TA0 confirmed in the previous remaining amount detection from the memory means 31 mounted on the process cartridge E3 and transmits it to the signal output means 49 disposed in the controller portion 43 via the video interface (I/F) 45.

Upon receiving the remaining-developer-amount level TA0, the signal output means 49 outputs a signal instructing the indicating means 33 provided in the image forming apparatus main body or the host 41 to display TA0 as the remaining-developer-amount level at that time (step 103).

Further, since the amount of a developer that is contained at the factory shipment stage is memorized in the memory means 31 in advance even if the cartridge B is brand-new, this level is read out and indicated until the remaining-developer-amount level is confirmed.

In addition, if printing is commenced from the status in which a cartridge B is inserted and printing has not been performed for a while with the power-source switch of the apparatus main body being kept turned on (step 104), time is also required until the remaining-developer-amount level is confirmed after the agitation of the developer (cleaning of the antenna) is started, but since the previous remaining developer amount is already indicated on the display, the processes of step 101 through 103 are not conducted.

A detection by the remaining developer amount detecting means 20 is thereafter executed (step 105) and the remaining-developer-amount level is confirmed as TA1 by the signal processing means 46 disposed in the E-controller 44 of the engine portion 42 (step 106).

The signal processing means 46 outputs the confirmed remaining-developer-amount-level value TA1 to the comparing means 48 disposed in the controller portion 43 via the comparing means 50 disposed in the E-controller of the engine portion 42 and the video interface (I/F) 45. The remaining-developer-amount level TA0 memorized in the memory means 31 mounted on the process cartridge B is simultaneously outputted to the comparing means 48 by the data writing and reading means 47 via the comparing means 50 and the video interface (I/F) 45 (step 107).

TA1 and TA0 are compared as follows in the comparing means 50 and the comparing means 48 (step 108).

If the difference is equal to or larger than a predetermined value, upon receiving an output from the comparing means 48 indicating that some abnormality has occurred, the signal output means 49 disposed in the controller portion 43 outputs a signal indicating the occurrence of an abnormality to the indicating means 33 provided in the image forming apparatus main body 100 or the host 41 (step 109).

In addition, the data writing and reading means 47 disposed in the E-controller 44 of the engine portion 42 receives the output from the comparing means 48 via the video interface (I/F) 45, prohibits the memory means 31 mounted on the process cartridge B to overwrite the remaining-developer-amount level TA1 on the level TA0 and causes the memory means 31 to memorize the information indicating the occurrence of an abnormality (step 110).

Moreover, TA1 and TA0 are compared to find which is larger by the comparing means 50 disposed in the E-controller 44 of the engine portion 42 (step 111). If the newly confirmed remaining-developer-amount level TA1 is larger, upon receiving a signal from the comparing means 50, the data writing and reading means 47 disposed in the E-controller 44 of the engine portion 42 reads out the remaining-developer-amount level TA0 confirmed in the previous remaining amount detection from the memory means 31 mounted on the process cartridge B and transmits it to the signal output means 49 disposed in the controller portion 43 via the video interface (I/F) 45 (step 113).

If the remaining-developer-amount level TA1 detected by the remaining developer amount detecting means 20 is smaller than TA0, upon receiving a signal from the comparing means 50, the remaining-developer-amount level TA1 is transmitted to the signal output means 49 disposed in the controller portion 43 from the signal processing means 46 via the video interface (I/F) 45 (step 112).

Moreover, the data writing and reading means 47 receives the signal from the comparing means 50, replaces TA0 in the memory means 31 with the value of TA1 and memorizes it as new TA0 (step 114).

Although, in the configuration of the embodiment, the controller portion 43 is made to have a part of the function comparing the remaining-developer-amount level, a configuration in which all the functions are held by the controller portion 43 is also possible.

In this case as well, there are two lines of outputs relating to the remaining-developer-amount level, namely, the current remaining-developer-amount-level value confirmed by the remaining developer amount detecting means 20 and the remaining-developer-amount-level value confirmed in the previous remaining amount detection and memorized in the memory means 31, on the video interface (I/F) being communication means of the controller portion 43 and the engine portion 42.

Although the flat antenna method is used as the remaining developer amount detecting means 20 in this embodiment, the present invention is not limited to the remaining developer amount detecting means of this method. The method such as the agitating torque detecting method in the developer container 4 may be used, as far as it can serially detect the remaining-developer-amount level.

Third Embodiment

Figure 7:
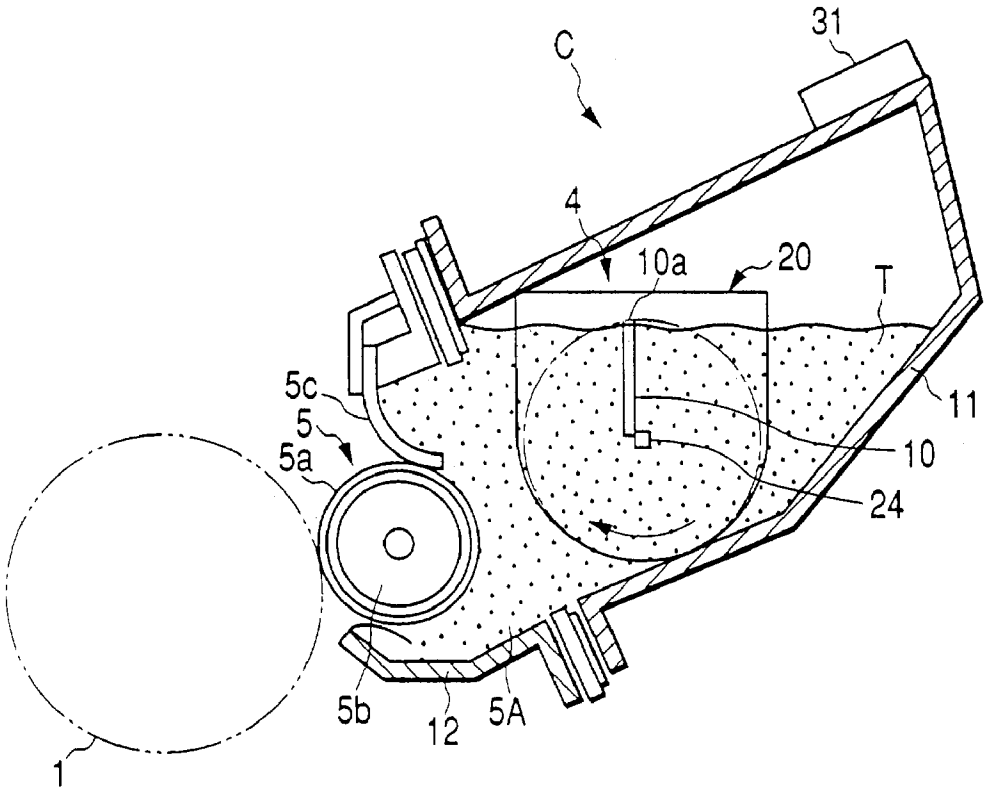
FIG. 7 is a cross sectional view of a developing apparatus of the third, sixth, eleventh and thirteenth embodiments of the present invention.

An embodiment of a developing apparatus C constituted as a cartridge that is another aspect of the present invention is shown in FIG. 7.

The developing apparatus C of this embodiment has a developer carrying body like a developing roller 5*a* and a developing chamber 5A containing toner therein, and is integrally constituted as a cartridge by developing frame bodies 11, 12 of plastic. That is, the developing apparatus C of this embodiment is the part of the process cartridge B forming the developing apparatus described in the first embodiment, which is constituted as a unit, i.e., a cartridge that may be integrally formed by excluding the photosensitive drum 1, the charging means 2 and the cleaning means 7 from the process cartridge B. Therefore, all the developing apparatus constituting parts and the developer-amount-detecting-means configuration described in the first and the second embodiments are applied to the developing apparatus of this embodiment. Therefore, the above description in the first and the second embodiments are applied to descriptions concerning these configurations and operations, i.e., the remaining-developer-amount indicating method and the abnormality detecting method.

Operations and effects similar to those in the first and the second embodiments can be attained in this embodiment as well.

Fourth Embodiment

The fourth embodiment of the present invention will now be described. The configurations of an image forming apparatus main body and a cartridge are the same as those in the first embodiment (FIGS. 1 through 3) and, therefore, in order to prevent repetition, the fourth embodiment will not be described in full. In addition, when the remaining developer amount is detected, the developer amount is confirmed by statistical processing such as finding an average value or choosing a minimum value of an antenna output depending on the rotation cycle of an agitating means 10. These signal processing means, i.e., calculating means 132 (FIG. 8) are disposed in the image forming apparatus main body 100.

As the resolution of the remaining developer amount detecting means 20 in this embodiment, considering a limit, measurement errors and the like of measurement resolution, the remaining developer amount detecting means 20 can make a detection with the decreasing ratio of 1% when the full developer amount in the developer containing portion in its unused state is assumed to be 100%.

At the point where a confirmed remaining-developer-amount level reaches a predetermined value, an alarm concerning the remaining developer amount is produced and a user can be informed. In the image forming apparatus of this embodiment, the alarm of "toner LOW" is indicated to a user when the remaining developer amount level is 10% or less and the alarm of "toner OUT" is indicated to a user when the remaining developer amount level is 0% as an alarm concerning the remained developer amount.

"Toner LOW" is an alarm to inform a user that the remaining developer amount in the developer container 4 is extremely small and the time to replace a cartridge is approaching, and "toner OUT" is an alarm to inform a user that there is no developer and any further image forming operation is impossible. Particularly, the alarm of "toner LOW" is not limited to being indicated once, but it is also possible to provide a plurality of threshold values and inform a user step by step in accordance with the decrease of the remaining developer amount.

However, in order to confirm the remaining-developer-amount level, it is necessary to conduct bias impression to the flat antenna 20, rotate the agitating means 10 and the flat antenna surface cleaning means 10*a*, and execute statistical processing of an antenna output corresponding to the rotation cycle of the surface cleaning means 10*a* and therefore, time is required for such processing.

That is, after the power source switch of the image forming apparatus main body 100 is turned on to agitate the developer and a sufficient time elapses, an alarm concerning a developer amount can be indicated on the indicating means 33 of the apparatus main body 100 or the display of a personal computer that can communicate with the image forming apparatus when a first statistical processing is finished. However, the alarms of "toner LOW" and "toner OUT" that are indicated based on the confirmed remaining-developer-amount level cannot be indicated immediately after the power-source switch of the image forming apparatus body 100 is turned on, a cartridge is replaced or jam processing operation is conducted and so on because there is not enough time to confirm the remaining amount. Therefore, during such a period of time, a user cannot find if an alarm concerning the remaining developer amount has been produced or not.

In this embodiment, therefore, memory means 31 is disposed in the process cartridge B, in which it is written and memorized that a predetermined developer amount at which an alarm concerning the remaining developer amount is detected, and an alarm is indicated, using this data, on the indicating means 33 of the apparatus main body 100 or the display of a personal computer that can communicate with the image forming apparatus. Further, the indicating means 33 can indicate it on a display provided in the apparatus main body 100, or can display it on a recording material P by recording and outputting it thereon simultaneously with a displaying indication or independently.

In this way, during the period when sufficient time does not elapse until the remaining-developer-amount level is confirmed, such as immediately after the power-source switch of the image forming apparatus main body is turned on, a cartridge is replaced or jam processing is conducted and so on, an alarm concerning the remaining developer amount, indicating the detection of the remaining developer amount to be alarmed and being memorized in the previous remaining developer amount detection, can be indicated by reading it out of the memory means. Therefore, even during the period of time when the remaining developer amount level cannot be confirmed, a user can be immediately informed of an alarm concerning the developer amount.

In addition, by mounting the memory means 31 on the process cartridge B, even if the cartridge B is replaced, a user can call the data on whether the cartridge B has detected the developer amount to be alarmed or not out of the memory means 31 and find the alarm concerning the remaining developer amount.

Figure 8:
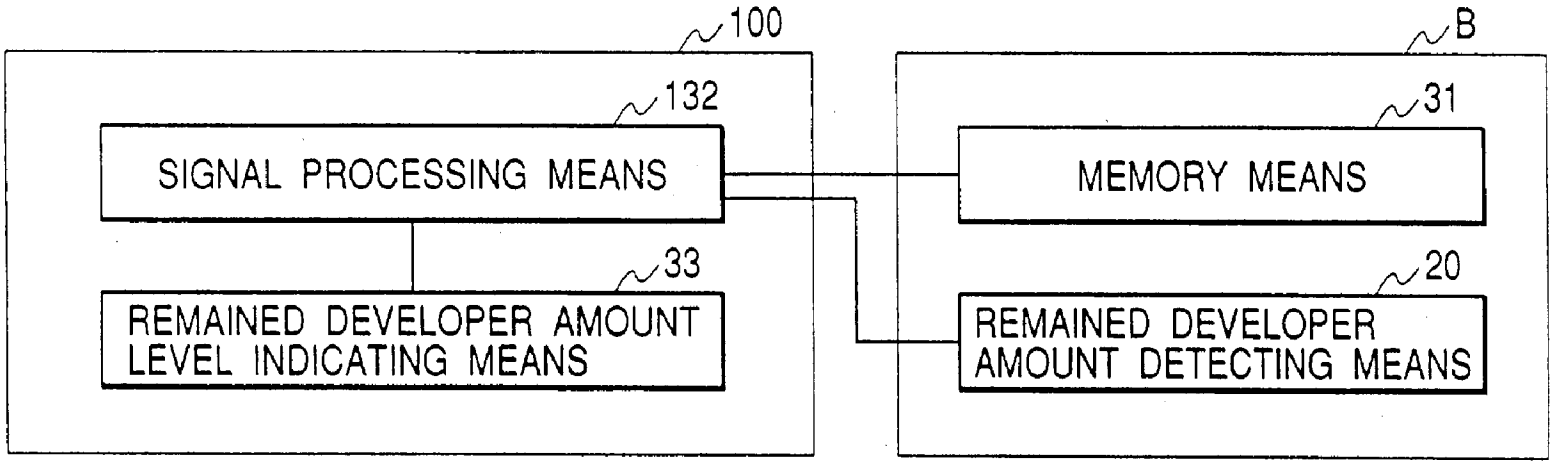
FIG. 8 is a block diagram showing the relationship between an image forming apparatus and a cartridge relating to the fourth and fifth embodiments of the present invention.

Further, a read-writable NVRAM is adopted as the memory means 31 to be mounted on the process cartridge B in this embodiment. As shown in FIG. 8, data writing and reading means with respect to the memory means 31 of the remaining developer amount detecting device 30 provided with the remaining developer amount detecting means 20 is provided in the image forming apparatus main body 100 side. In addition, a signal processing means 132 disposed in the image forming apparatus main body 100 side processes an output signal of the remaining developer amount detecting device 30 to confirm the remaining-developer-amount level and determines if a remaining-developer-amount level has reached the level at which the alarm of "toner LOW" and "toner OUT" should be indicated.

Figure 9:
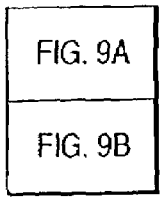
FIG. 9, composed of FIGS. 9A and 9B, is a flow chart of a remaining developer amount alarm indicating system of the fourth embodiment of the present invention.
Figure 9A:
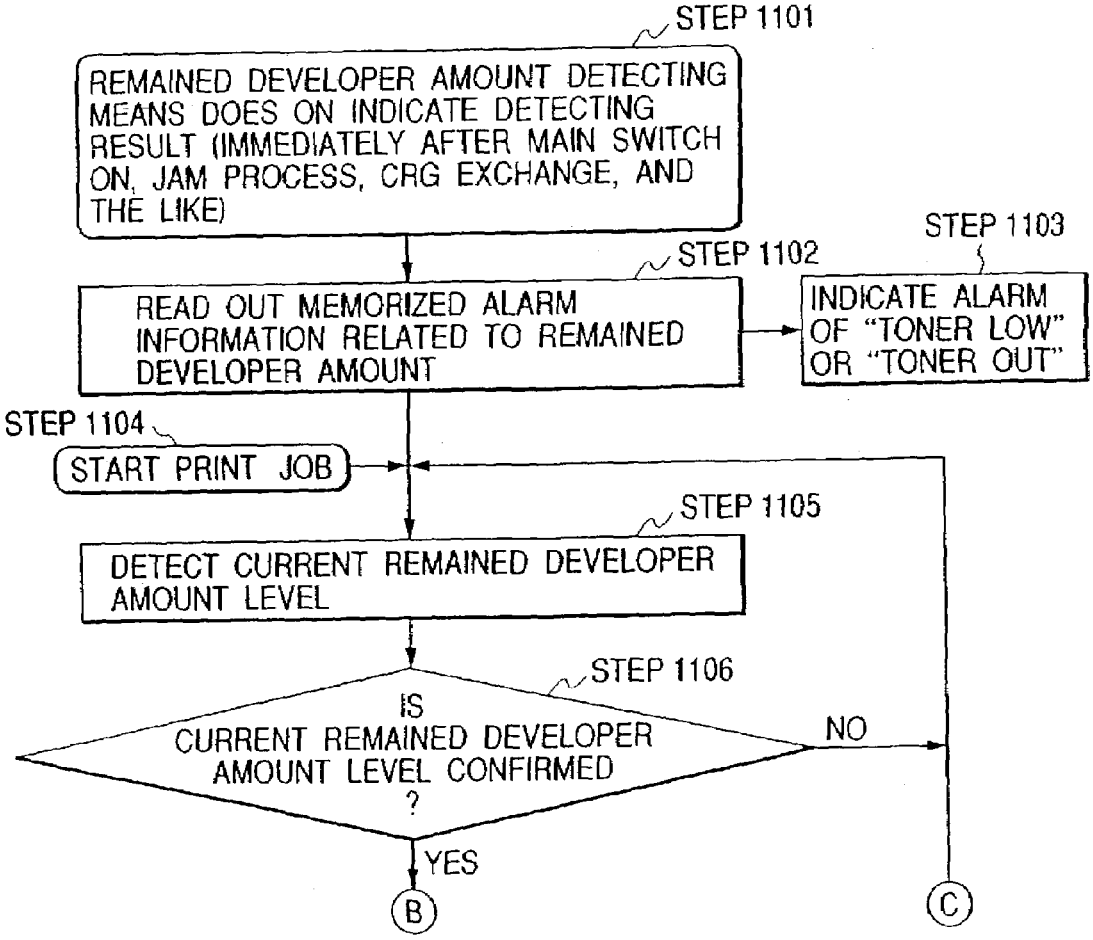
Figure 9B:
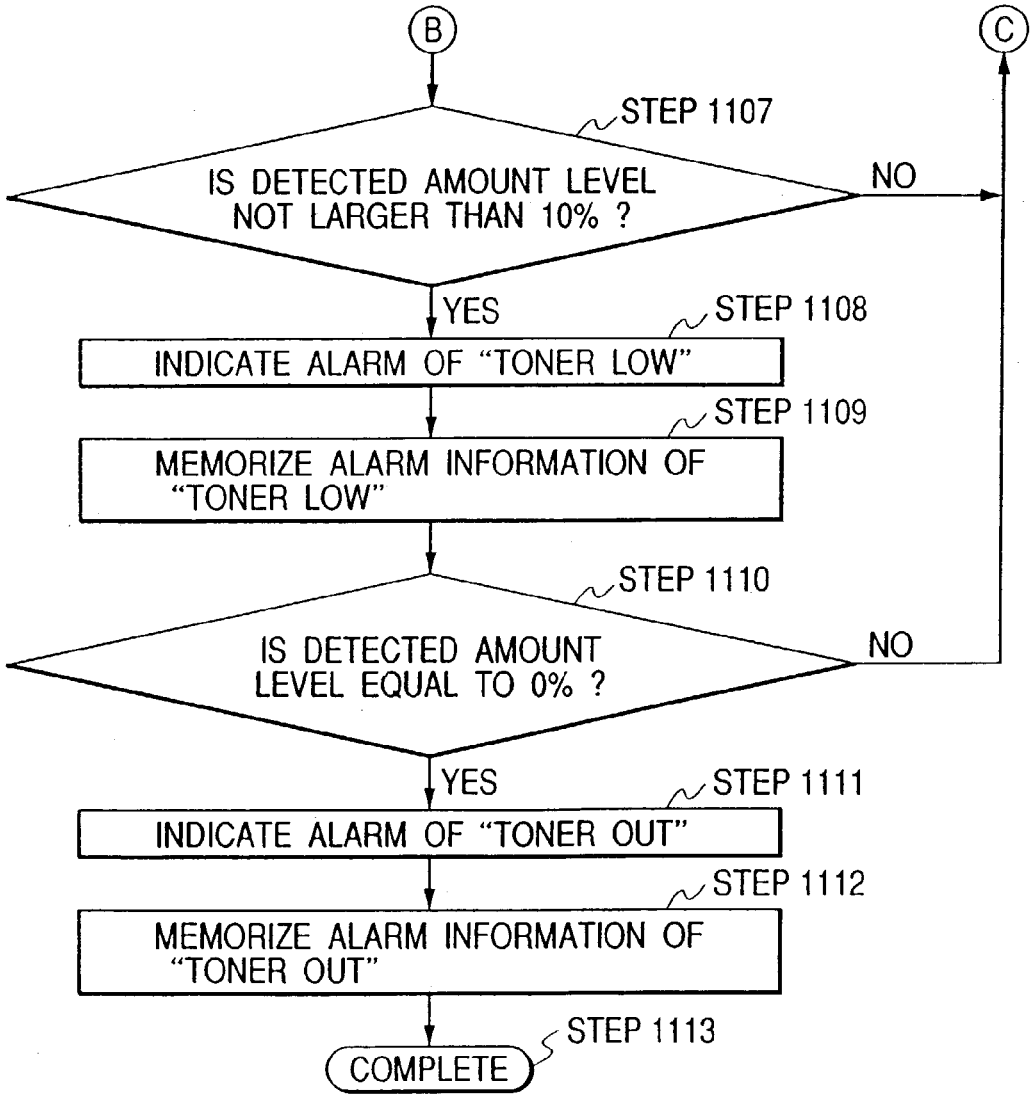

The operations of the image forming apparatus of this embodiment will now be described using a flow chart of FIGS. 9A and 9B.

In this embodiment, it is assumed that an alarm is always indicated on indicating means 33 of the image forming apparatus main body 100 or the display of a personal computer if alarms concerning the remaining developer amount ("toner LOW" and "toner OUT") are generated while the apparatus main body 100 is operating.

As described above, if the remaining-developer-amount level is not confirmed by the remaining developer amount detecting means 20 immediately after the power-source switch of the main body is turned on, a cartridge is replaced or jam processing is conducted and so on (step 1101), the image forming apparatus main body 100 reads out the alarms ("toner LOW" and "toner OUT") concerning the remaining-developer amount confirmed by the previous remaining amount detection and memorized from the memory means 31 mounted on the process cartridge B (step 1102) and indicates them on the indicating means 33 of the apparatus main body 100 or the display of a personal computer (step 1103). The data indicating that the alarm concerning the remaining amount is produced is not memorized in the memory means 31, i.e., if the remaining developer amount level in the developer containing portion is still high, the alarms are not indicated naturally.

In addition, if printing is commenced from the status in which a cartridge is inserted and printing has not been performed for a while with the power-source switch of the apparatus main body 100 being kept turned on (step 1104), time is also required until the remaining-developer-amount level is confirmed after the agitation of the developer is started, but since the alarms ("toner LOW" and "toner OUT") concerning the remaining-developer amount confirmed by the previous remaining-amount detection are already indicated on the display, the processes of step 1101 through 1103 are not conducted.

A detection by the remaining developer amount detecting means 20 is thereafter executed (step 1105) and the remaining-developer-amount level is confirmed as X % by the remaining developer amount detecting means 20 (step 1106).

Here, the confirmed remaining-developer-amount level X % is compared with the remaining-developer-amount level of 10% at which the alarm of "toner LOW" should be indicated (step 1107). If the remaining-developer-amount level X % is a value larger than 10%, it is not necessary to produce an alarm and, therefore, the above-mentioned processes of steps 1105 through 1107 are repeated in the course of forming an image. If the remaining-developer-amount level is 10% or less, the alarm of "toner LOW" is produced by the signal processing means 132 disposed in the image forming apparatus main body 100 side. The alarm of "toner LOW" is indicated on the indicating means 33 of the apparatus main body 100 or the display of a personal computer (step 1108) and thereafter memorized in the memory means 31 (step 1109).

The remaining-developer-amount level X is compared with the remaining-developer-amount level 0% at which the alarm of "toner OUT" should be indicated (step 1110). If the remaining-developer-amount level is between 10% and 0%, the process returns to the above-mentioned step 1105 and repeats the display of the alarm of "toner LOW". If the remaining-developer-amount level X has reached 0%, the alarm of "toner OUT" is produced by the signal processing means 132 disposed in the image forming apparatus main body 100 side.

The alarm of "toner OUT" is indicated on the indicating means 33 of the apparatus main body 100 or the display of a personal computer (step 1108) and is thereafter memorized in the memory means 31 (step 1109).

The memorizing of "toner LOW" and "toner OUT" in the memory means 31 may be performed only once at the time when each of the alarms is detected first. That is, after writing in the memory means 31 is conducted once, no writing in the memory means 31 is required even if a new writing is instructed. This eliminates an unstable condition, such as the display of the alarm of "toner LOW" blinking due to a detection error and the like that the remaining developer amount detecting means 20 has in such cases as the remaining-developer-amount level is increased from 10% to 11%.

Although the flat antenna method that is one form of the electrostatic capacity detection method as the remaining developer amount detecting means 20 in this embodiment, the present invention is not limited to the remaining developer amount detecting means 20 of this method, but the method such as the agitating torque detecting method in the developer container 4 may be used, as far as it can detect the remaining-developer-amount level.

It is also naturally possible to set more remaining-developer-amount-level-threshold values at which an alarm is produced and to cause an alarm concerning the remaining-developer-amount to be produced in multiple stages.

In addition, although the signal processing means 132 for statistically processing an output signal of the remaining developer amount detecting means 20 and confirming it as the remaining-developer amount is disposed in the image forming apparatus main body 100 in this embodiment, it can be provided in the process cartridge B. By mounting calculation processing means relating to both the image forming apparatus main body 100 and the process cartridge B, communications, such as writing and reading of data, performed between the image forming apparatus main body 100 and the process cartridge B, can be simplified.

As a result, the possibility of the occurrence of a communication error due to a defective contact, noise and the like can be decreased and a stable remaining-developer-amount-level detection can be conducted.

Fifth Embodiment

In this embodiment as well, the image forming apparatus and the process cartridge as well as the remaining developer amount detecting device 30 provided with the remaining developer amount detecting means 20 all having the same configurations as described in the first embodiment with reference to FIGS. 1 through 3 are used. Therefore, detailed explanations of the image forming apparatus, the process cartridge and the remaining developer amount detecting device 30 provided with the remaining developer amount detecting means 20 are omitted.

In this embodiment as well, as described above, the developer amount is confirmed by statistical processing such as finding an average value or choosing a minimum value depending on the rotation cycle of the agitating means 10 as in the first and the fourth embodiments. These signal processing means 132 are disposed in the image forming apparatus main body 100 as shown in FIG. 8.

As the resolution of the remaining developer amount detecting means 20 in this embodiment, considering a limit, measurement errors and the like of measurement resolution, the remaining developer amount detecting means 20 can perform a detection with the decreasing ratio of 1% when the full developer amount in the developer containing portion in its unused state is assumed to be 100% as in the first and the fourth embodiments.

At the point where a confirmed remaining-developer-amount level reaches a predetermined value, an alarm concerning the remaining developer amount is produced and a user can be informed. In the image forming apparatus of this embodiment, the alarm of "toner LOW" is indicated to a user when the remaining-developer-amount level is 10% or less as an alarm concerning the remaining-developer amount, and the alarm of "toner OUT" is indicated to a user when the remaining-developer-amount level reaches 0%.

"Toner LOW" is an alarm to inform a user that the remaining-developer amount in the developer container 4 is extremely small and the time to replace a cartridge is approaching, and "toner OUT" is an alarm to inform a user that there is no developer and a further image forming operation is impossible. Particularly, an alarm of "toner LOW" is not limited to one but it is also possible to provide a plurality of threshold values and inform a user step by step, in accordance with the decrease of the remaining developer amount.

However, in order to confirm the remaining-developer-amount level, it is necessary to conduct bias impression to the flat antenna 20, rotate the agitating means 10 and the flat antenna surface cleaning means 10*a*, and execute statistical processing of an antenna output corresponding to a rotation cycle of the surface cleaning means 10*a* and therefore time is required for such processing.

That is, after the power source switch of the image forming apparatus main body 100 is turned on to agitate the developer and a sufficient time elapses, an alarm concerning the developer amount can be indicated on the indicating means 33 of the apparatus main body 100 or the display of a personal computer when a first statistical processing is finished. However, the alarms of "toner LOW" and "toner OUT" that are indicated based on the confirmed remaining-developer-amount level cannot be indicated immediately after the power source switch of the image forming apparatus body 100 is turned on, a cartridge is replaced or jam processing is conducted and so on because there is not enough time to confirm the remaining amount. Therefore, during such a period of time, a user cannot find if an alarm concerning the remaining-developer amount has been produced.

In this embodiment, therefore, memory means 31 is disposed in the process cartridge B, in which it is written and memorized that a predetermined developer amount at which an alarm concerning the remaining-developer amount is detected, and an alarm is indicated, using this data, on the indicating means 33 of the apparatus main body 100 or the display of a personal computer as in the fourth embodiment.

In this way, during the period when sufficient time does not elapse until the remaining-developer-amount level is confirmed, such as immediately after the power-source switch of the image forming apparatus main body 100 is turned on, a cartridge is replaced or jam processing is conducted and so on, an alarm concerning the remaining-developer amount indicating that the remaining-developer amount to be alarmed is detected can be indicated by reading it out of the memory means 31. Therefore, even during the period of time when the remaining-developer-amount level cannot be confirmed, a user can be immediately informed of an alarm concerning the developer amount.

In addition, by mounting the memory means 31 on the process cartridge B, even if the cartridge B is replaced, a user can call the data on whether the cartridge B has detected a developer amount to be alarmed or not out of the memory means 31 and find the alarm concerning the remaining-developer amount.

Although a nonvolatile memory is used as the memory means 31 mounted on the process cartridge in this embodiment, as in the fourth embodiment, a volatile memory provided with a power source as well as a non-contacting memory (FeRAM) capable of communicating without mechanically connecting the image forming apparatus main body 100 and the memory means 31 can be used as memory means other than a nonvolatile memory.

An appropriate capacity can be selected as the capacity of the memory means 31 mounted on the process cartridge B. In this embodiment, one bit of a predetermined address is allocated to each of the alarms of "toner LOW" and "toner OUT". In the state in which the process cartridge B is unused, the alarm flag concerning each remaining developer amount is 0. If the remaining-developer amount at which the alarms of "toner LOW" should be indicated is detected, the alarm flag of "toner LOW" is made 1, and if the remaining-developer amount at which the alarm of "toner OUT" should be indicated is detected, the alarm flag of "toner OUT" is made 1. In this way, whether a predetermined remaining-developer amount at which an alarm concerning the remaining-developer amount should be indicated is detected or not can be memorized in the memory means 31.

In addition, theoretically, the remaining-developer-amount level to be detected by the remaining developer amount detecting means 20 does not possibly increase. Therefore, naturally, it is a normal operation of the remaining-developer-amount detecting means 20 to detect the remaining developer amount level at which the alarm of "toner OUT" informs the user that the developer is running out and it is necessary to immediately replace a cartridge and to indicate this to the user after detecting the remaining developer amount level at which the alarm of "toner LOW" informing the user that the developer is running short and the time to replace the cartridge B is approaching.

Thus, in this embodiment, the data indicating the detection of a predetermined remaining-developer amount at which an alarm concerning the remaining developer amount should be produced is memorized in the memory means 31 in the order in accordance with the decrease of the remaining developer amount level.

That is, when the flag of "toner LOW" is made 1, the alarm flag of "toner OUT" must be 0. When the alarm flag of "toner OUT" is made 1, the alarm flag of "toner LOW" must already be 1. This is the same when the alarm of "toner LOW" is multiply informed at a plurality of threshold values, step by step in accordance with the decrease of the remaining developer amount, and when a certain alarm flag is made 1, all the alarm flags of alarms that should be produced at the larger remaining developer amount before that must be 1 and all the alarm flags of alarms that should be produced at the smaller remained developer amount before that must be 0.

In this way, whether or not a predetermined remaining-developer amount at which an alarm concerning the remaining developer amount should be produced has been detected or not can be memorized in the memory means 31 precisely, and the user can be informed of an alarm concerning the developer amount precisely in order in accordance with the decrease of the remaining-developer-amount level.

In addition, since the remaining developer amount level to be detected by the remaining developer amount detecting means 20 does not possibly increase theoretically, it is limited to the case in which some abnormality has occurred in the image forming apparatus or the cartridge detachably attachable to the image forming apparatus that the remaining-developer amount at which the alarm of "toner OUT" should be indicated is detected before the remaining-developer amount at which the alarm of "toner LOW" should be indicated is detected. This is the same for the case in which the alarm of "toner LOW" is multiply informed at a plurality of threshold values step by step in accordance with the decrease of the remaining-developer amount, and if the remaining-developer amount is not detected in the order in accordance with the decrease of the remaining-developer-amount level, the image forming apparatus or the cartridge detachably attachable to the image forming apparatus are not considered to be operating normally.

Thus, in this embodiment, it is determined, in the order in accordance with the decrease of the remaining-developer-amount level, if the remaining-developer-amount level at which an alarm concerning the remaining-developing amount should be produced has been detected and, if the detection is deviated from the order, it is detected that some abnormality has occurred in the image forming apparatus or the cartridge detachably attachable to the image forming apparatus.

In this embodiment, the following four combinations listed in the table below are all the combinations of the "toner LOW" alarm flag and the "toner OUT" alarm flag.

| | Case 1 | Case 2 | Case 3 | Case 4 |
|---|---|---|---|---|
| State of "toner low" flag | 0 | 1 | 1 | 0 |
| State of "toner out" flag | 0 | 0 | 1 | 1 |
| Judgement | Normal operation | Normal operation | Normal operation | Abnormal operation |
| Indicated information | None | "toner low" | "toner out" | "abnormal state" |

As described above, it is not theoretically possible to detect the remaining-developer-amount level at which the alarm of "toner OUT" should be indicated before detecting the remaining-developer-amount level at which the alarm of "toner LOW" should be indicated.

Thus, in a case corresponding to the case 4, it can be determined that an abnormality has occurred in the image forming apparatus.

When the remaining-developer-amount level confirmed by the remaining developer amount detecting means 20 reaches a threshold value at which an alarm concerning the remaining-developer amount should be produced, the image forming apparatus main body 100 reads the data concerning whether a predetermined remaining-developer amount at which an alarm concerning the remaining developer amount should be produced, which is memorized in the memory means 31 of the process cartridge, i.e., the alarm flag, and determines if the remaining-developer amount has been detected by a normal operation in accordance with the decrease of the remaining-developer-amount level.

If the remaining-developer amount has been detected by a normal operation (the case 1 through the case 3), by making the alarm flag 1, the data indicating that the remaining developer amount level at which an alarm concerning the remaining-developer-amount should be produced is memorized in the memory means 31 of the process cartridge B and an alarm concerning the remaining-developer amount is indicated on the indicating means 33 or the display of a personal computer.

If it is determined that the remaining-developer amount has been detected by the order deviating from the order in accordance with the decrease of the remaining-developer-amount level (the case 4), it is determined that some abnormality has occurred and a signal showing the occurrence is transmitted.

Indicated contents of the indicating means 33 or the display of a personal computer receiving the signal may be those indicating the occurrence of a failure in the remaining developer amount detecting means 20, or the possibility of occurrence of a failure such as the occurrence of a failure in the main body 100, or may be the one indicating the necessity of maintenance, such as indicating that the process cartridge B or the main body 100 needs inspection.

In this embodiment, a user is informed of "the occurrence of abnormality" in the indicating means 33 provided on the image forming apparatus. As an alternative, it is also possible to output and to transmit a signal indicating "the occurrence of abnormality" to the image forming apparatus and a personal computer, and to indicate on the display of the personal computer.

In addition, with one bit of a predetermined address of the memory means 31 mounted on the process cartridge being allocated in order to memorize the existence of the occurrence of an abnormality and the abnormality occurrence flag being made 1, if a cartridge is replaced, it is possible to display that the cartridge is the process cartridge that has possibly failed and the use of this cartridge in which the abnormality has occurred can be prevented.

Data writing and reading means with respect to the memory means 31 of the remaining developer amount detecting device 30 provided with the remaining developer detecting means 20 is provided in the image forming apparatus main body 100 side.

In addition, signal processing means 132 disposed in the image forming apparatus main body 100 side processes an output signal of the the remaining-developer-amount detecting means 20 to confirm the remaining-developer-amount level, determines if the remaining developer amount level has reached the level at which the alarms of "toner LOW" and "toner OUT" should be indicated, if it is in the order in accordance with the decrease of the remaining-developer-amount level and sends an alarm signal and an abnormality occurrence signal.

Figure 10:
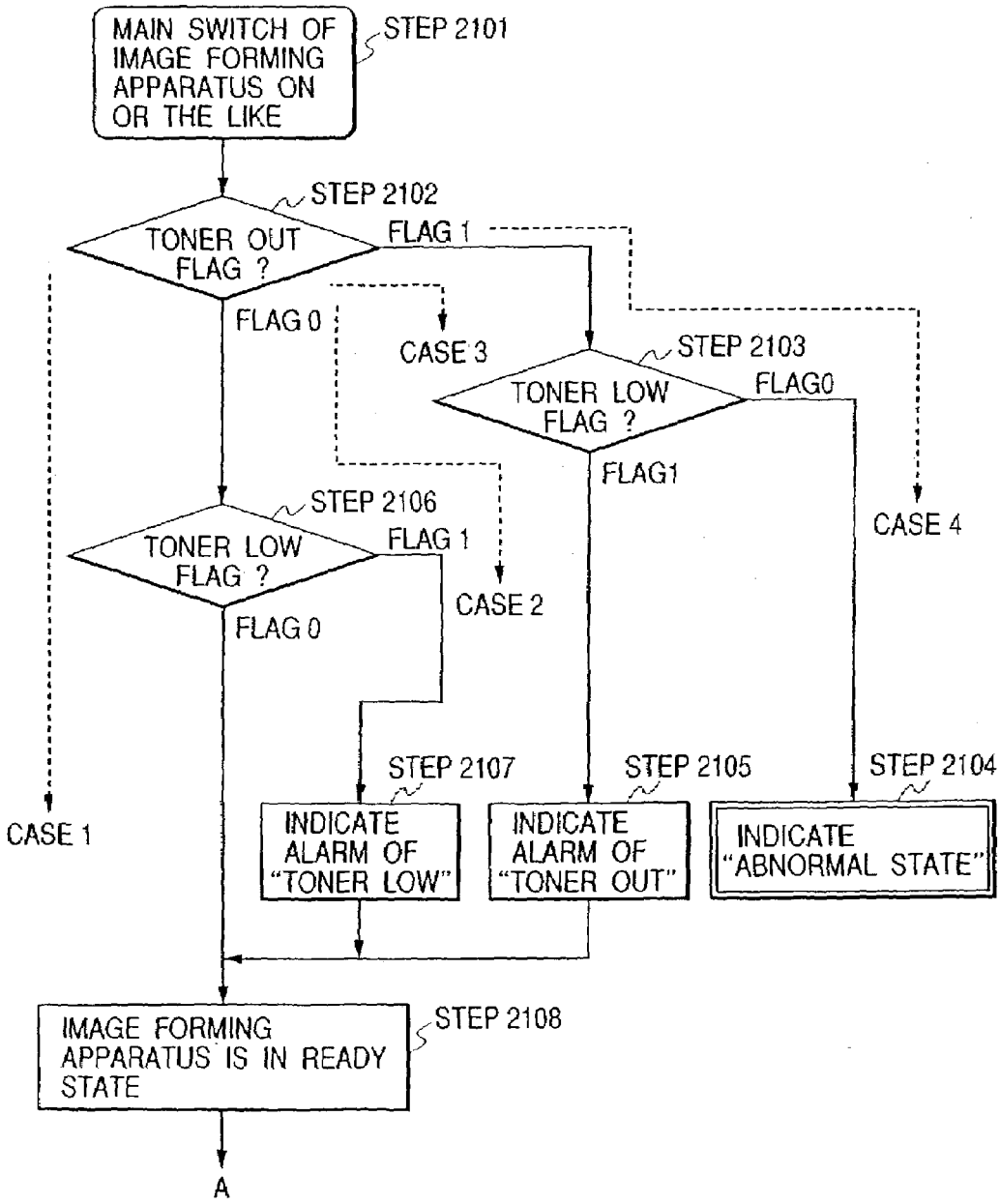
FIG. 10 is a flow chart of a remaining developer amount alarming system and an abnormality detecting system of the fifth embodiment of the present invention.
Figure 11:
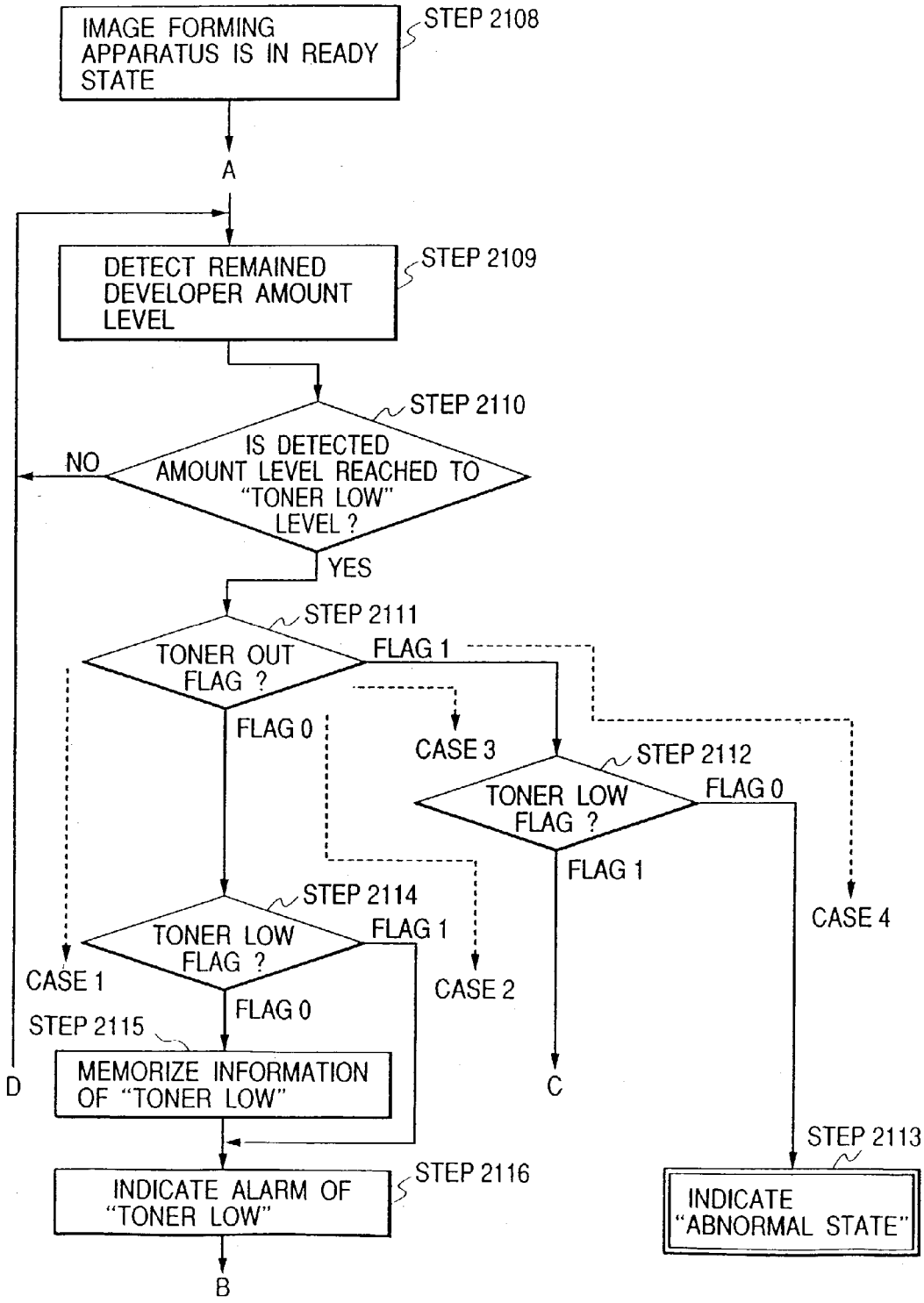
FIG. 11 is a flow chart of a remaining developer amount alarming system and an abnormality detecting system of the fifth embodiment of the present invention.
Figure 12:
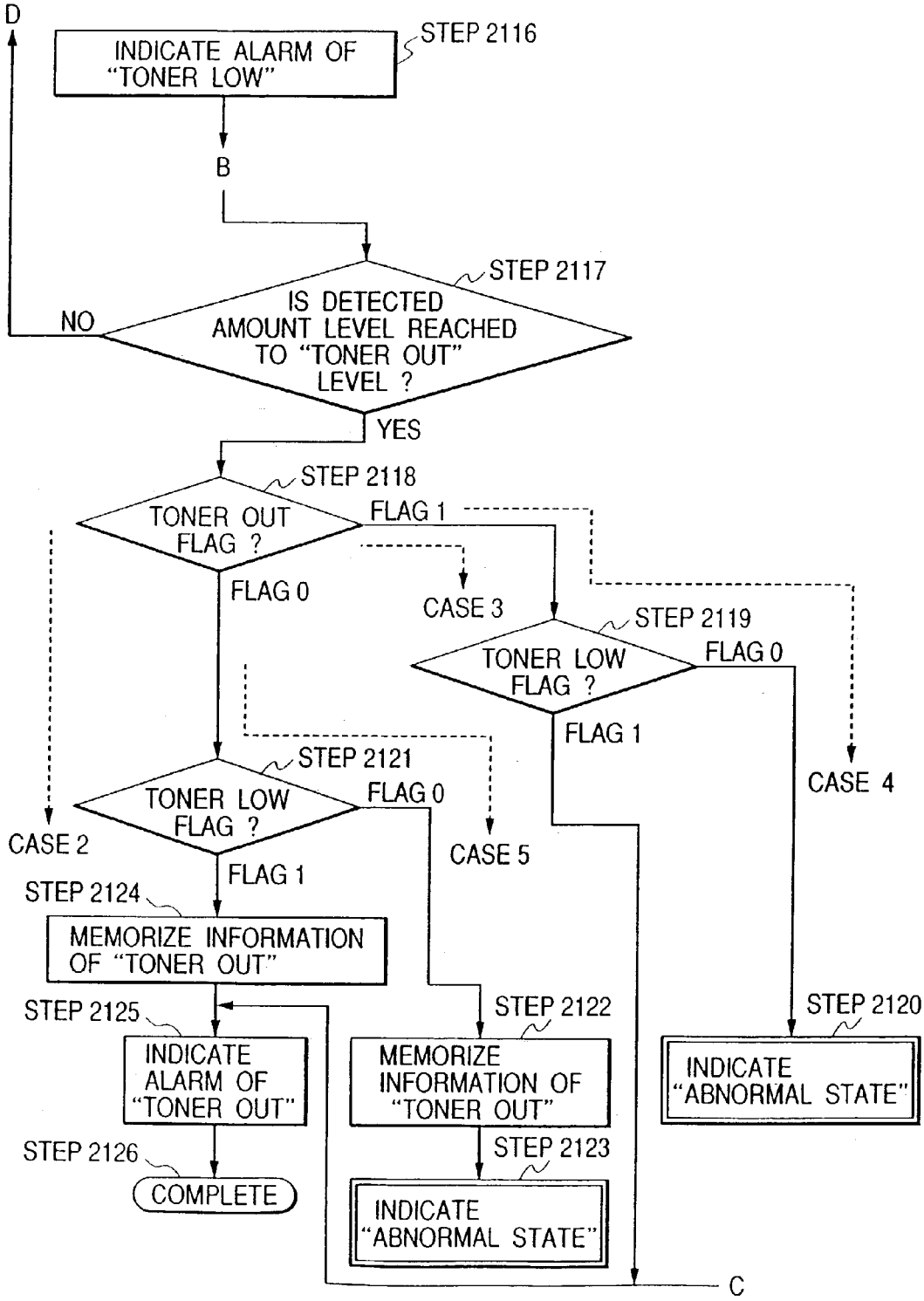
FIG. 12 is a flow chart of a remaining developer amount alarming system and an abnormality detecting system of the fifth embodiment of the present invention.

Operations of the image forming apparatus of this embodiment will now be described using flow charts of FIGS. 10 through 12.

In this embodiment, it is assumed that an alarm is always indicated on the indicating means 33 of the image forming apparatus main body 100 or the display of a personal computer if alarms concerning the remaining developer amount ("toner LOW" and "toner OUT") are generated while the apparatus main body 100 is operating.

As described above, if the remaining-developer-amount level is not confirmed by the remaining developer amount detecting means 20 immediately after the power-source switch of the main body is turned on, a cartridge is replaced or jam processing is conducted and so on (step 2101), the image forming apparatus main body 100 immediately communicates with the memory means 31 mounted in the process cartridge B and confirms the detection of the remaining-developer-amount level at which an alarm concerning the remaining-developer amount confirmed in the previous remaining-amount detection and memorized should be produced.

In addition, if printing is commenced from the status in which a cartridge is inserted and printing has not been performed for a while with the power-source switch of the apparatus main body 100 being kept turned on, time is also required until the remaining-developer-amount level is confirmed after the agitation of the developer is started, but since the previous remaining-developer amount is already indicated on the display of the indicating means 33 or the display of a personal computer, the processes of step 2101 through 2107 are not conducted.

First, whether the remaining-developer-amount level at which the alarm of "toner OUT" should be indicated has been detected or not is confirmed (step 2102), and then whether the remaining-developer amount level at which the alarm of "toner LOW" should be indicated has been detected or not is confirmed (step 2103 and step 2106). 1. The case in which the "toner OUT" alarm flag is 1 (the fact that the remaining-developer-amount level at which the alarm of "toner OUT" should be indicated has been detected is memorized in the memory means 31).

1-1. The case in which the "toner LOW" alarm flag is 0 (the remaining-developer-amount level at which the alarm of "toner LOW" should be indicated has not been detected)

This is a cartridge in which the remaining-developer-amount level at which the alarm of "toner OUT" should be indicated has been detected before detecting the remaining-developer-amount level at which the alarm of "toner LOW" should be indicated and corresponds to a cartridge in the case 4. Therefore, the image forming apparatus indicates an "abnormal state" (step 2104).

1-2. The case in which the "toner LOW" alarm flag is 1 (the fact that the remaining-developer-amount level at which the alarm of "toner LOW" should be indicated has been detected is memorized in the memory means 31).

It is determined that both remaining-developer-amount levels at which the alarms of "toner OUT" and "toner LOW" should be indicated have been normally detected and an alarm concerning each remaining-developer amount has been produced. This case corresponds to the case 3. Therefore, the alarm of "toner OUT" that is the final alarm concerning the remaining-developer amount is indicated (step 2105).

2. The case in which the "toner OUT" alarm flag is 0 (the remaining-developer-amount level at which the alarm of "toner OUT" should be indicated has not been detected).

2-1. The case in which the "toner LOW" alarm flag is 1 (the remaining developer amount level at which the alarm of "toner LOW" should be indicated has been detected is memorized in the memory means 31).

This means that the developer amount in the developer container 4 has decreased to the remaining-developer level at which the alarm of "toner LOW" should be indicated but is still more than the amount at which the alarm of "toner OUT". should be indicated. This case corresponds to the case 2. Therefore, the alarm of "toner LOW" is indicated (step 2107). 2-2. The case in which the "toner LOW" alarm flag is 0 (the remaining-developer-amount level at which the alarm of "toner OUT" should be indicated has not been detected).

This is a cartridge in which the remaining-developer-amount level has not reached a level at which an alarm concerning the remaining-developer-amount level should be indicated and an abundance of developer exists in the developer container 4. This case corresponds to the case 1. Therefore, nothing specific is indicated.

After finishing the above processes, the image forming apparatus is in the ready state and waits for a printing request from a user (step 2108).

The remaining-developer-amount level in the developer container 4 decreases in accordance with the image forming apparatus, which receives a printing request from a user and forming images, repeatedly. The remaining developer amount detecting means 20 simultaneously detects the remaining-developer-amount level in the developer container 4 (step 2109).

It is determined if the detected the remaining-developer-amount level is the remaining-developer-amount level at which the alarm of "toner LOW", that is the first alarm concerning the remaining-developer amount, should be indicated (step 2110). In step 2110, if the remaining-developer-amount level is not in the remaining developer amount level at which the alarm of "toner LOW" should be indicated (in the case of NO), the above processes are repeated until the remaining-developer-amount level reaches the remaining-developer-amount level at which the alarm of "toner LOW" should be indicated.

If the remaining-developer-amount level decreases and it is determined that the remaining-developer-amount level is the remaining-developer-amount level at which the alarm of "toner LOW" should be indicated (in the case of YES), in indicating the alarm of "toner LOW", an abnormality detection is conducted in the image forming apparatus and a cartridge detachably attachable to the image forming apparatus in the following processes:

First, whether the remaining-developer-amount level at which the alarm of "toner OUT" should be indicated has been detected or not is confirmed (step 2111), and then whether the remaining-developer-amount level at which the alarm of "toner LOW" should be indicated has been detected or not is confirmed (step 2112 and step 2114).

1. The case in which the "toner OUT" alarm flag is 1

1-1. The case in which the "toner LOW" alarm flag is 0

This is a cartridge in which the remaining-developer-amount level at which the alarm of "toner OUT" should be indicated has been detected before detecting the remaining-developer-amount level at which the alarm of "toner LOW" should be indicated and corresponds to a cartridge in the case 4. Therefore, the indicating means 33 of the image forming apparatus or the display of a personal computer indicates an "abnormal state" (step 2113).

1-2. The case in which the "toner LOW" alarm flag is 1 It is determined that both the remaining-developer-amount levels at which the alarms of "toner OUT" and "toner LOW" should be indicated have been normally detected. This case corresponds to the case 3. Therefore, the alarm of "toner OUT" that is the final alarm concerning the remaining-developer amount is indicated (to step 2125).

2. The case in which the "toner OUT" alarm flag is 0

2-1. The case in which the "toner LOW" alarm flag is 1

This means that a developer amount in the developer container 4 has decreased to the remaining-developer level at which the alarm of "toner LOW" should be indicated but is still more than an amount at which the alarm of "toner OUT" should be indicated. This case corresponds to the case 2. Therefore, the alarm of "toner LOW" is indicated (to step 2116).

2-2. The case in which the "toner LOW" alarm flag is 0

This is the case in which the remaining-developer-amount level at which the alarm of "toner LOW" should be indicated has been detected for the first time by this remaining-developer-amount detection. This case corresponds to the case 1. Therefore, the flag is made 1 (step 2115) and the alarm of "toner LOW" is indicated (step 2116) so that the information that the remaining-developer-amount level at which the alarm of "toner LOW" should be indicated has been detected is memorized in the memory means 31 of the process cartridge.

Then, it is determined if the remaining-developer-amount level is the remaining-developer-amount level at which the alarm of "toner OUT" that is the final alarm concerning the remaining-developer-amount should be indicated (step 2117).

In step 2117, if the remaining-developer-amount level is not the remaining-developer-amount level at which the alarm of "toner OUT" should be indicated (in the case of NO), the the remaining-developer-amount detecting means 20 detects the remaining-developer amount level in the developer container 4 again by conducting image formation (to step 2109). By repeating the above-mentioned processes, the abnormality detection and the indication of the alarm of "toner LOW" are continued.

If the remaining-developer-amount level decreases and it is determined that the remaining-developer-amount level is the remaining-developer-amount level at which the alarm of "toner OUT" should be indicated (in the case of YES), and in indicating the alarm of "toner OUT" to a user, an abnormality detection is conducted in the image forming apparatus and a cartridge detachably attachable to the image forming apparatus in the following processes:

First, whether the remaining-developer-amount level at which the alarm of "toner OUT" should be indicated has been detected or not is confirmed (step 2118), and then whether the remaining-developer-amount level at which the alarm of "toner LOW" should be indicated has been detected or not is confirmed (step 2119 and step 2121).

1. The case in which the "toner OUT" alarm flag is 1

1-1. The case in which the "toner LOW" alarm flag is 0

This is a cartridge in which the remaining-developer-amount level at which the alarm of "toner OUT" should be indicated has been detected before detecting the remaining-developer-amount level at which the alarm of "toner LOW" should be indicated and corresponds to a cartridge in the case 4. Therefore, the indicating means 33 of the image forming apparatus or the display of a personal computer indicates an "abnormal state" (step 2120).

1-2. The case in which the "toner LOW" alarm flag is 1

It is determined that both the remaining-developer-amount levels at which the alarms of "toner OUT" and "toner LOW" should be indicated have been normally detected. This case corresponds to the case 3. Therefore, the alarm of "toner OUT" that is the final alarm concerning the remaining-developer amount is indicated (to step 2125).

2. The case in which the "toner OUT" alarm flag is 0

2-1. The case in which the "toner LOW" alarm flag is 1

This is the case in which the remaining-developer-amount level at which the alarm of "toner OUT" should be indicated is detected for the first time after the alarm of "toner LOW" is indicated. This case corresponds to the case 2. Therefore, the flag is made 1 so that the detection of information that the remaining developer amount level at which the alarm of "toner OUT" should be indicated is memorized in the memory means 31 of the process cartridge (step 2124), and the alarm of "toner OUT" is indicated (step 2125).

2-2. The case in which the "toner LOW" alarm flag is 0

This is the case in which, although the remaining-developer-amount level at which the alarm of "toner OUT" should be indicated has been detected for the first time, the information that the remaining developer amount level at which the alarm of "toner LOW" should be indicated, which should have been detected naturally, has been detected is not memorized. This case (the case 5) does not correspond to any case, but it is determined that it deviates from the order of producing alarms in accordance with the decrease of the remaining-developer-amount level. Therefore, the flag is made 1 so that the information that the remaining-developer-amount level at which the alarm of "toner OUT" should be indicated has been detected is memorized in the memory means 31 of the process cartridge (step 2122), and this case is made to correspond to the case 4 in which the image forming apparatus or the process cartridge has possibly broken down. Therefore, even in this case, the indicating means 33 of the image forming apparatus or the display of a personal computer indicates an "abnormal state" (step 2123).

As described above, by memorizing the information that the predetermined remaining developer amount at which an alarm concerning the remaining developer amount should be produced has been detected in the memory means 31 in the order in accordance with the decrease of the remaining-developer amount level, whether the predetermined remaining amount at which an alarm concerning the remaining-developer-amount has been detected or not can be precisely memorized in the memory means 31 and, at the same time, a user can be precisely informed of the alarm concerning the developer amount in the order in accordance with the decrease of the remaining-developer-amount level.

In addition, it is determined if the remaining-developer-amount level at which an alarm concerning the remaining-developer-amount level should be produced in the order in accordance with the decrease of the remaining-developer amount level has been detected and, if the detection deviates from the order, it is possible to detect that any abnormality has occurred in the image forming apparatus and the cartridge detachably attachable to the image forming apparatus.

Moreover, it is possible to memorize the existence of the detection of the remaining-developer-amount level at which an alarm concerning the remaining-developer-amount level should be produced in the memory means 31 mounted on the process cartridge.

As an alternative, it is possible to memorize whether an alarm concerning the remaining-developer-amount level is produced or not in the memory means 31 mounted on the process cartridge.

Although the flat antenna method being one form of the electrostatic capacity detecting method is used as the remaining developer amount detecting means 20 in this embodiment, the present invention is not limited to the remaining developer amount detecting means 20 of this method. The method such as the plate antenna method and the torque detecting method that are the forms other than the electrostatic capacity detecting method may be used, as far as it can detect the remaining-developer-amount level.

In addition, although the signal processing means 132 that statistically processes an output signal of the remaining-developer amount detecting means 20 and confirms it as the remaining developer amount is disposed in the image forming apparatus main body 100 in this embodiment, it can be mounted on the process cartridge B. By mounting calculation processing means relating to both the image forming apparatus main body 100 and the process cartridge B on the process cartridge B, communications such as writing and reading of data performed between the image forming apparatus main body 100 and the process cartridge B can be simplified. As a result, the possibility of the occurrence of communication errors by a defective contact, a noise and the like is decreased and stable detection of the remaining-developer amount level can be conducted.

Sixth Embodiment

One embodiment of the developing apparatus C constituted as a cartridge that is another aspect of the present invention will now be described.

The developing apparatus C of this embodiment, whose mechanical configuration is the same as that of FIG. 7 (the third embodiment), has a developer carrying body like a developing roller 5*a* and a developing chamber 5A containing toner therein in order to supply developer to the developer carrying body, and is integrally constituted as a cartridge by developing frame bodies 11, 12 of plastic. That is, the developing apparatus C of this embodiment is the part of the process cartridge B forming the developing apparatus described in the first and the fourth embodiments, which is constituted as a unit, i.e., the developing apparatus C is part of a cartridge that may be integrally formed by excluding the photosensitive body drum 1, the charging means 2 and the cleaning means 7 from the process cartridge B. Therefore, all the developing apparatus constituting parts and the developer-amount-detecting-means configuration described in the fourth and the fifth embodiments are applied to the developing apparatus of this embodiment. Therefore, the above description in the fourth and the fifth embodiments are applied to descriptions concerning these configurations and operations, i.e., the remaining-developer-amount indicating method and the abnormality detecting method.

Seventh Embodiment

An embodiment in which an abnormality of an apparatus can be detected in a short time after the start-up of the image forming apparatus will now be described. Further, the mechanical configurations of the image forming apparatus main body and the cartridge are the same as those of the first embodiment.

An abnormality detection of whether the remaining developer amount detecting means 20 breaks down or not should be conducted at least before the image forming apparatus forms an image such as immediately after the power-source switch of the image forming apparatus main body is turned on, immediately after a cartridge is replaced or immediately after jam processing and so on.

This is because, although a failure has possibly occurred due to a breakage of the remaining developer amount detecting means 20, a breakage of the surface cleaning means 10*a*, an electrical short circuit, a failure of the image forming apparatus main body 100 and the like, if the image forming apparatus is operated while it is broken, the possibility that both the image forming apparatus and the cartridge are critically affected is high in any case.

In this embodiment, a predetermined alternating bias is impressed on the flat antenna 20 that is the remaining developer amount detecting means and the remaining developer amount detection is conducted immediately after the power source switch of the image forming apparatus main body 100 is turned on, immediately after the cartridge B is replaced or immediately after jam processing.

As described above, in order to confirm the remaining-developer-amount level by the remaining developer amount detecting means 20, a certain degree of an image forming operation is performed, so as to rotate the agitating means 10 and the flat antenna surface cleaning means 10*a* so that a statistical processing of an antenna output depending on the rotation cycle of the surface cleaning means 10*a* must be executed and time is required for such processing. Therefore, at this point of time, the remaining-developer-amount level cannot be precisely confirmed.

However, although not the precisely confirmed the remaining-developer-amount level, an approximate the remaining-developer-amount level can be detected in a short time by performing simple statistical processing of the detection output from the remaining developer amount detecting means 20.

That is, as described above, the developer amount in the developer container is usually confirmed by statistical processing such as statistical processing for taking an average value of antenna outputs detected while, for example, the ten rotations of the agitating means 10. On the other hand, as the above-mentioned simple statistical processing, the following have possibly occurred:

1. Impressing bias on the flat antenna without rotating the agitating means. Although, there is high possibility that the developer sticks to the flat antenna and remains, there is no problem in a rough detection.
2. An average of antenna outputs detected during one rotation of the agitating means. Precision of the detection is decreased, but there is no problem in a rough detection.

The approximate the remaining-developer-amount level currently detected and the remaining-developer-amount level memorized in the memory means 31 of the process cartridge that was confirmed at the time of the previous image formation are compared in the signal comparing means 232 disposed in the image forming apparatus 100.

Figure 13:
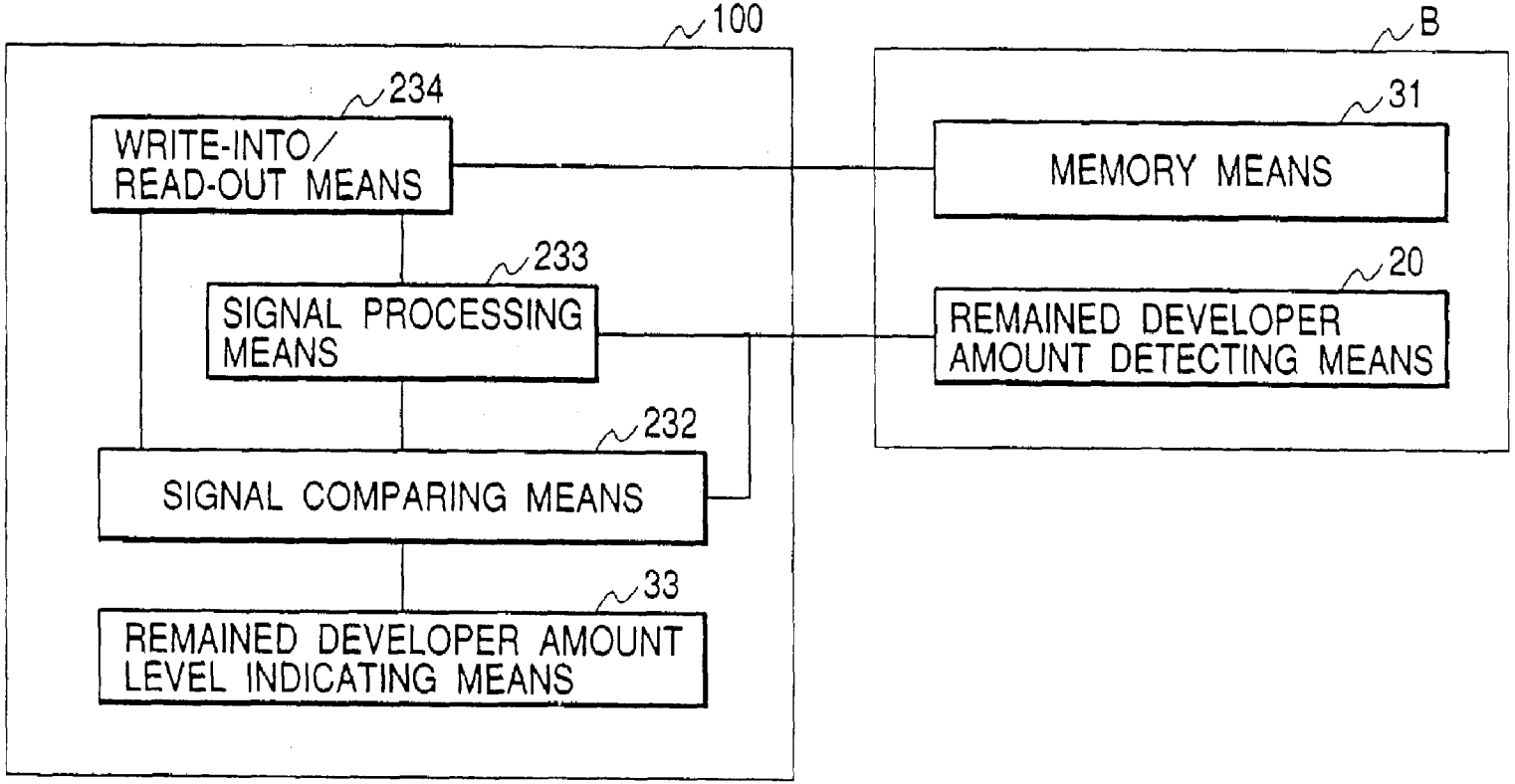
FIG. 13 is a block diagram showing the relationship between an image forming apparatus and a cartridge relating to the seventh and eighth embodiments of the present invention.

That is, as shown in FIG. 13, two lines of outputs, namely, the remaining-developer-amount level output from the the remaining-developer-amount detecting means 20 currently operating, and the already confirmed remaining developer amount level output memorized in the memory means 31 are transmitted to the signal comparing means 232.

When a significant difference exceeding a predetermined threshold value X is recognized between these outputs, a breakage of the remaining developer amount detecting means 20, a breakage of the surface cleaning means 10*a*, an electric short circuit, a failure of the image forming apparatus main body 100 and the like have possibly occurred.

In this case, it is determined that there is an abnormality or a failure of the process cartridge B or the image forming apparatus main body 100, or both, and a user is informed of this fact.

In this way, a detection of an abnormality of the remaining developer amount detecting means 20 is possible before the image forming apparatus forms an image, and the image forming apparatus and/or the cartridge or both can be prevented from being critically affected.

The signal processing means 233 disposed in the image forming apparatus main body 100 side statistically processes an output signal of the remaining developer amount detecting means 20 and confirms the remaining-developer-amount level.

Data writing and reading means 234 with respect to the memory means 31 disposed in the process cartridge B is provided in the image forming apparatus main body 100 side.

If it is determined that there is an abnormality or a failure of the process cartridge B and/or the image forming apparatus body 100, this fact is indicated on the display 33 of the image forming apparatus main body 100 or the display of a personal computer connected to the image forming apparatus main body 100 and the like, and a user is informed of it. Naturally, the information can be indicated on both the display 33 of the image forming apparatus main body 100 and the display of a personal computer connected to the image forming apparatus main body 100 and the like.

Figure 14:
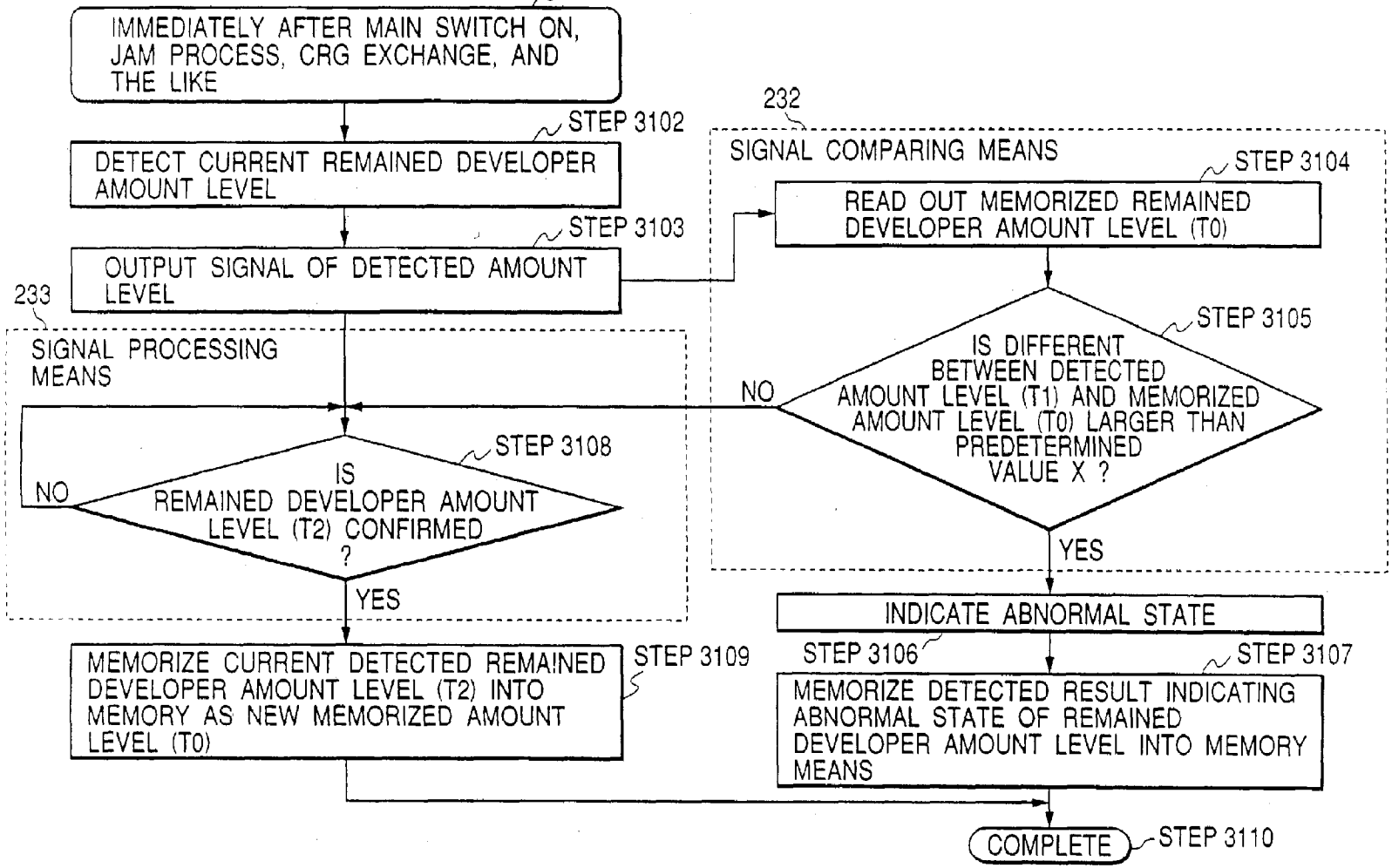
FIG. 14 is a flow chart of an abnormality detecting system of the seventh embodiment of the present invention.

The above processing is shown as a flow chart in FIG. 14. A detection of an abnormality of the remaining developer amount detecting means 20 of the image forming apparatus of this embodiment will now be described with reference to FIG. 14.

Immediately after the power source switch of the main body is turned on, immediately after a cartridge is replaced and immediately after jam processing (step 3101), the remaining-developer-amount detection is executed by the remaining developer amount detecting means 20 (step 3102). An output signal from the the remaining-developer-amount detecting means 20 is sent to the signal processing means 233 for processing the output signal and confirming the remaining developer amount level and the above-mentioned signal comparing means 232 (step 3103).

The signal comparing means 232 reads out the remaining-developer-amount level T0 confirmed by the previous remaining amount detection from the memory means 31 disposed in the process cartridge B (step 3104). Further, even if the cartridge B is brand-new, since the amount of remaining developer which is contained at the factory shipment stage is memorized in the memory means 31 in advance, this level is read out.

The output signal from the remaining developer amount detecting means 20 is statistically processed in the signal processing means 233 simply and in a short time, and is compared as an approximate remaining developer amount level T1, with the remaining developer amount level T0 read out of the memory means 31 in the signal comparing means 232 (step 3105).

As described above, if the difference between these two values is larger than the predetermined X, it is determined that some abnormality has occurred and a signal indicating the abnormality is sent (step 3106). The indicated contents of the indicating portion receiving the signal may be those indicating the occurrence of a failure of the remaining developer amount detecting means 20, the possibility of the occurrence of a failure such as a failure of the main body or the cause of a failure, or those indicating the necessity of maintenance such as indicating that inspection of the process cartridge or the main body is necessary, and so on.

In addition, the information that the abnormality has occurred is memorized in the memory means 31 (step 3107). This makes it possible to indicate that the process cartridge is the one that has possibly failed even if it is replaced and inserted instead of indicating the remaining-developer-amount level, and the use of the cartridge in which the abnormality has occurred can be prevented.

If the difference between the both values is smaller than the predetermined value X, it is determined that there is no abnormality. During this abnormality detection, a detection by the remaining developer amount detecting means 20 is executed, the signal processing means 233 performs a statistical calculation based on the output signal from the remaining developer amount detecting means 20, and the accurate the remaining-developer-amount level T2 is confirmed (step 3108).

T0 in the memory means 31 is thereafter replaced by the value of T2 and is memorized (step 3109).

Although the flat antenna method is used as the remaining developer amount detecting means 20 in this embodiment, the present invention is not limited to the remaining developer amount detecting means of this method. A method such as the agitating torque detecting method in the developer container 4 may be used, as far as it can serially detect the remaining-developer-amount level.

In addition, the signal processing means 233 disposed in the image forming apparatus main body 100 may be mounted on the process cartridge B together with the memory means 31. By mounting an calculation processing apparatus relating to both the signal processing means 233 and the memory means 31 on the process cartridge B, communications such as writing and reading of data performed between the image forming apparatus main body 100 and the process cartridge B can be simplified. As a result, the possibility of the occurrence of communication errors by a defective contact, a noise and the like is decreased.

Eighth Embodiment

In the eighth embodiment, input and output of the data signal in the electrophotographic image forming apparatus described in the seventh embodiment will now be described. In this embodiment as well, as in the seventh embodiment, the electrophotographic image forming apparatus is the laser printer A of the electrophotographic method. In addition, the process cartridge B is removably inserted in the image forming apparatus body 100 by a user.

Figure 15:
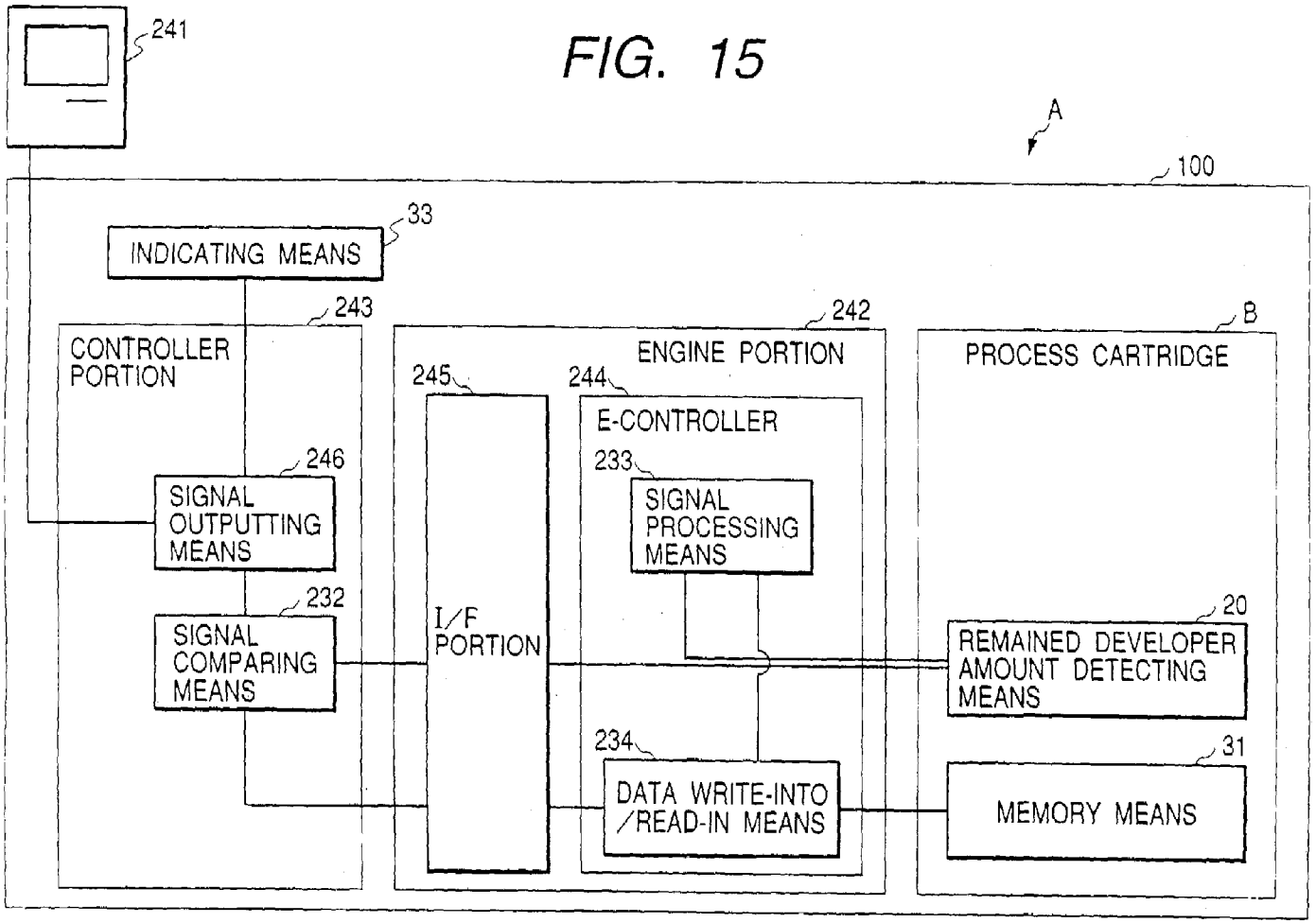
FIG. 15 is a block diagram of an image forming apparatus of the eighth embodiment of the present invention.

As shown in FIG. 15, the laser printer A is connected to a host 241 such as a personal computer and/or a workstation and used, and the configuration thereof is roughly divided into an engine portion 242 as image forming means for forming an image on a recording material by an electrophotographic process based on image information and a controller portion 243 as developing means that is connected to the host 241 and develops a page descriptive language received together with a print requiring signal from the host 241 to image information data.

The overall operations of the engine portion 242 are controlled by an E-controller 244. The controller portion 243 and the engine portion 242 can mutually communicate via a video interface (I/F) 245 forming a part of the E-controller.

As described in the seventh embodiment, this embodiment is characterized in that comparing means 232 having the function of executing the comparison of the approximate the remaining-developer-amount level confirmed by a simple statistical calculation in a short time and the remaining-developer-amount level memorized in the memory means 31 of the process cartridge and a signal output means 246 for outputting a signal indicating the remaining-developer-amount level and the occurrence of an abnormality to indicating means 33 of the image forming apparatus main body 100 and/or an apparatus having a display that can communicate with the image forming apparatus are disposed in the controller portion 243.

By disposing these in the controller portion 243, it becomes easy to display the remaining-developer-amount level and the occurrence of an abnormality on the host 241 such as a personal computer or a workstation each of which is an apparatus having a display that can communicate with the image forming apparatus.

As described in the seventh embodiment, a predetermined alternating bias is impressed on the flat antenna 20 that is the remaining developer amount detecting means and the remaining-developer-amount detection is conducted immediately after the power-source switch of the image forming apparatus main body 10 is turned on, immediately after the cartridge B is replaced or immediately after jam processing.

The approximate the remaining-developer-amount level confirmed in a short time by the simple statistical processing as above is transmitted to the comparing means 232 disposed in the video controller portion 243 via the video interface (I/F) 245.

The remaining-developer-amount-level value confirmed in the previous remaining amount detection and memorized in the memory means 31 is simultaneously read out by data writing and reading means 234 disposed in the E-controller 244 of the engine portion 242, and is transmitted to the signal comparing means 232 disposed in the controller 243 via the video interface (I/F) 245. That is, there are two lines of outputs relating to the remaining-developer-amount level on the video interface (I/F) being communicating means of the controller portion 243 and the engine portion 242.

In the signal comparing means 232 disposed in the controller portion 243, when a significant difference exceeding a predetermined threshold value X is recognized between these outputs, a breakage of the remaining developer amount detecting means 20, a breakage of the surface cleaning means 10*a*, an electric short circuit, a failure of the image forming apparatus main body 100 and the like have possibly occurred.

In this case, upon receiving the output from the signal comparing means 232, the signal output means 246 disposed in the controller portion 243 outputs a signal indicating that the abnormality has occurred to the indicating means 33 provided in the image forming apparatus main body 100 and/or the host 241 that is an apparatus having the display that can communicate with the image forming apparatus.

Operations of the image forming apparatus of the present invention conform to the flow chart shown in FIG. 14 of the seventh embodiment, and hence the description is omitted.

Although the flat antenna method is used as the remaining developer amount detecting means 20 in this embodiment, the present invention is not limited to the remaining developer amount detecting means of this method. A method such as the agitating torque detecting method in the developer container 4 may be used, as far as it can detect the remaining-developer-amount level.

In addition, although it is described in the above embodiment that the process cartridge is detachably attachable to the image forming apparatus and the developer amount of the developer container provided in the process cartridge is detected by the remaining developer amount detecting means, the principle of the present invention can be applied in the similar manner to an image forming apparatus provided with a developing apparatus constituted in a cartridge, or an image forming apparatus having the configuration in which developer container is disposed in an image forming apparatus main body itself and the developer amount in this developer container is detected by the remaining developer amount detecting means, and a similar operational effect can be attained.

Ninth Embodiment

One embodiment of an electrophotographic image forming apparatus to be configured in accordance with the present invention to which a process cartridge can be inserted will first be described with reference to FIGS. 1 through 3 and FIG. 16. In this embodiment, the electrophotographic image forming apparatus is the laser printer A of the electrophotographic method. Further, since mechanical configurations of the image forming apparatus main body and the cartridge are the same as those of the first embodiment, the description thereof is omitted.

Figure 16:
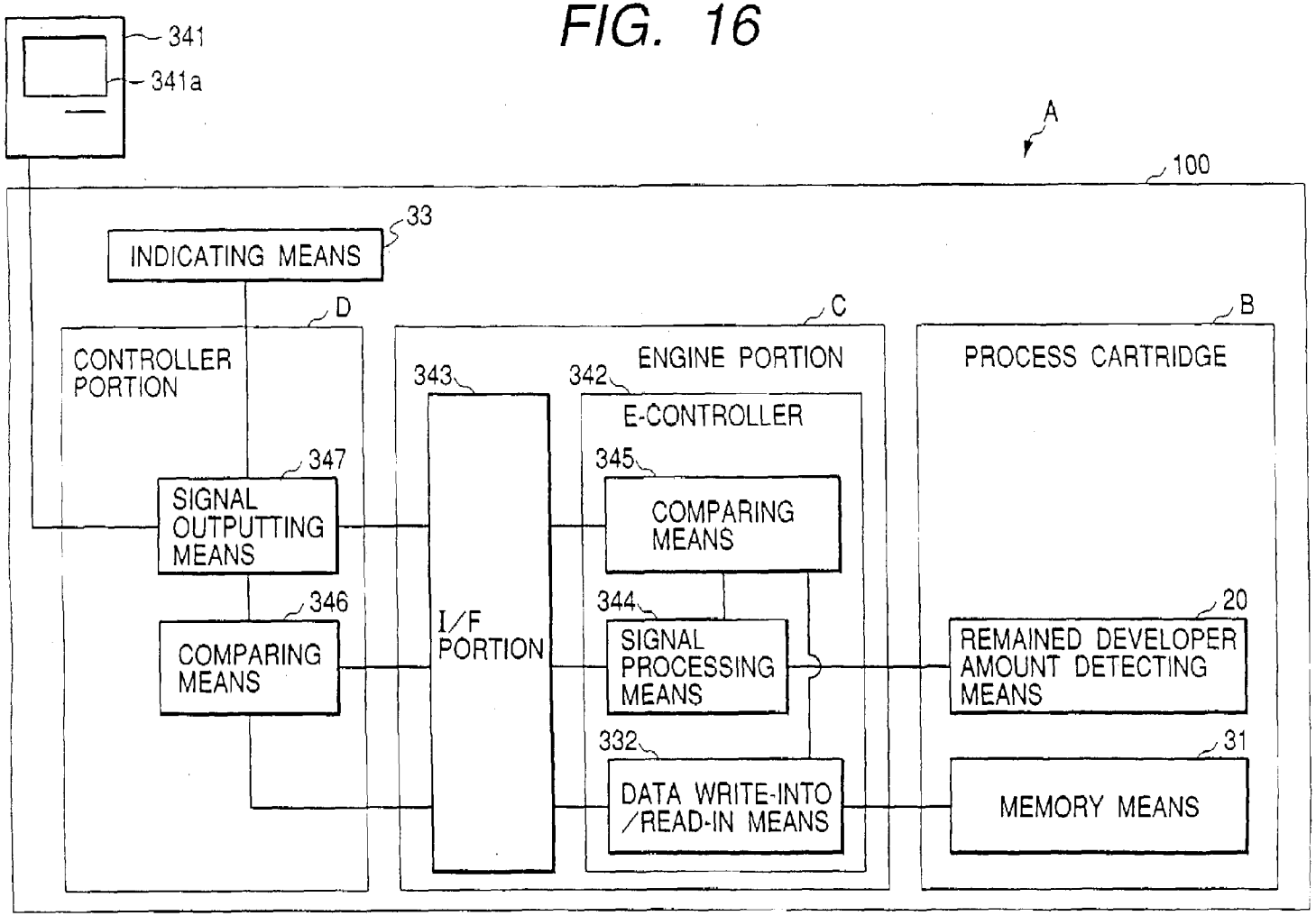
FIG. 16 is a block diagram of an image forming apparatus of the ninth embodiment of the present invention.

As shown in FIG. 16, a laser printer A is connected to a host 341 such as a personal computer and a workstation and used, and its configuration is roughly divided into an engine portion C for forming an image on recording material, for example, recording paper, an OHP sheet, cloth and the like by electrophotographic image forming process, and a controller portion D that is connected to a host 341 and is developing means for developing page descriptive language received with a print requesting signal from the host 341 to image data.

The overall operation of the engine portion C is controlled by an E-controller 342 mounted on the engine portion C. The engine portion C and the controller portion D can mutually communicate via a video interface (I/F) 343.

In this embodiment as well, statistical processing such as taking an average of antenna outputs depending on the rotation cycle of the surface cleaning means 10*a*, selecting a minimum value and so on is conducted.

However, in order to confirm the remaining-developer-amount level, it is necessary to impress bias to the flat antenna 20, rotate the agitating means 10 and the surface cleaning means 10*a*, and execute statistical processing of an antenna output in accordance with the rotation cycle of the surface cleaning means 10*a*, and hence time is required for such processing.

More particularly, an output signal from the remaining developer amount detecting means 20 disposed in the process cartridge B is statistically processed by a signal processing means 344 disposed in the engine portion C. Further, this is confirmed as the remaining-developer-amount level in the developer container 4 using the relationship between an electrostatic capacity and the developer amount to be detected by the flat antenna 20 that are related to each other in advance.

In this embodiment, the remaining-developer-amount level is indicated as a percentage with the remaining-developer amount in the unused state as 100% and the remaining-developer amount in the state in which developer is fully consumed for forming an image as 0%.

In addition, in accordance with the present invention, the memory means 31 is disposed in the process cartridge B, and the confirmed remaining-developer-amount level is written and memorized in the memory means 31 at any time.

As described above, by disposing the memory means 31 in the process cartridge B, even in the case in which the cartridge B is replaced and used, the remaining-developer-amount level in each cartridge can be memorized.

In this embodiment, the memory means 31 mounted on the process cartridge B is a nonvolatile memory of the serial data input/output type and has a memory capacity of 16 bits.

This capacity is enough to express integral numbers from 0 to 100. Thus, it is possible to memorize the remaining-developer-amount level in the developer container 4 as a percentage.

Other than the nonvolatile memory used in this embodiment, a volatile memory and the like provided with the power source can be used as the memory means 31, and a non-contact memory capable of communicating without mechanically connecting the image forming apparatus main body 100 and the memory means 31 can also be used.

In addition, data writing and reading means 332 with respect to the memory means 31 is disposed in the engine portion C.

When data are Written and read in the memory means 31, an appropriate waiting time is set depending on a device characteristic to be used and its operation is guaranteed.

Then, the remaining-developer-amount-indicating system as well as an abnormality detecting system for the cartridge and the image forming apparatus in this embodiment will now be described.

First, the remaining-amount-detecting method of developer will be described. In this embodiment, while the image forming apparatus main body 100 is operating, the remaining-developer amount level can always be indicated on the display 33 (FIG. 16) being an indicating portion of the apparatus main body 100 or a display 341*a* (FIG. 16) being an information indicating portion provided in the host 341 that is a personal computer, a workstation and the like, and if an abnormality has occurred, the occurrence can be instantly indicated on the display 33 of the apparatus main body 100 or the display 341*a* of the host 341. Naturally, this can be indicated on both the display 33 of the apparatus main body 100 and the display 341*a* of the host 341.

Signal output means 347 for outputting a signal indicating the remaining-developer-amount level and the occurrence of the abnormality to the display portion 33 of the image forming apparatus main body or an apparatus having a display that can communicate with the image forming apparatus is disposed in a controller portion D. In this way, it becomes easy to display the remaining-developer-amount level and the occurrence of an abnormality on the host 341 such as a personal computer or a workstation each of which is an apparatus having a display that can communicate with the image forming apparatus.

As described above, the remaining-developer amount in the developer container 4 is confirmed by statistically processing the output from the flat antenna. This processing is executed in the signal processing means 344 disposed in the E-controller 342 of the engine portion C.

Immediately after the power-source switch of the image forming apparatus main body 100 is turned on, immediately after a cartridge is replaced, immediately after jam processing and so on, when a door is opened or closed for the replacement of a cartridge, due to the cleaning of the transferring roller 6 or the preliminary heating of the fixing device 10, the image forming apparatus main body commences a rotational operation called the initial rotation and is in the print available status (the print ready status) after finishing the rotation. During this initial rotation, an alternate bias is impressed on the flat antenna 20 and the remaining-developer-amount-level detection is performed by the remaining developer amount detecting means 20.

As described above, in the initial rotation, since a bias impression to the flat antenna 20 and rotations of the agitating means 10 and the flat antenna surface cleaning means 10*a* are performed, and statistical processing of an antenna output depending on the rotation cycle of the surface cleaning means 10*a* is performed, there is not sufficient time for confirming the remaining-developer-amount level and the remaining-developer-amount level cannot be indicated. Therefore, a user cannot find the precise remaining-developer-amount level immediately after the print ready status.

Thus, the remaining-developer-amount level confirmed by the previous remaining-amount detection and memorized in the memory means 31 disposed in the process cartridge B is read out by the writing and reading means 332 disposed in the engine portion C, transmitted to the signal output means 347 disposed in the controller portion D via the video interface (I/F) 343 and indicated on the display 33 of the apparatus main body 100, or the display 341*a* of the host 341 such as a personal computer or a workstation.

An abnormality detection of the cartridge and the image forming apparatus in this embodiment is conducted before the image forming apparatus main body is in the print ready status.

The remaining developer amount detecting means such as the flat antenna 20 capable of detecting the remaining-developer-amount level possibly breaks down. As a cause of the failure, electrical causes such as defective contact and defective bias impression, or mechanical causes such as the breakage of the flat antenna 20 have possibly occurred, and in any case, it is highly possible that the failure seriously affects both the image forming apparatus and the cartridge. Therefore, an abnormality detection must be executed at least before forming an image.

As described above, since statistical processing of an antenna output depending on the rotation cycle of the agitating means 10 must be executed by performing after rotation of the agitating means 10, i.e., a certain degree of image forming operation, at this point of time, the remaining-developer-amount level cannot be precisely confirmed.

However, low precision and simple statistical processing different from the ordinary statistical processing can detect an approximate remaining-developer-amount level in a short time. This statistical processing is performed by the signal processing means 344 disposed in the engine portion C. The remaining-developer-amount level is confirmed as an approximate remaining-developer-amount level in the developer container 4 from the relationship between an electrostatic capacity and the developer amount.

This simple statistical processing is performed by the signal processing means 344 disposed in the engine portion C. The remaining-developer-amount level is confirmed as an approximate remaining-developer-amount level in the developer container 4 from the relationship between the electrostatic capacity and the developer amount, detected using the flat antenna 20, that are made related to each other in advance.

That is, as described above, the developer amount in the developer container 4 is usually confirmed by statistical processing, such as statistical processing for taking an average value of antenna outputs detected while, for example, the agitating means 10 performs ten rotations. On the other hand, as the above-mentioned simple statistical processing, the following has possibly occurred:

1. Impressing bias on the flat antenna 20 without rotating the agitating means 10. Although, there is a high possibility that the developer sticks to the flat antenna and remains, there is no problem in a rough detection.
2. Taking an average value of antenna outputs detected during one rotation of the agitating means 10. Precision of the detection is decreased, but there is no problem in a rough detection.

The confirmed approximate remaining-developer-amount level is transmitted to the comparing means 346 disposed in the controller portion D from the signal processing means 332 via the video interface (I/F) 343.

The remaining-developer-amount level confirmed by the previous remaining-developer-amount detection and memorized in the memory means 31 disposed in the process cartridge B is simultaneously read by the writing and reading means 332 disposed in the engine portion C and transmitted to the comparing means 346 disposed in the controller portion D via the video interface (I/F) 343.

In the comparing means 346, when a large difference exceeding the predetermined threshold value X is recognized between the approximate remaining-amount level and the remaining-developer-amount level confirmed at the time of the previous image formation and memorized in the memory means 31 of the process cartridge, a breakage of the remaining developer amount detecting means 20, a breakage of the surface cleaning means 10*a*, an electrical short circuit, a failure of the image forming apparatus main body 100 and the like have possibly occurred.

In this case, although it is possible to determine that the abnormality or the failure of the process cartridge B or the image forming apparatus main body 100 has occurred based on the result of one initial rotation, in order to improve the credibility of the detection results, if the result of the first initial rotation exceeds a predetermined threshold value, an initial rotation is executed again and the remaining developer amount level is confirmed in this embodiment.

As described above, the remaining developer amount detecting means in the configuration of the flat antenna 20 has different outputs depending on the remaining-developer-amount level. Therefore, particularly, from the state in which the developer level is not stable after inserting the cartridge in the apparatus main body, the detection precision increases depending on the duration of rotation time of the cartridge before a measurement. This is because toner is agitated in conjunction with the rotation and the toner level in the developer container is leveled evenly. In this way, by determining the existence of an abnormality in the second initial rotation, more precise determination can be performed.

In the second initial rotation as well, when a large difference exceeding the predetermined threshold value X is recognized between the result of this initial rotation and the remaining-developer-amount level memorized in the memory means 31 of the process cartridge, it is determined that an abnormality or a failure has occurred in the cartridge B or the image forming apparatus main body 100. Then, the status of the image forming apparatus is not the print ready status but the alarm display status. That is, the comparing means 346 disposed in the controller portion D communicates with the signal output means 347 also disposed in the controller portion D, indicates the occurrence of the abnormality on the display 33 of the apparatus main body 100 or the display 341*a* of the host 341 such as a personal computer or a workstation to inform a user of the occurrence of the abnormality.

The indicated contents may be those indicating the occurrence of a failure of the remaining developer amount detecting means 20, the possibility of the occurrence of a failure such as a failure of the main body or the cause of a failure, or those indicating the necessity of maintenance, such as indicating that inspection of the process cartridge or the main body is necessary, and so on.

The comparing means 346 disposed in the controller portion D then communicate with the writing and reading means 332 disposed in the engine portion C via the video interface (I/F) 343 and causes the memory means 31 mounted on the process cartridge B to memorize the information that the abnormality has occurred. In this way, it can be instantly determined that it is the process cartridge that has possibly failed even if the cartridge is replaced and inserted, and the use of the cartridge in which the abnormality has occurred can be prevented.

If the detection result of the first initial rotation and the detection result of the second initial rotation are smaller than the predetermined value X, it is determined that there is no problem and the abnormality detection finishes.

Figure 17:
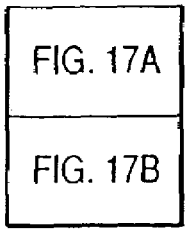
FIG. 17, composed of FIGS. 17A and 17B, is a flow chart of an abnormality detecting system of the ninth embodiment of the present invention.
Figure 17A:
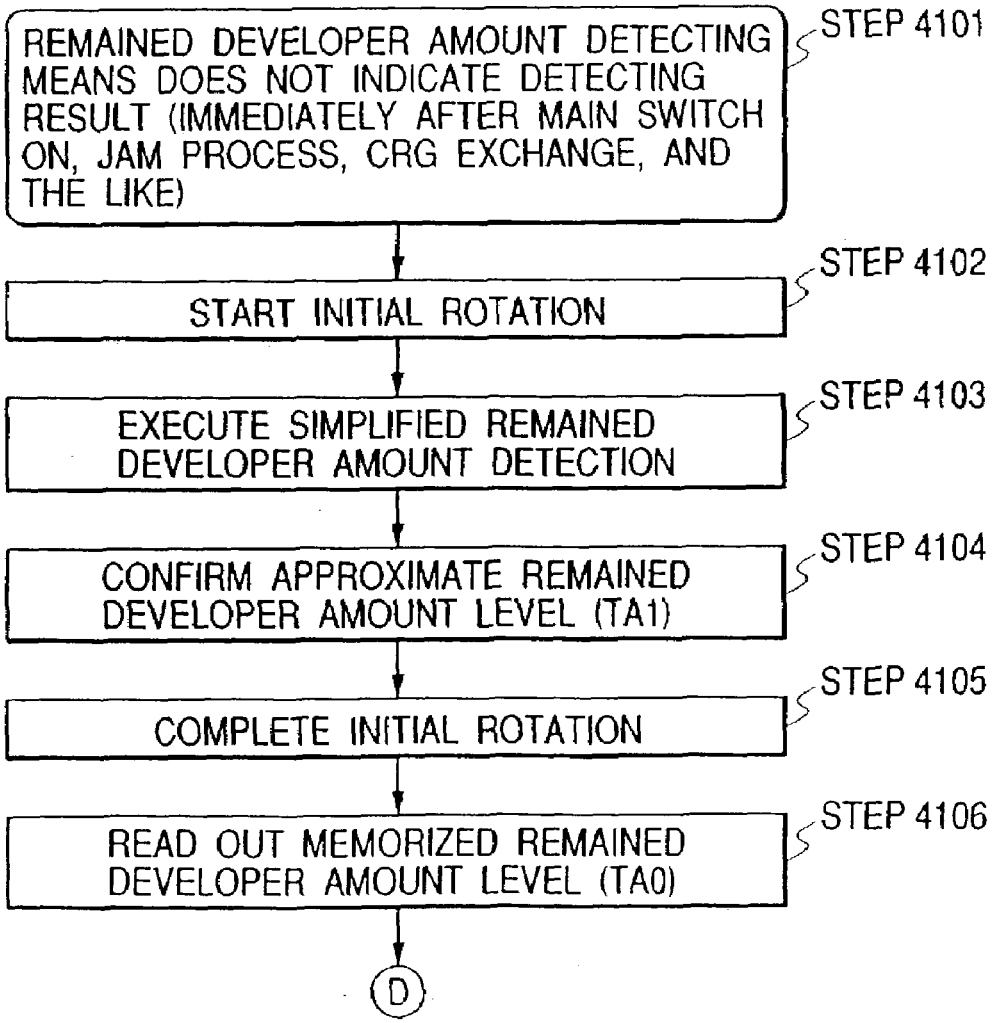
Figure 17B:
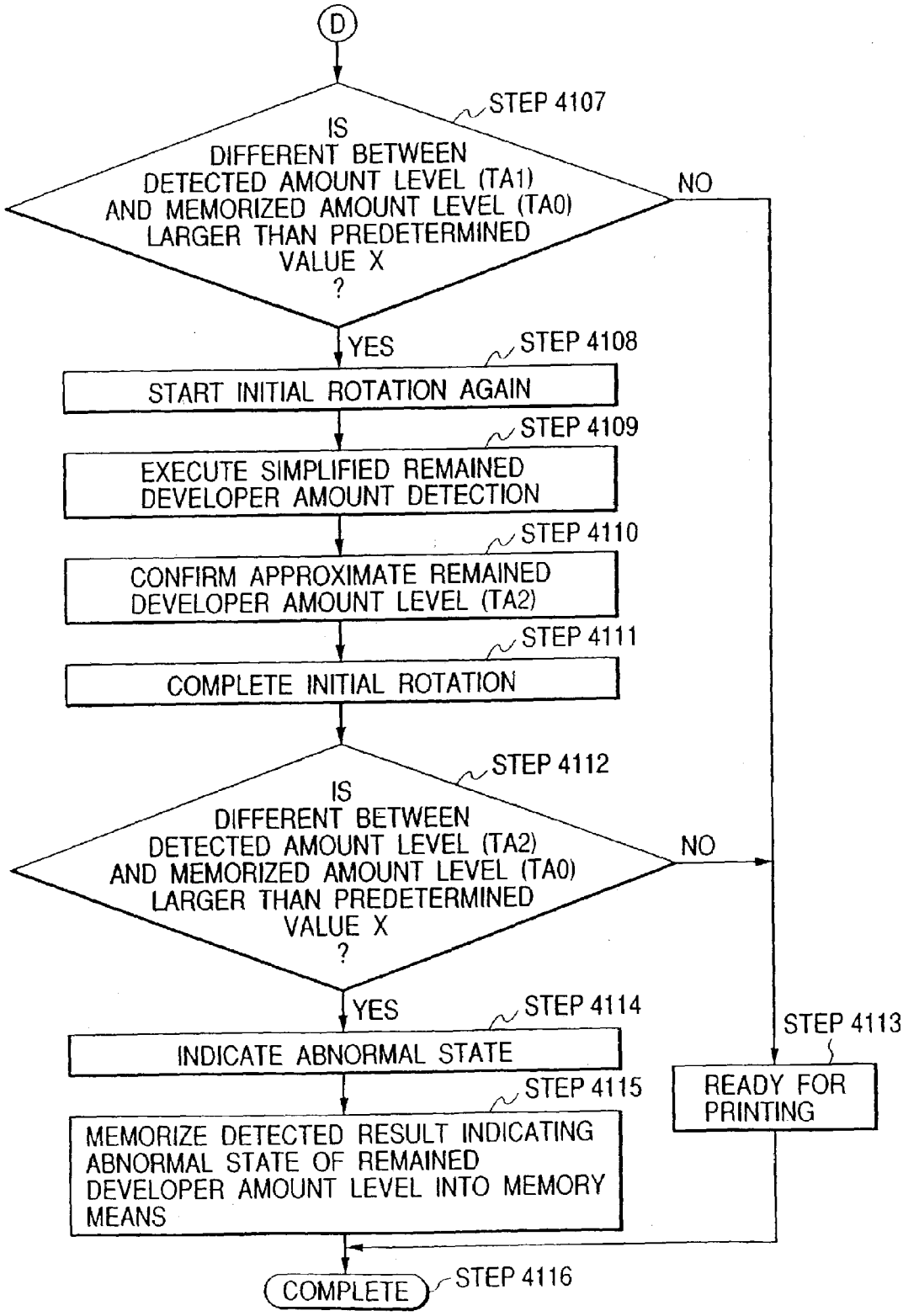

The above processing is shown as a flow chart in FIGS. 17A and 17B. The remaining-developer-amount-indicating method and the abnormality detection method of the cartridge and the image forming apparatus will now be described with reference to FIGS. 17A and 17B.

In this embodiment, it is assumed that the remaining-developer-amount level is always indicated on the display 33 of the apparatus main body 100 and the display 341*a* of a personal computer while the image forming apparatus main body 100 is operating.

Therefore, if the remaining-developer-amount level by the remaining developer amount detecting means 20 is not confirmed, the remaining-developer amount is indicated as follows:

The data writing and reading means 332 disposed in the engine portion C reads out the remaining-developer-amount level TA0 confirmed by the previous remaining-developer-amount detection from the memory means 31 mounted on the process cartridge B and transmits it to the signal output means 347 disposed in the controller portion D via the video interface (I/F) 343. Upon receiving this, the signal output means 347 outputs a signal instructing the indicating means 33 provided in the image forming apparatus main body 100 or the host 341 to display TA0 as the remaining-developer-amount level at that time.

Further, since an amount of a developer which is contained at the factory shipment stage is memorized in the memory means 31 in advance even if the cartridge B is brand-new, this level is read out and indicated until the remaining-developer-amount level is confirmed.

As shown in FIGS. 17A and 17B, immediately after the power-source switch of the image forming apparatus main body is turned on, immediately after a cartridge is replaced, immediately after jam processing and so on, when a door is opened or closed for the replacement of a cartridge (step 4101), the image forming apparatus main body is in the above-mentioned initial rotation mode (step 4102). During the execution of this initial rotation, a simple remaining-developer-amount detection by the remaining developer amount detecting means 20 is executed (step 4103). An output signal from the remaining developer amount detecting means 20 is rendered by a simple statistical processing different from the ordinary statistical processing in the signal processing means 344 disposed in the engine portion C, and the approximate remaining developer amount level TA1 is confirmed in a short time (step 4104). After the confirmation, the initial rotation finishes (step 4105).

The confirmed approximate remaining-developer-amount level TA1 is transmitted to the comparing means 346 disposed in the controller portion D from the signal processing means 344 via the video interface (I/F) 343.

In addition, the remaining-developer-amount level TA0 confirmed by the previous remaining-amount detection is read out of the memory means 31 mounted on the process cartridge B by the writing and reading means 332 disposed in the engine portion C (step 4106) and transmitted to the comparing means 346 disposed in the controller portion D via the video interface (I/F) 343.

Further, since the amount of a developer which is contained at the factory shipment stage is memorized in the memory means 31 in advance even if the cartridge B is brand-new, this level is read out.

In the comparing means 346 disposed in the controller portion D, the approximate remaining developer amount level TA1 and the remaining-developer-amount level TA0 read out of the memory means 31 are compared (step 4107).

Here, comparing both the values, if the difference is smaller than the predetermined value X, the comparing means 346 determines that no specific problem has occurred, and the image forming apparatus is in the print ready status (step 4113).

If the difference of both the values is larger than the predetermined value X, the comparing means 346 determines that there is the possibility of an abnormality and requests the initial rotation again to the engine controller 342 via the video interface 343. The engine controller 342, upon receiving this signal, suspends to be in the print ready status and is in the initial rotation mode again (step 4108).

By signal processing similar to steps 4103 and 4104, the second approximate remaining-developer-amount level TA2 is thereafter confirmed (step 4109, step 4110). After the confirmation, the second initial rotation finishes (step 4111).

After this, TA2 and TA0 are compared (step 4112) and, if the difference is smaller than the predetermined value X, the comparing means 346 determines that no specific problem has occurred, and the image forming apparatus is in the print ready status (step 4113).

If the difference is larger than the predetermined value X, the comparing means 346 determines that some abnormality has occurred, communicates with the signal output means 347 disposed in the controller portion D as well and transmits a signal indicating that the abnormality has occurred to the display 33 of the apparatus body 100 and the display 341*a* of the host 341 such as a personal computer or a workstation (step 4114).

The comparing means 346 simultaneously communicates with the data writing and reading means 332 disposed in the engine portion C and causes the memory means 31 to memorize the information that the abnormality has occurred (step 4115).

In this embodiment, although the controller portion D is configured to have a part of the comparing functions of a remained-developer-amount level, the controller portion D can be configured to be provided with all the functions. In this case as well, on the video interface (I/F) 343 being communicating means of the controller portion D and the engine portion C, there are two lines of outputs relating to the remaining developer amount level, namely, the current remaining-developer-amount-level value confirmed by the remaining developer amount detecting means 20 and the remaining-developer-amount-level value confirmed by the previous remaining-developer-amount detection and memorized in the memory means 31.

Although the flat antenna method is used as the remaining developer amount detecting means 20 in this embodiment, the present invention is not limited to the remaining developer amount detecting means of this method. A method such as the agitating torque detecting method in the developer container 4 may be used, as far as it can detect the remaining-developer-amount level.

In addition, the signal processing means 332 disposed in the image forming apparatus main body 100 may be mounted on the process cartridge B together with the memory means 31. By mounting a calculation processing apparatus relating to both the signal processing means 332 and the memory means 31 on the process cartridge B, communications such as writing and reading of data performed between the image forming apparatus main body 100 and the process cartridge B can be simplified. As a result, the possibility of the occurrence of communication errors by a defective contact, a noise and the like is decreased and a stable detection of the remaining-developer-amount level can be conducted.

Tenth Embodiment

The tenth embodiment of the present invention will now be described. A characteristic of this embodiment is that a replacement detection of a cartridge is performed and an abnormality detection is performed only when a cartridge is replaced. The configurations of the image forming apparatus main body 100 and the cartridge B are the same as those of the first and the ninth embodiment, thus a description thereof is omitted.

Causes of failures of the remaining developer amount detecting means such as the flat antenna 20 are described in the ninth embodiment, and in the case of an integrated type cartridge in which a photosensitive drum and a developing apparatus are integrated, since a cartridge is rarely taken out from the image forming apparatus main body during the use, the cases in which a failure actually occurs are mostly defective insertion or defective contact at the time when a cartridge is replaced, breakage inherent in the flat antenna 20 and so on.

Therefore, an objective of this embodiment is to improve the user's operability by limiting the execution of an abnormality detection that takes time until the print ready status to only in cases it is required through detecting the replacement of a cartridge.

The detection of the replacement of a cartridge is possible if the apparatus main body side recognizes individual identifying information held by the cartridge side. For example, the replacement of a cartridge can be detected by memorizing a serial number inherent in a cartridge in the memory means 31 of the process cartridge B, memorizing the number in a nonvolatile memory disposed in the engine portion C or the controller portion D, and comparing the number with the serial number of the cartridge inserted when the power source is inputted or the cartridge door is closed.

Processing of the tenth embodiment of the present invention will be hereinafter described with reference to FIGS. 18A and 18B. In this embodiment, as in the ninth embodiment, it is assumed that the remaining-developer-amount level is always indicated on the display 33 of the image forming apparatus main body 100 or the display 341*a* of a personal computer while the apparatus main body 100 is operating.

Figure 18:
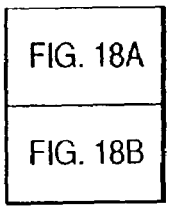
FIG. 18, composed of FIGS. 18A and 18B, is a flow chart of an abnormality detecting system of the tenth embodiment of the present invention.
Figure 18A:
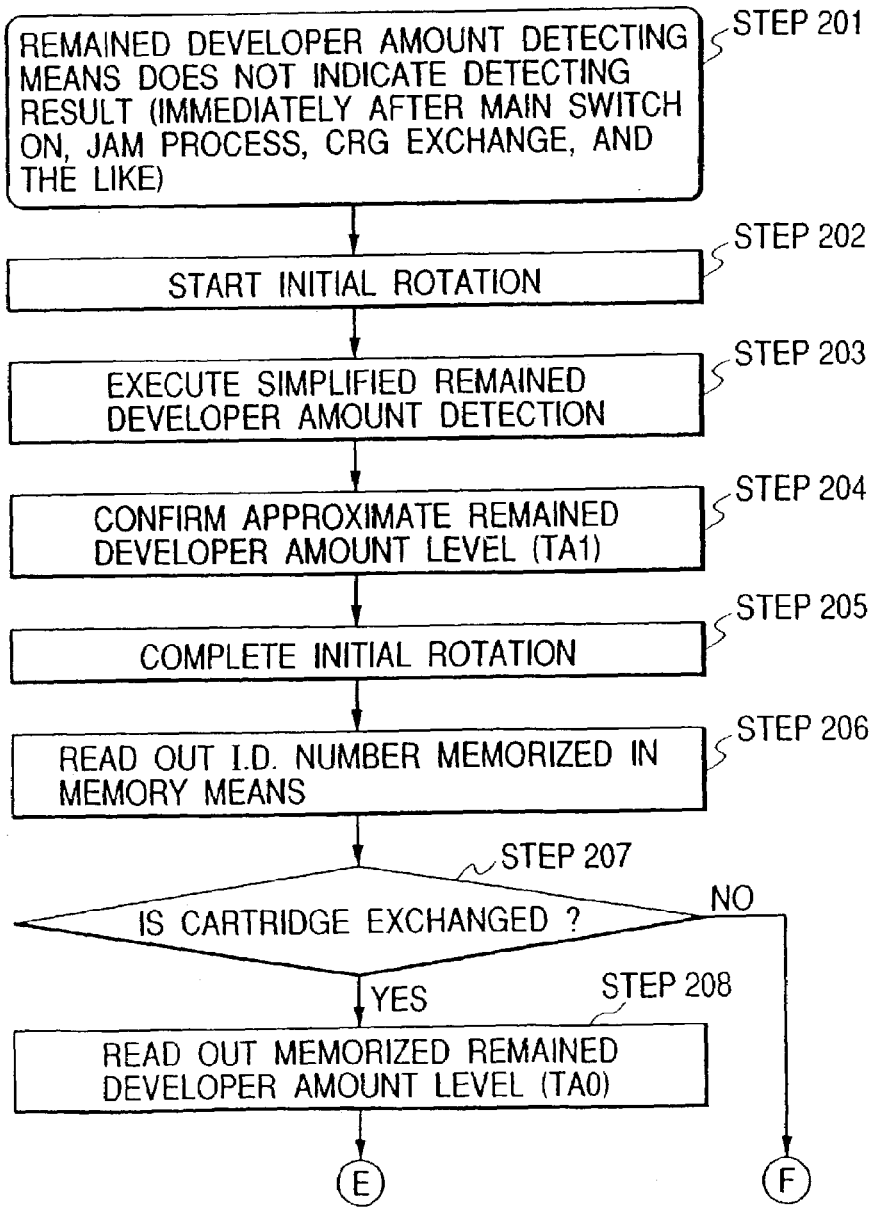
Figure 18B:
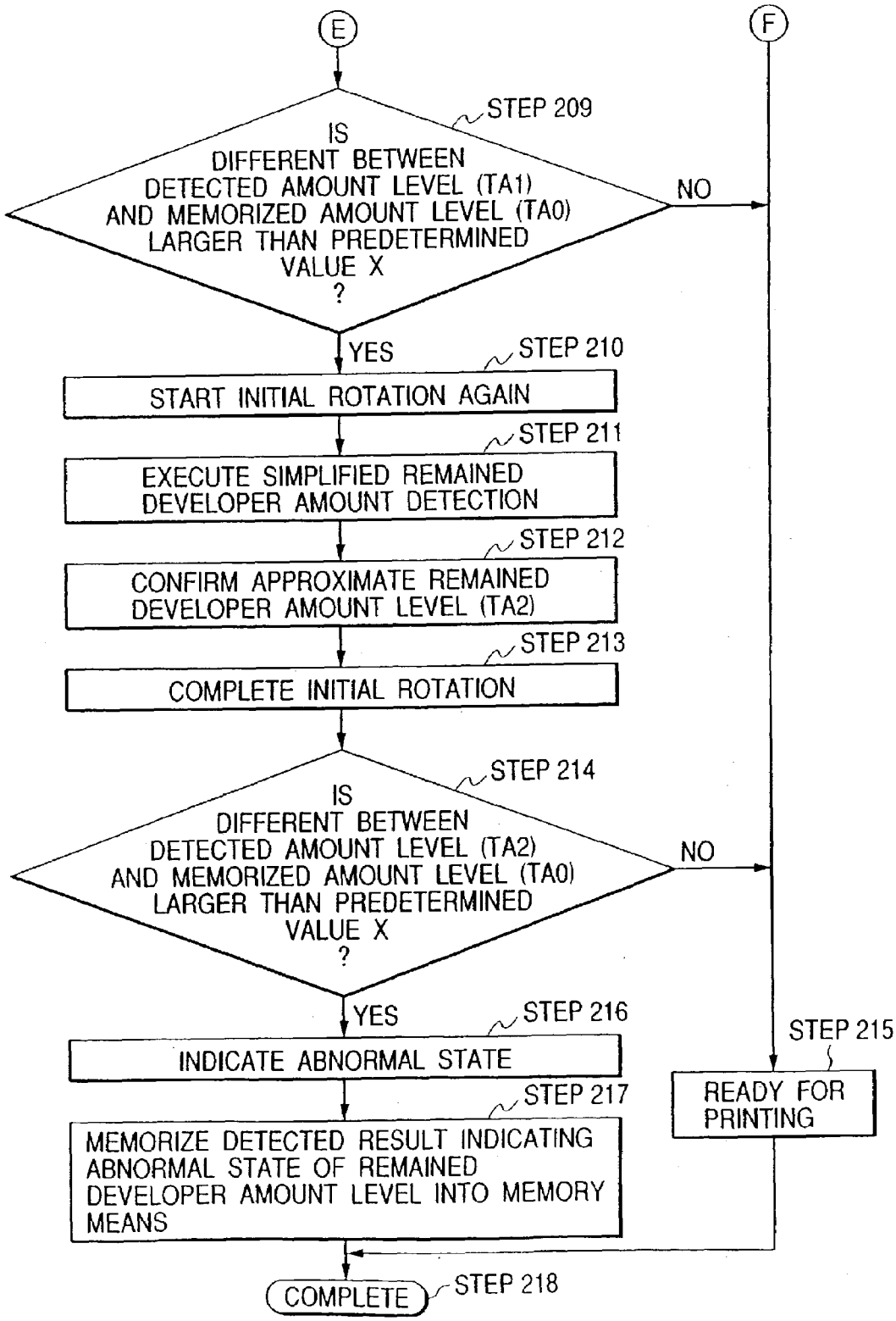

As shown in FIGS. 18A and 18B, immediately after the power source switch of the image forming apparatus main body is turned on, immediately after a cartridge is replaced, immediately after jam processing and so on, when a door is opened or closed for the replacement of a cartridge (step 201), the image forming apparatus main body is in the above-mentioned initial rotation mode (step 202). During the execution of this initial rotation, a simple remaining-developer-amount detection by the remaining developer amount detecting means 20 is executed (step 203). An output signal from the remaining developer amount detecting means 20 is rendered a simple statistical processing different from the ordinary statistical processing in the signal processing means 344 disposed in the engine portion C, and the approximate remaining developer amount level Ta1 is confirmed (step 204). After the confirmation, the initial rotation finishes (step 205).

Then, the serial number of the cartridge is read out of the memory means 31 of the cartridge (step 206) and compares it with the number memorized in the apparatus main body side (step 207). Here, if the serial number is the same as the number memorized in the apparatus main body side and the cartridge is not replaced, the apparatus main body is in the print ready status (step 215). If the serial number is changed, the process proceeds to step 208 and subsequent steps.

The approximate remaining-developer-amount level TA1 confirmed in step 204 is transmitted to the comparing means 346 disposed in the controller portion D from the signal processing means 344 via the video interface (I/F) 343.

In addition, the remaining-developer-amount level TA0 confirmed by the previous remaining-developer-amount detection is read out from the memory means 31 mounted on the process cartridge B by the data writing and reading means 332 disposed in the engine portion C (step 208) and transmitted to the comparing means 346 disposed in the controller portion D via the video interface (I/F) 343.

Further, since an amount of a developer which is contained at the factory shipment stage is memorized in the memory means 31 in advance even if the cartridge B is brand-new, this level is read out.

In the comparing means 346 disposed in the controller portion D, the approximate remaining-developer-amount level TA1 and the remaining-developer-amount level TA0 read out of the memory means 31 are compared (step 209).

Here, both the values are compared and, if the difference is smaller than the predetermined value X, the comparing means determines that no specific problem has occurred, and the image forming apparatus is in the print ready status (step 215).

If the difference of both the values is larger than the predetermined value X, the comparing means 346 determines that there is the possibility of an abnormality and requests the engine controller 342 to perform the initial rotation again via the video interface 343. The engine controller 342, upon receiving this signal, suspends to be in the print ready status and is in the initial rotation mode again (step 210).

By signal processing similar to steps 203 and 204, the second approximate remaining developer amount-level TA2 is thereafter confirmed (step 211, step 212). After the confirmation, the second initial rotation finishes (step 213).

After this, TA2 and TA0 are compared (step 214) and, if the difference is smaller than the predetermined value X, the comparing means 346 determines that no specific problem has occurred, and the image forming apparatus is in the print ready status (step 215). If the difference is larger than the predetermined value X, the comparing means 346 determines that some abnormality has occurred, communicates with the signal output means 347 disposed in the controller portion D as well and transmits a signal indicating that the abnormality has occurred to the display 33 of the apparatus body 100 and the display 341*a* of the host 341 such as a personal computer or a workstation (step 216).

The comparing means 346 simultaneously communicates with the data writing and reading means 332 disposed in the engine portion C and causes the memory means 31 to memorize the information that the abnormality has occurred (step 217).

In this way, by entering the abnormality detecting sequence only when a cartridge is replaced, a failure can be detected in substantially most of the cases.

In this embodiment, as in the ninth embodiment, although the controller D is configured to have a part of the comparing functions of the remaining-developer-amount level, the controller portion D can be configured to be provided with all the functions. In this case as well, on the video interface (I/F) 343 being communicating means of the controller portion D and the engine portion C, there are two lines of outputs relating to the remaining-developer-amount level, namely, the current remaining-developer-amount-level value confirmed by the remaining developer detecting means 20 and the remaining-developer-amount-level value confirmed by the previous remaining amount detection and memorized in the memory means 31.

Although the flat antenna method is used as the remaining developer amount detecting means 20 in this embodiment, the present invention is not limited to the remaining developer amount detecting means of this method. A method such as the agitating torque detecting method in the developer container 4 may be used, as far as it can detect the remaining-developer-amount level.

In addition, the signal processing means 344 disposed in the image forming apparatus main body 100 may be mounted on the process cartridge B together with the memory means 31. By mounting a calculation processing apparatus relating to both the signal processing means 344 and the memory means 31 on the process cartridge B, communications such as writing and reading of data performed between the image forming apparatus main body 100 and the process cartridge B can be simplified As a result, the possibility of occurrence of communication errors by a defective contact, a noise and the like is decreased and a stable detection of the remaining-developer-amount level can be conducted.

Moreover, although the replacement detection of a cartridge is performed by a serial number in the memory means 31 in this embodiment, any known technology is applicable if the individual identification of a cartridge is possible.

Eleventh Embodiment

One embodiment of the developing apparatus E constituted as a cartridge that is another aspect of the present invention will now be described.

The developing apparatus E of this embodiment, whose mechanical configuration is the same as that shown in FIG. 7, is constituted as a cartridge by integrally forming a developing chamber 5A holding developing means such as a developing roller 5*a* and a developing blade 5*c* and developer container 4 containing developer for supplying developer to the developing means 5 by developing frame bodies 11, 12 of plastic. That is, the developing apparatus E of this embodiment is the part of the process cartridge B forming the developing apparatus described in the first and the ninth embodiments constituted as a unit, i.e., the developing apparatus E is part of a cartridge that is integrally formed by excluding the photosensitive drum 1, the charging means 2 and the cleaning means 7 from the process cartridge B. Therefore, all the developing apparatus constituting parts and the developer-amount-detecting-means configuration described in the first and the ninth embodiments are applied to the developing apparatus of this embodiment. Therefore, the above description in the ninth and the tenth embodiments are applied to descriptions concerning these configurations and operations, i.e., the abnormality detecting system.

Operations and effects similar to those in the ninth and the tenth embodiments can be attained in this embodiment as well.

Twelfth Embodiment

One embodiment of an electrophotographic image forming apparatus that can be inserted in a process cartridge configured in accordance with the present invention will now be described with reference to FIGS. 1 through 3 and FIG. 19. In this embodiment, an electrophotographic image forming apparatus is a laser printer A of the electrophotographic method. Further, since mechanical configurations of the image forming apparatus main body and the cartridge are the same as those of the first embodiment, the description thereof is omitted.

Figure 19:
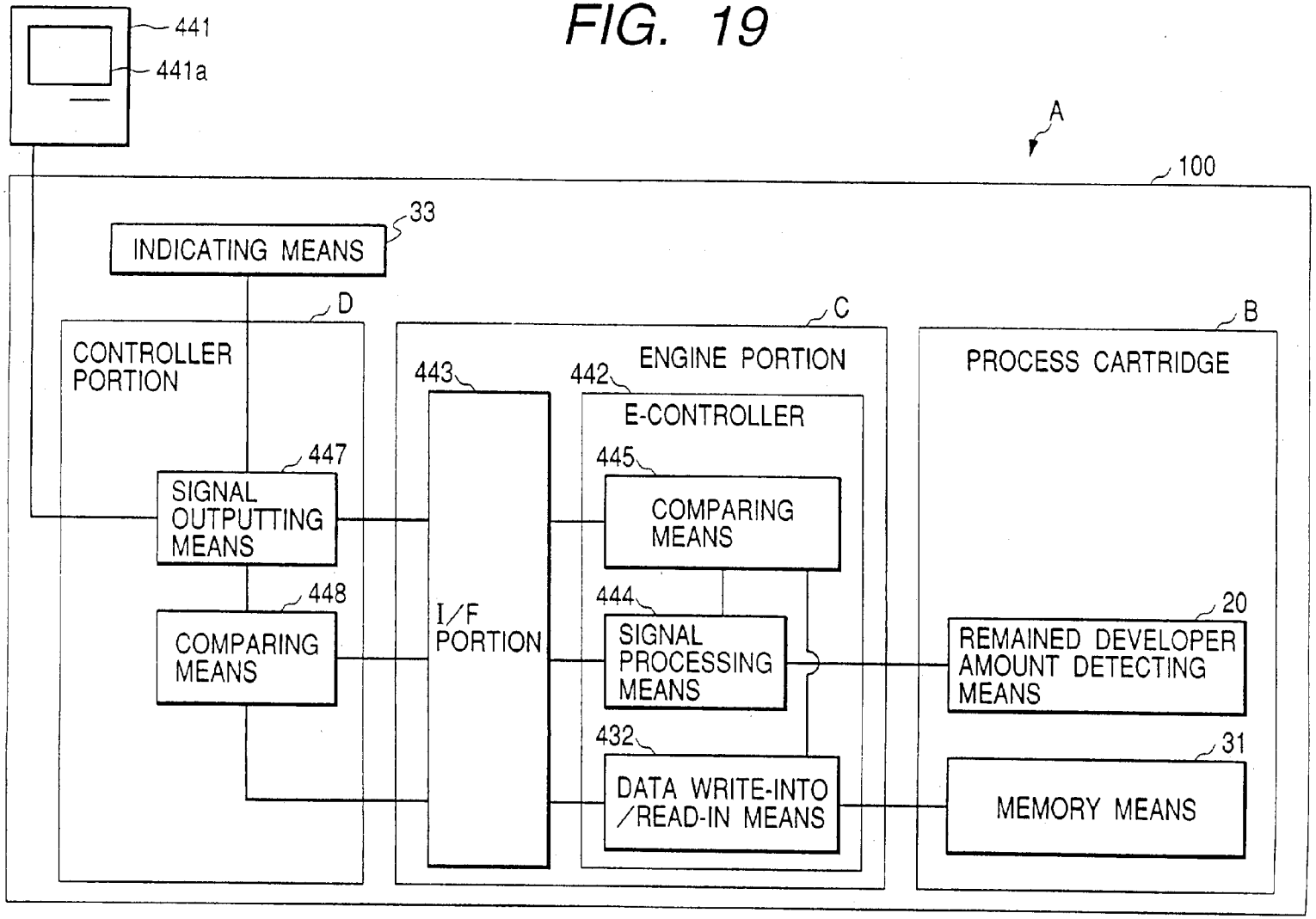
FIG. 19 is a block diagram of an image forming apparatus of the twelfth embodiment of the present invention.

As shown in FIG. 19, a laser printer A is connected to a host 441 such as a personal computer and a workstation and used, and its configuration is roughly divided into an engine portion C for forming an image on recording material, for example, recording paper, an OHP sheet, cloth and the like by electrophotographic image forming process, and a controller portion D that is connected to a host 441 and is developing means for developing page descriptive language received with a print requesting signal from the host 441 to image data.

The overall operation of the engine portion C is controlled by an E-controller 442 mounted on the engine portion C. The engine portion C and the controller portion D can mutually communicate via a video interface (I/F) 443.

In this embodiment as well, statistical processing such as finding an average value or choosing a minimum value of antenna outputs is conducted depending on the rotation cycle of the surface cleaning means 10*a*.

However, in order to confirm the remaining-developer-amount level, it is necessary to impress bias to the flat antenna 20, rotate the agitating means 10 and the surface cleaning means 10*a* (the agitating means 10), and execute statistical processing of the antenna output in accordance with the rotation cycle of the surface cleaning means 10*a*, and hence time is required for such processing.

More particularly, an output signal from the remaining developer amount detecting means 20 disposed in the process cartridge B is statistically processed by a signal processing means 444 disposed in the engine portion C. Further, this is confirmed as the remaining-developer-amount level in the developer container 4 using the relationship between an electrostatic capacity and the developer amount to be detected by the flat antenna 20 that are related to each other in advance.

In this embodiment, the remaining-developer-amount level is indicated as a percentage with the remaining developer amount in the unused state as 100% and the remaining developer amount in the state in which developer is fully consumed for forming an image as 0%.

In addition, in accordance with the present invention, the memory means 31 is disposed in the process cartridge B, and the confirmed remaining-developer-amount level is written and memorized in the memory means 31 at any time.

As described above, by disposing the memory means 31 on the process cartridge B, even in the case in which the cartridge B is replaced and used, the remaining-developer-amount level in each cartridge can be memorized.

In this embodiment, the memory means 31 mounted on the process cartridge B is a nonvolatile memory of the serial data input/output type and has the memory capacity of 16 bits. This capacity is enough to express integral numbers from 0 to 100. Thus, it is possible to memorize the remaining-developer-amount level in the developer container 4 as a percentage.

Other than the nonvolatile memory used in this embodiment, a volatile memory and the like provided with the power source can be used as the memory means 31, and a non-contact memory capable of communicating without mechanically connecting the image forming apparatus main body 100 and the memory means 31 can also be used.

In addition, data writing and reading means 432 with respect to the memory means 31 is disposed in the engine portion C.

When data are written and read in the memory means 31, an appropriate waiting time is set depending on a device characteristic to be used, and its operation is guaranteed.

The remaining-developer-amount-detecting system as well as an abnormality detecting system for the cartridge and the image forming apparatus in this embodiment will now be described.

First, the remaining-amount-detecting method of developer will be described. In this embodiment, while the image forming apparatus main body 100 is operating, the remaining-developer-amount level can always be indicated on the display 33 (FIG. 19) being a indicating portion of the apparatus main body 100 or a display 441*a* (FIG. 19) being an information indicating portion provided in the host 44*i* such as a personal computer and a workstation, and if an abnormality has occurred, the occurrence can be instantly indicated on the display 33 of the apparatus main body 100 or the display 441*a* of the host 441. Naturally, this can be indicated on both the display 33 of the apparatus main body 100 and the display 441*a* of the host 441.

Signal output means 447 for outputting a signal indicating the remaining-developer-amount level and the occurrence of the abnormality to the display portion 33 of the image forming apparatus main body or an apparatus having a display that can communicate with the image forming apparatus is disposed in a controller portion D. In this way, it becomes easy to display the remaining-developer-amount level and the occurrence of an abnormality on the host 441 such as a personal computer, a workstation that are an apparatus having a display that can communicate with the image forming apparatus.

As described above, the remaining developer amount in the developer container 4 is confirmed by statistically processing the output from the flat antenna. This processing is executed in the signal processing means 444 disposed in the E-controller 442 of the engine portion C.

Immediately after the power-source switch of the image forming apparatus main body 100 is turned on, immediately after a cartridge is replaced, or immediately after jam processing, an alternate bias is impressed on the flat antenna 20 and the remaining-developer-amount-level detection is performed by the remaining developer amount detecting means 20.

As described above, immediately after the power-source switch of the image forming apparatus main body is turned on, immediately after a cartridge is replaced, or immediately after jam processing, since a bias impression to the flat antenna 20 and rotations of the agitating means 10 and the flat antenna surface cleaning means 10*a* are performed, and statistical processing of an antenna output depending on the rotation cycle of the surface cleaning means 10*a*, there is not sufficient time for confirming the remaining-developer-amount level and the remaining-developer-amount level cannot be indicated. Therefore, a user cannot find the precise remaining-developer-amount level during such a period of time.

Thus, the remaining-developer-amount level confirmed by the previous remaining-developer-amount detection and memorized in the memory means 31 disposed in the process cartridge B is read out by the writing and reading means 432 disposed in the engine portion C, communicated with and transmitted to the signal output means 447 disposed in the controller portion D via the video interface (I/F) 443 and indicated on the display 33 of the apparatus main body 100, or the display 441*a* of the host 441 such as a personal computer or a workstation.

In this way, during the period when sufficient time does not elapse until the remaining-developer-amount level is confirmed such as immediately after the power-source switch of the image forming apparatus main body is turned on, a cartridge is replaced or jam processing is conducted a user can be notified of the remaining-developer amount immediately. An abnormality detection of the cartridge and the image forming apparatus is performed at this time.

The abnormality detecting method of a cartridge and the image forming apparatus will now be described. There is a possibility that the remaining developer amount detecting means 20 such as the flat antenna 20 capable of detecting the remaining-developer amount level breaks down. Causes of failures might be electronic failures such as defective contact and defective impressed bias or mechanical failures such as damage to the flat antenna 20. In any case, the possibility that both the image forming apparatus and the cartridge are critically affected is high. Thus, an abnormality detection must be performed at least before the image forming apparatus forms an image.

As described above, since the agitating means 10 must be rotated and statistical processing of antenna outputs must be performed in accordance with the rotation cycle of the agitating means 10 such as by performing some image formation, the remaining-developer-amount level cannot be precisely confirmed at this time. Therefore, in order to detect an abnormality as above based on the remaining-developer amount confirmed by the ordinary statistical processing, it is necessary to wait until such processing finishes, and an abnormality cannot be promptly detected at least before starting image formation.

On the other hand, low precision statistical processing different from the ordinary statistical processing can detect an approximate remaining-developer-amount level in a short time. Thus, this embodiment adopt a configuration to promptly detect an abnormality of a cartridge and the image forming apparatus using this less precise (simple) statistical processing different from the ordinary statistical processing first.

This simple statistical processing is performed by the signal processing means 444 disposed in the engine portion C. The approximate remaining-developer-amount level is confirmed as the remaining developer amount level in the developer container 4 using the relationship between an electrostatic capacity to be detected using the flat antenna 20 and the developer amount that are related to each other in advance.

That is, as described above, the developer amount in the developer container 4 is usually confirmed by statistical processing such as statistical processing for taking an average value of antenna outputs detected while, for example, the ten rotations of the agitating means 10 occur. On the other hand, as the above-mentioned simple statistical processing, the following have possibly occurred:

1. Impressing bias on the flat antenna 20 without rotating the agitating means 10. Although, there is high possibility that the developer sticks to the flat antenna 20 and remains, there is no problem in a rough detection.
2. An average value of antenna outputs detected during one rotation of the agitating means 10. Precision of the detection is decreased, but there is no problem in a rough detection.

The confirmed approximate remaining-developer-amount level is transmitted to comparing means 448 disposed in the controller portion D from the signal processing means 432 via the video interface (I/F) 443.

The remaining-developer-amount level confirmed by the previous remaining-developer-amount detection and memorized in the memory means 31 disposed in the process cartridge B is simultaneously read by the writing and reading means 432 disposed in the engine portion C and transmitted to the comparing means 448 disposed in the controller portion D via the video interface (I/F) 443.

In the comparing means 448, when a large difference exceeding the predetermined threshold value X is recognized between the approximate remaining-developer-amount level and the remaining-developer-amount level confirmed at the time of the previous image formation and memorized in the memory means 31 of the process cartridge, a breakage of the remaining developer amount detecting means 20, a breakage of the surface cleaning means 10*a*, an electrical short circuit, a failure of the image forming apparatus main body 100 and the like have possibly occurred.

In this case, the comparing means 448 determines that an abnormality or a failure has occurred in the process cartridge B or the image forming apparatus main body 100, communicates with the signal output means 447 disposed in the controller portion D as well and indicates that the abnormality has occurred on the display 33 of the apparatus body 100 and the display 441*a* of the host 441 such as a personal computer or a workstation, and inform a user of the occurrence of the abnormality.

Indicated contents may be those indicating the occurrence of a failure of the remaining developer amount detecting means 20, the possibility of the occurrence of a failure such as a failure of the main body 100 or the cause of a failure, or those indicating the necessity of maintenance such as indicating that inspection of the process cartridge or the main body is necessary.

The comparing means 448 disposed in the controller portion D then communicate with the writing and reading means 432 disposed in the engine portion C via the video interface (I/F) 443 and causes the memory means 31 mounted on the process cartridge B to memorize the information that the abnormality has occurred. In this way, it can be instantly determined that it is the process cartridge that has possibly failed even if the cartridge is replaced and inserted, and the use of the cartridge in which the abnormality has occurred can be prevented.

In addition, if it is recognized that the difference between both the values is smaller than the predetermined threshold value X, the comparing means 448 determines that there is no problem and the abnormality detection finishes.

After the abnormality detection using the remaining-developer-amount obtained by the above-mentioned simple statistical processing, the remaining-developer-amount is confirmed by the ordinary statistical processing. That is, in the remaining-developer-amount detection performed during the operation of image formation, in order to inform a user of more precise remaining developer amount level and to make the abnormality detection of the cartridge and the image forming apparatus always possible, the remaining-developer-amount level is confirmed by performing the ordinary statistical processing with respect to output signals of the remaining developer amount detecting means 20, and the confirmed remaining developer amount level and the remaining-developer-amount level memorized in the memory means 31 of the process cartridge B are compared by the comparing means 48 disposed in the controller portion D and the comparing means 445 disposed in the engine portion C in two steps as described below.

First, in the first step, the magnitude of the absolute value of the difference between both remaining-developer-amount levels are compared in the comparing means 448 disposed in the controller portion D.

In an apparatus for serially detecting the remaining amount such as the developer amount detecting device 20 of this embodiment, there should not be too large a difference between the remaining-developer-amount level confirmed by the nth detection and the remaining-developer-amount level confirmed by the n+1th detection. Therefore, when a large difference exceeding a predetermined threshold value X is recognized, it is possible that this is caused by a failure of the remaining developer amount detecting means 20, a failure of the surface cleaning means 10*a*, an electric short-circuit, a failure of the image forming apparatus main body and so on.

In this case, as described above, the comparing means 448 disposed in the controller portion D determines that an abnormality or a failure of the process cartridge or the image forming apparatus main body 100 has occurred, communicates with and transmits to the signal output means 447 disposed in the controller portion D as well, indicates the occurrence of the abnormality on the display 33 of the apparatus main body 100 and/or the display 441*a* of the host 441 such as a personal computer and a workstation, informs a user of the occurrence of the abnormality, and causes the memory means 31 mounted on the process cartridge B to memorize the information that the abnormality has occurred. Then, in the second step, the confirmed remaining-developer-amount level and the remaining-developer-amount level memorized in the memory means 31 of the process cartridge B are compared in the comparing means 445 disposed in the engine portion C to find which is larger.

Rationally, the currently confirmed remaining-developer-amount level is not possibly larger than the remaining-developer-amount level value confirmed at the time of the previous image formation and the like and memorized in the memory means 31 of the process cartridge B. Therefore, if the confirmed remaining-developer-amount-level value is larger than the remaining-developer-amount-level value memorized in the memory means 31 of the process cartridge B, this can be regarded as a measurement error.

In such a case, in order to not give a use erroneous information that the remaining-developer-amount level has increased, the remaining developer-amount-level confirmed in the previous remaining developer amount detection is indicated on the display 33 of the apparatus main body 100 and/or the display 441*a* of the host 441 such as a personal computer and a workstation.

That is, an update of the remaining-developer-amount level confirmed in the previous remaining-developer-amount detection to the currently confirmed remaining-developer-amount level is not inputted into the signal output means 447 disposed in the controller portion D. Thus, the writing and reading means 432 disposed in the engine portion C is not requested to write the remaining-developer-amount level as well.

If the currently confirmed remaining-developer-amount level is smaller than the remaining-developer-amount level memorized in the memory means 31 of the process cartridge, the comparing means 445 disposed in the engine portion C communicates with the signal output means 447 disposed in the controller portion D via the video interface (I/F) 443, indicates the currently confirmed remaining-developer-amount level as a new remaining-developer-amount level on the display of the apparatus main body 100 and/or the display 411*a* of the host 441 such as a personal computer and a workstation and informs a user of the remaining developer amount level.

The comparing means 445 simultaneously requests the writing and reading means 432 to write the currently confirmed remaining-developer-amount level as a new remaining-developer-amount level into the memory means 31.

By disposing the memory means 31 in the process cartridge B, the remaining-developer amount can be memorized in each cartridge. Thus, even if the cartridge B is replaced, a user can immediately find the remaining-developer-amount level conforming to each cartridge by calling the remaining-developer-amount level information out of the memory means 31 that the replacing cartridge has. In addition, an abnormality detection of the cartridge and the image forming apparatus is simultaneously possible.

Further, since an amount of a developer which is contained at the factory shipment stage is memorized in the memory means 31 in advance even if the cartridge B is brand-new, this level is read out and indicated until the remaining developer amount level is confirmed.

In this way, in accordance with this embodiment, outputs concerning the two lines of remaining-developer-amount level which are the current remaining-developer-amount level value confirmed by the remaining developer amount detecting means 20 and the remaining-developer-amount-level value confirmed in the previous remaining-amount detection and memorized in the memory means 31, is performed from the engine portion C to the controller portion D.

Figures 20, 20A:
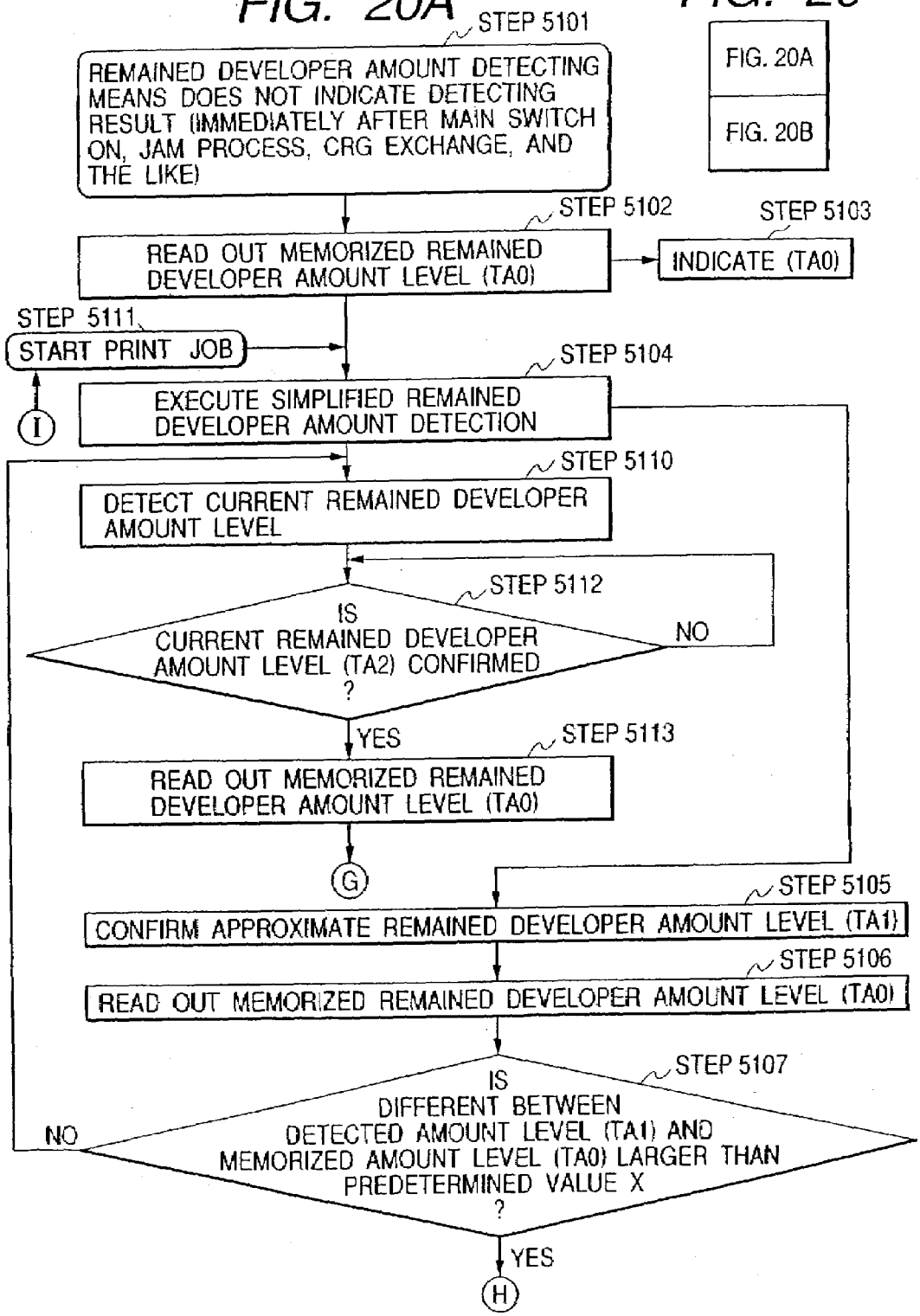
FIG. 20, composed of FIGS. 20A and 20B, is a flow chart of a remaining developer amount indicating system of the twelfth embodiment of the present invention.
Figure 20B:
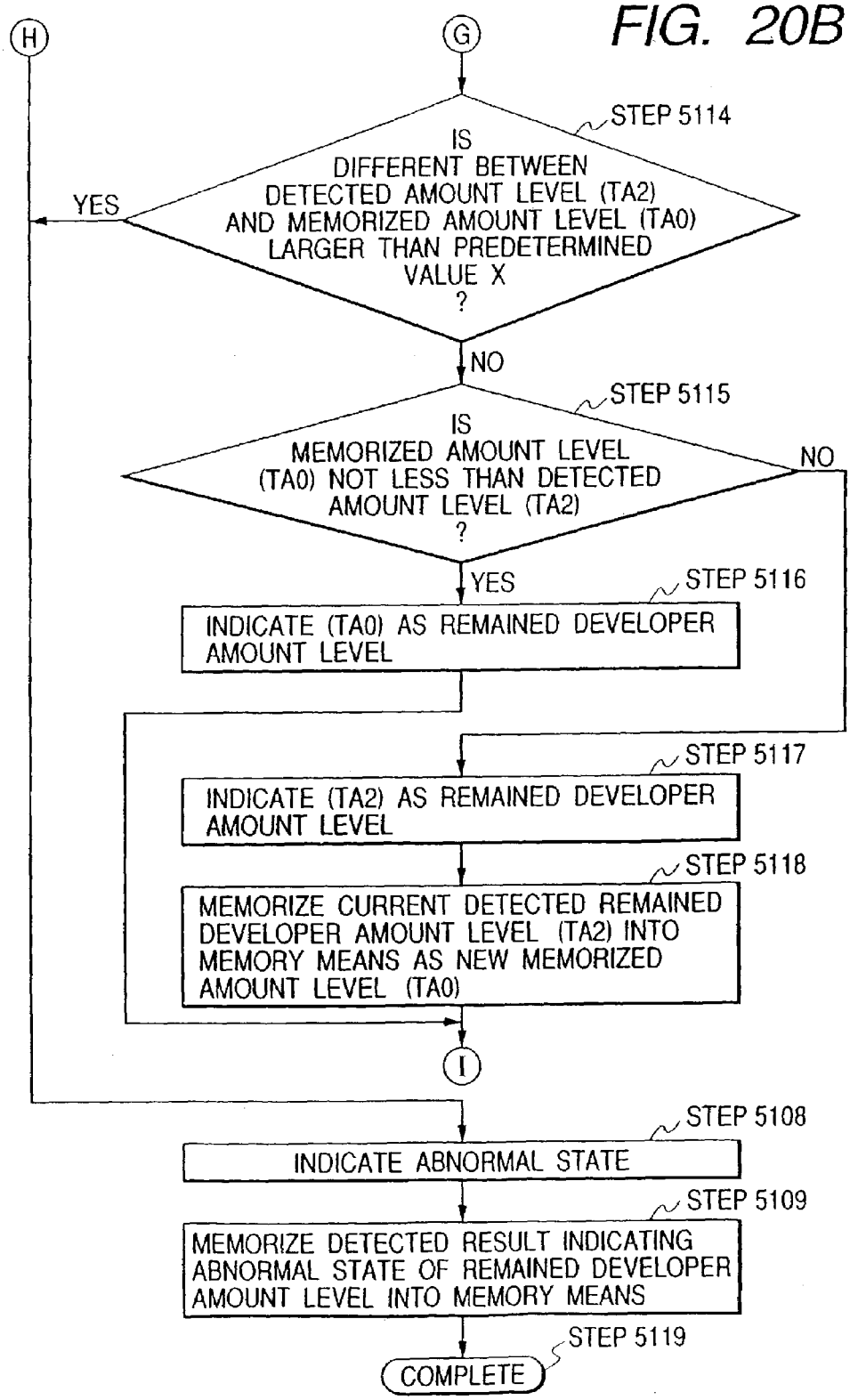

The remaining-developer-amount-detecting method and an abnormality detecting method of a cartridge and the image forming apparatus in accordance with this embodiment will now be described with reference to a flow chart shown in FIGS. 20A and 20B. The processing described above is shown as a flow chart in FIGS. 20A and 20B.

In this embodiment, while the image forming apparatus main body 100 is operating, the remaining-developer-amount level is always indicated on the display 33 of the apparatus main body 100 and/or the display 441*a* of a personal computer as the host 441.

If the remaining-developer-amount level is not confirmed by the remaining developer amount detecting means 20 immediately after the power source of the main body is inputted, a cartridge is replaced or jam processing is conducted and so on (step 5101), the data writing and reading means 432 disposed in the engine portion C reads out the remaining-developer-amount level TA0 confirmed by the previous remaining-developer-amount detection from the memory means 31 mounted on the process cartridge B (step 5102) and transmits it to the signal output means 447 disposed in the controller portion D via the video interface (I/F) 443.

Upon receiving this, the signal output means 447 outputs a signal instructing to display TA0 as the remaining-developer-amount level at that time to the display portion 33 provided in the image forming apparatus main body or the personal computer 441 (step 5103).

Further, since an amount of a developer which is contained at the factory shipment stage is memorized in the memory means 31 in advance even if the cartridge B is brand-new, this level is read out and indicated until the remaining-developer-amount level is confirmed.

A simple remaining-developer-amount detection by the remaining developer amount detecting means 20 is simultaneously executed (step 5104). Output signals from the remaining developer amount detecting means 20 are rendered by a simple statistical processing different from the ordinary statistical processing in the signal processing means 444 disposed in the engine portion C, and the approximate remaining-developer-amount level TA1 is confirmed in a short time (step 5105).

The confirmed approximate the remaining-developer-amount level TA1 is transmitted to the comparing means 448 disposed in the controller portion D from the signal processing means 444 via the video interface (I/F) 443.

In addition, the remaining-developer-amount level TA0 confirmed by the previous remaining-amount detection is read out of the memory means 31 mounted on the process cartridge B by the data writing and reading means 432 (step 5106), and transmitted to the comparing means 448 disposed in the controller portion D via the video interface (I/F) 443.

Further, since the amount of a remaining developer which is contained at the factory shipment stage is memorized in the memory means 31 in advance even if the cartridge B is brand-new, this level is read out and indicated until the remaining-developer-amount level is confirmed.

In the comparing means 448 disposed in the controller D, the approximate remaining-developer-amount level TA1 and the remaining-developer-amount level TA0 read out of the memory means 31 are compared (step 5107).

As described above, if the difference between the both values is larger than the predetermined value X, the comparing means 448 determines that some abnormality has occurred, communicates with the signal output means 447 disposed in the controller portion D and sends a signal indicating that the abnormality has occurred to the display 33 of the apparatus main body 100 and/or the display 441*a* of the host 44*i* (step 5108).

The comparing means 448 simultaneously communicates with the data writing and reading means 432 disposed in the engine portion C and causes the memory means 31 to memorize the information that the abnormality has occurred (step 5109).

If the difference between the both values is smaller than the predetermined value X in step 107, it is determined that there is no abnormality.

When the abnormality detection is finished by steps 104 through 107, a detection by the remaining developer amount detecting means 20 is executed (step 5110).

In addition, if printing is commenced from the status in which a cartridge is inserted and printing has not been performed for a while with the power-source switch of the apparatus main body being kept turned on (step 5111), time is also required until the remaining-developer-amount level is confirmed after the agitation of the developer (cleaning of the antenna) is started, but since the previous remaining-developer amount is already indicated on the display, the processes of step 5101 through 5103 are not conducted. However, the abnormality detection of steps 5104 through 5107 is executed so that an abnormality of the cartridge and the image forming apparatus is detected at least before the operation for image formation.

Thereafter, the remaining-developer detection is executed by the remaining developer amount detecting means 20 such as by forming an image to some extent (step 5110), and the current remaining-developer-amount level is confirmed as TA2 by the signal processing means 444 disposed in the engine portion C (step 5112).

The signal processing means 444 outputs the confirmed remaining-developer-amount level value TA2 to the comparing means 448 disposed in the controller portion D via the comparing means 445 disposed in the engine portion C and the video interface (I/F) 443. The remaining-developer-amount level TA0 memorized in the memory means 31 mounted on the process cartridge B is simultaneously read out by the data writing and reading means 432 (step 5113), and outputted to the comparing means 448 of the controller portion D via the comparing means 445 of the engine portion C and the video interface (I/F) 443.

TA2 and TA0 are processed as follows in the comparing means 445 and the comparing means 448.

First, an abnormality detection is performed in the comparing means 448 disposed in the controller portion D (step 5114). As described above, the remaining-developer-amount level detected and confirmed by the remaining developer amount detecting means 20 is memorized in the memory means 31 mounted on the process cartridge B at any time. Thus, unless there is any abnormality, TA2 and TA0 should be very close values. Therefore, if the difference between both the values is larger than the predetermined value X, upon receiving the output from the comparing means 448 determining that some abnormality has occurred, the signal output means 447 disposed in the controller portion D outputs a signal informing that the abnormality has occurred to the display portion 33 provided in the image forming apparatus main body 100 and/or the host 441 (step 5108).

In addition, the data writing and reading means 432 disposed in the engine portion C receives the output from the comparing means 448 via the video interface (I/F) 443, and prohibits the memory means 31 of the process cartridge B to overwrite the currently confirmed remaining-developer-amount level TA2 in place of the remaining-developer-amount level TA0 confirmed by the previous remaining-developer-amount detection, and causes the memory means 31 to memorize the information that the abnormality has occurred (step 5109).

On the other hand, in the comparing means 445 disposed in the engine portion C, processing that enables a more precise remaining-developer-amount detection is performed. That is, TA2 and TA0 are compared to find which is larger (step 5115) and, if the newly confirmed remaining-developer-amount level TA2 is larger, upon receiving a signal from the comparing means 445, a request to update the developer-amount level is not produced. Thus, the remaining-developer amount which is transmitted to the display portion 33 and/or the host 441 by the signal output means 447 disposed in the controller portion D stays as the previously confirmed remaining-developer-amount level TA0 (Step 5116).

In addition, if the remaining-developer-amount level TA2 currently confirmed by the remaining developer amount detecting means 20 is smaller than TA0, upon receiving a signal from the comparing means 445, the remaining-developer-amount level TA2 is transmitted to the signal output means 447 disposed in the controller portion D via the video interface (I/F) 443 (step 5117).

Moreover, the data writing and reading means 432 receives a signal from the comparing means 445, replaces TA0 of the memory means 31 with TA2, and memorizes it as new TA0 (step 5118).

By repeating the above-mentioned processes, the remaining-developer-amount display is updated, and at the same time, an abnormality detection of the cartridge and the image forming apparatus is executed.

Further, although the configuration in which the controller portion is made to have a part of the comparing function of the remaining-developer-amount level in this embodiment, a configuration in which all the functions are held by the controller portion is also possible. In this case as well, there are two lines of outputs relating to the remaining-developer-amount level, namely, the current remaining developer amount level value confirmed by the remaining-developer-amount detecting means and the remaining-developer-amount level value confirmed in the previous remaining-amount-detection and memorized in the memory means 31, on the video interface (I/F) 443 being communication means of the controller portion D and the engine portion C.

In addition, although the flat antenna method is used as the remaining developer amount detecting means 20 in this embodiment, the present invention is not limited to the remaining-developer amount detecting means of this method. A method such as the agitating torque detecting method in the developer container 4 may be used, as far as it can detect the remaining-developer-amount level.

Moreover, the signal processing means 432 disposed in the image forming apparatus main body 100 may be mounted on the process cartridge B together with the memory means 31. By mounting a calculation processing apparatus relating to both the signal processing means 432 and the memory means 31 on the process cartridge B, communications such as writing and reading of data performed between the image forming apparatus main body 100 and the process cartridge B can be simplified. As a result, the possibility of the occurrence of communication errors by a defective contact, a noise and the like is decreased and a stable detection of the remaining-developer-amount level can be conducted.

Thirteenth Embodiment

One embodiment of the developing apparatus E constituted as a cartridge that is another aspect of the present invention will now be described.

The developing apparatus E of this embodiment, whose mechanical configuration is the same as that shown in FIG. 7, is constituted as a cartridge by integrally forming a developing chamber 5A holding developing means such as a developing roller 5*a* and an developing blade 5*c* and developer container 4 containing developer for supplying developer to the developing means 5 by developing frame bodies 11, 12 of plastic. That is, the developing apparatus E of this embodiment is the part of the process cartridge B forming the developing apparatus described in the first and the twelfth embodiments constituted as a unit, i.e., the developing apparatus E is part of a cartridge that is integrally formed by excluding the photosensitive drum 1, the charging means 2 and the cleaning means 7 from the process cartridge B. Therefore, all the developing apparatus constituting parts and the developer amount detecting means configuration described in the first and the twelfth embodiments are applied to the developing apparatus of this embodiment. Therefore, the above description in the twelfth embodiment is applied to descriptions concerning these configurations and operations, i.e., the remaining-developer-amount-indicating system and the abnormality detecting system.

Operations and effects similar to those in the twelfth embodiment can be attained in this embodiment as well.

Thus, it is seen that an image forming apparatus and a cartridge detachably attachable to the image forming apparatus is provided. One skilled in the art will appreciate that the present invention can be practiced by other than the preferred embodiments which are presented for the purposes of illustration and not of limitation, and the present invention is limited only by the claims which follow.

What is claimed is:

1. An image forming apparatus, which forms an image using a cartridge having a memory, said image forming apparatus comprising:

a developer container configured to contain developer;

a developer amount detecting portion configured to detect the remaining amount of the developer contained in said developer container, wherein the memory stores first information indicating that the remaining amount of the developer detected by said developer amount detecting portion is a first predetermined value or less, and second information indicating that the remaining amount of the developer detected by said developer amount detecting portion is a second predetermined value or less, the second predetermined value being less than the first predetermined value; and a controller, which writes the first information in the memory when the remaining amount of the developer detected by said developer amount detecting portion is the first predetermined value or less, and which writes the second information in the memory when the remaining amount of the developer detected by said developer amount detecting portion is the second predetermined value or less, wherein said controller outputs a signal indicating an abnormality in said image forming apparatus or the cartridge in the case in which the first information is not written in the memory and in which the second information is written in the memory.

2. An image forming apparatus according to claim 1, further comprising a display, wherein said display shows an indication that said image forming apparatus or the cartridge is abnormal based on the signal.

3. An image forming apparatus according to claim 1, further comprising an output portion configured to output the signal to an electronic apparatus having a display that can communicate with said image forming apparatus.

4. An image forming apparatus according to claim 1, wherein the memory further stores third information indicating the abnormality in said image forming apparatus or the cartridge.

5. An image forming apparatus according to claim 1, wherein the developer amount detecting portion includes an antenna.

6. An image forming apparatus according to claim 1, wherein said controller determines whether said image forming apparatus or the cartridge is abnormal on the basis of a storage state of the first information and the second information.

* * * * *

UNITED STATES PATENT AND TRADEMARK OFFICE

CERTIFICATE OF CORRECTION

PATENT NO. : 7,068,955 B2
APPLICATION NO. : 10/386687
DATED : June 27, 2006
INVENTOR(S) : Shinya Yamamoto et al.

It is certified that error appears in the above-identified patent and that said Letters Patent is hereby corrected as shown below:

ON THE TITLE PAGE, AT ITEM (57), Abstract:
Line 3, "comprises developer" should read --comprises a developer--.

IN THE DRAWINGS, SHEET NO. 4:
Figure 4, Items 20 and 33, "REMAINED" should read --REMAINING--.

IN THE DRAWINGS, SHEET NO. 5:
Figure 5, Items 101, 102, 105, 106, and 107, "REMAINED" should read --REMAINING--.

IN THE DRAWINGS, SHEET NO. 6:
Figure 5B, Items 110, 113, 114, "REMAINED" should read --REMAINING--.

IN THE DRAWINGS, SHEET NO. 7:
Figure 6, Items 20 and 33, "REMAINED" should read --REMAINING--.

IN THE DRAWINGS, SHEET NO. 9:
Figure 8, Items 20 and 33, "REMAINED" should read --REMAINING--.

IN THE DRAWINGS, SHEET NO. 10:
Figure 9A, Items 110, 111, 112, 115, and 116, "REMAINED" should read --REMAINING--.

IN THE DRAWINGS, SHEET NO. 13:
Figure 11, Item 2109, "REMAINED" should read --REMAINING--.

IN THE DRAWINGS, SHEET NO. 15:
Figure 13, Items 20 and 33, "REMAINED" should read --REMAINING--.

IN THE DRAWINGS, SHEET NO. 16:
Figure 14, Items 3102, 3104, 3105, 3107, and 3108, "REMAINED" should read --REMAINING--; and Item 3105, "DIFFERENT" should read --DIFFERENCE--.

IN THE DRAWINGS, SHEET NO. 17:
Figure 15, Item 20, "REMAINED" should read --REMAINING--.

UNITED STATES PATENT AND TRADEMARK OFFICE

CERTIFICATE OF CORRECTION

PATENT NO. : 7,068,955 B2
APPLICATION NO. : 10/386687
DATED : June 27, 2006
INVENTOR(S) : Shinya Yamamoto et al.

It is certified that error appears in the above-identified patent and that said Letters Patent is hereby corrected as shown below:

IN THE DRAWINGS, SHEET NO. 18:
Figure 16, Item 20, "REMAINED" should read --REMAINING--.

IN THE DRAWINGS, SHEET NO. 19:
Figure 17A, Items 4101, 4103, 4104, and 4106, "REMAINED" should read --REMAINING--.

IN THE DRAWINGS, SHEET NO. 20:
Figure 17B, Items 4107 and 4112, "DIFFERENT" should read --DIFFERENCE--; and Items 4109, 4110, 4112, and 4115, "REMAINED" should read --REMAINING--.

IN THE DRAWINGS, SHEET NO. 21:
Figure 18A, Items 201, 203, 204, and 208 "REMAINED" should read --REMAINING--.

IN THE DRAWINGS, SHEET NO. 22:
Figure 18B, Items 209 and 214, "DIFFERENT" should read --DIFFERENCE--; and Items 211, 212, and 217, "REMAINED" should read --REMAINING--.

IN THE DRAWINGS, SHEET NO. 23:
Figure 19, Item 20, "REMAINED" should read --REMAINING--.

IN THE DRAWINGS, SHEET NO. 24:
Figure 20A, Items 5101, 5102, 5104, 5105, 5106, 5107, and 5510, "REMAINED" should read --REMAINING--; and Items 5107, "DIFFERENT" should read --DIFFERENCE--.

IN THE DRAWINGS, SHEET NO. 25:
Figure 20B, Items 5109, 5116, 5117, and 5118, "REMAINED" should read --REMAINING--; and Item 5114, "DIFFERENT" should read --DIFFERENCE--.

COLUMN 7:
Line 38, "deceases" should read --decreases--.

COLUMN 9:
Line 48, "cartridge B; (step 102)" should read --cartridge B (step 102),--.

UNITED STATES PATENT AND TRADEMARK OFFICE

CERTIFICATE OF CORRECTION

PATENT NO. : 7,068,955 B2
APPLICATION NO. : 10/386687
DATED : June 27, 2006
INVENTOR(S) : Shinya Yamamoto et al.

It is certified that error appears in the above-identified patent and that said Letters Patent is hereby corrected as shown below:

COLUMN 10:
Line 15, “be the” should read --be--.

COLUMN 11:
Line 25, “is” should read --are--.

COLUMN 20:
Line 37, “0 1 1 0” should read --0 1 1 1--.

COLUMN 22:
Line 23, “1.” should begin a new paragraph.
Line 30, “detected)” should read --detected).--.
Line 62, “OUT”.” should read --OUT”--.
Line 64, “2-2.” should begin a new paragraph.

COLUMN 23:
Line 17, “detected the” should read --detected--.
Line 52, “is 1 It” should read --is 1. It--.

COLUMN 25:
Line 56, “The method” should read --The methods--.
Line 59, “it” should read --they--.

COLUMN 27:
Line 11, “confirmed the” should read --the--.
Line 12, “the” should be deleted.
Line 31, “approximate the” should read --approximate--.

COLUMN 29:
Line 13, “an” should read --a--.
Line 50, “the remaining-developer-amount” should read --remaining-developer-amount--.

COLUMN 30:
Line 6, “the” should be deleted.

COLUMN 32:
Line 4, “Written” should read --written--.

UNITED STATES PATENT AND TRADEMARK OFFICE

CERTIFICATE OF CORRECTION

PATENT NO. : 7,068,955 B2
APPLICATION NO. : 10/386687
DATED : June 27, 2006
INVENTOR(S) : Shinya Yamamoto et al.

It is certified that error appears in the above-identified patent and that said Letters Patent is hereby corrected as shown below:

COLUMN 34:
Line 57, "communicate" should read --communicates--.

COLUMN 39:
Line 22, "simplified" should bread --simplified.--.

COLUMN 41:
Line 32, "computer, a" should read --computer or a--; and "an" should be deleted.
Line 33, "apparatus" should read --apparatuses--.

COLUMN 42:
Line 38, "adopt" should read --adopts--.

COLUMN 43:
Line 28, "inform" should read --informs--.
Line 38, "communicate" should read --communicates--.

COLUMN 44:
Line 45, "use" should read --user--.

COLUMN 46:
Line 7, "the" should be deleted.
Line 33, "host 44i" should read --host 441--.

Signed and Sealed this

Twenty-third Day of December, 2008

JON W. DUDAS
*Director of the United States Patent and Trademark Office*